US009061816B2

(12) United States Patent
Best et al.

(10) Patent No.: US 9,061,816 B2
(45) Date of Patent: Jun. 23, 2015

(54) DISPENSING SYSTEM FOR DISPENSING A PRODUCT FROM A HANDHELD CONTAINER

(75) Inventors: Arnie M. Best, Pudong (CN); Nancy L. Broen, Racine, WI (US); Douglas P. Gundlach, Racine, WI (US); Paul Katz, New York, NY (US); Brook S. Kennedy, Glen Ridge, NJ (US); Boris Kontorovich, Brooklyn, NY (US); Hideaki Matsui, New York, NY (US); Leah Pelowski, Milwaukee, WI (US); Judith A. Rath, Milwaukee, WI (US); Matthew N. Thurin, Wauwatosa, WI (US); Richard Whitehall, New York, NY (US); Steven A. Zach, Waterford, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 320 days.

(21) Appl. No.: 13/024,760

(22) Filed: Feb. 10, 2011

(65) Prior Publication Data

US 2011/0192867 A1 Aug. 11, 2011

Related U.S. Application Data

(60) Provisional application No. 61/337,668, filed on Feb. 10, 2010.

(51) Int. Cl.
*B65D 88/54* (2006.01)
*B65D 83/20* (2006.01)

(52) U.S. Cl.
CPC ..... *B65D 83/206* (2013.01)

(58) Field of Classification Search
CPC ..... B65D 88/54
USPC ..... 222/402.1, 402.13, 402.15, 469–474, 222/320–321.9, 325; 239/154, 333
See application file for complete search history.

(56) References Cited

U.S. PATENT DOCUMENTS

| | | | | |
|---|---|---|---|---|
| 2,683,579 | A | 7/1954 | Wallace | |
| 3,189,232 | A * | 6/1965 | Joffe | 222/402.13 |
| 3,409,186 | A | 11/1968 | Melocchi | |
| 3,868,188 | A | 2/1975 | Velardi | |
| 3,888,392 | A | 6/1975 | Van Coney | |
| 4,078,508 | A | 3/1978 | Schertenleib | |

(Continued)

FOREIGN PATENT DOCUMENTS

| | | |
|---|---|---|
| DE | 2646149 A1 | 4/1978 |
| EP | 0024263 A1 | 2/1981 |

(Continued)

OTHER PUBLICATIONS

PCT/US2011/000238 International Search Report dated Aug. 8, 2011.

*Primary Examiner* — Paul R Durand
*Assistant Examiner* — Andrew P Bainbridge

(57) ABSTRACT

An overcap for a container includes a body having a sidewall. An opening is provided in the sidewall. An actuation mechanism includes an actuator with an elongate button and a manifold. The elongate button extends through the opening in the sidewall. The actuation mechanism is actuable to open a valve of a container by movement of the elongate button in a direction substantially perpendicular to a longitudinal axis of the overcap.

25 Claims, 61 Drawing Sheets

(56) References Cited

U.S. PATENT DOCUMENTS

| | | | | |
|---|---|---|---|---|
| 4,358,483 | A | 11/1982 | Waugh | |
| 4,510,665 | A | 4/1985 | Scheurer | |
| 4,747,523 | A | 5/1988 | Dobbs | |
| 4,883,204 | A | 11/1989 | Kay et al. | |
| 5,203,478 | A | 4/1993 | de Laforcade et al. | |
| 5,249,713 | A * | 10/1993 | Reich et al. | 222/321.8 |
| 5,285,996 | A | 2/1994 | Waller | |
| 5,477,977 | A | 12/1995 | Cudzik | |
| 5,522,547 | A | 6/1996 | Dobbs et al. | |
| 5,535,950 | A | 7/1996 | Barriac et al. | |
| 5,560,545 | A | 10/1996 | Grogan et al. | |
| 5,598,954 | A | 2/1997 | Salzano | |
| 5,657,907 | A | 8/1997 | Dobbs et al. | |
| 5,657,909 | A | 8/1997 | Barriac | |
| 5,704,521 | A | 1/1998 | Grogan et al. | |
| 5,711,457 | A | 1/1998 | Wanbaugh et al. | |
| 5,738,252 | A | 4/1998 | Dodd et al. | |
| 5,775,548 | A | 7/1998 | Hohmann et al. | |
| 5,779,108 | A | 7/1998 | Barriac et al. | |
| 5,839,616 | A * | 11/1998 | Irwin et al. | 222/321.8 |
| 5,842,675 | A * | 12/1998 | Davitt | 248/346.5 |
| 6,003,740 | A | 12/1999 | Castaneda, Jr. | |
| 6,095,377 | A | 8/2000 | Sweeton et al. | |
| 6,116,472 | A | 9/2000 | Wanbaugh et al. | |
| 6,131,820 | A | 10/2000 | Dodd | |
| 6,200,055 | B1 | 3/2001 | Fusaro, Jr. | |
| 6,286,728 | B1 | 9/2001 | Driskell et al. | |
| 6,318,595 | B1 | 11/2001 | Walters | |
| 6,332,562 | B1 | 12/2001 | Sweeton | |
| 6,338,422 | B1 | 1/2002 | DeJonge | |
| 6,510,967 | B1 | 1/2003 | DeSimone | |
| 6,527,144 | B2 * | 3/2003 | Ritsche et al. | 222/162 |
| 6,722,532 | B2 | 4/2004 | Lasserre et al. | |
| 6,802,197 | B2 | 10/2004 | Barrera | |
| 6,834,778 | B2 | 12/2004 | Jinbo et al. | |
| 6,891,125 | B2 | 5/2005 | Muhlenbach | |
| 6,918,547 | B2 | 7/2005 | Jaeger et al. | |
| 6,978,946 | B2 | 12/2005 | Sweeton | |
| 7,028,866 | B2 | 4/2006 | Kunesh et al. | |
| 7,137,536 | B2 | 11/2006 | Walters et al. | |
| 7,140,515 | B2 | 11/2006 | Cardwell, III et al. | |
| 7,204,393 | B2 * | 4/2007 | Strand | 222/402.13 |
| 7,325,705 | B2 | 2/2008 | Sweeton | |
| 7,344,053 | B2 | 3/2008 | Sweeton | |
| 7,350,675 | B2 | 4/2008 | Sweeton | |
| 7,360,672 | B2 | 4/2008 | Sweeton | |
| 7,455,198 | B2 | 11/2008 | Foster et al. | |
| 7,497,358 | B2 | 3/2009 | Clynes et al. | |
| 7,509,955 | B2 | 3/2009 | Cole et al. | |
| 7,571,836 | B2 | 8/2009 | Foster et al. | |
| 7,637,396 | B2 | 12/2009 | Foster et al. | |
| 7,677,416 | B2 | 3/2010 | Foster et al. | |
| 7,721,920 | B2 | 5/2010 | Ruiz De Gopegui et al. | |
| 7,959,040 | B2 | 6/2011 | Heirman | |
| 8,087,546 | B2 | 1/2012 | Rabinovitch | |
| 8,123,082 | B2 | 2/2012 | Hayton et al. | |
| 8,201,714 | B2 * | 6/2012 | Tomkins et al. | 222/402.13 |
| 2003/0152411 | A1 | 8/2003 | Prokopos | |
| 2004/0050869 | A1 | 3/2004 | Jennings et al. | |
| 2004/0188473 | A1 | 9/2004 | Groh et al. | |
| 2004/0251259 | A1 | 12/2004 | Copeland | |
| 2006/0180612 | A1 * | 8/2006 | Paas et al. | 222/182 |
| 2006/0273200 | A1 * | 12/2006 | Williams et al. | 239/337 |
| 2007/0023457 | A1 | 2/2007 | O'Toole et al. | |
| 2007/0102455 | A1 | 5/2007 | Stark et al. | |
| 2008/0190968 | A1 * | 8/2008 | Heirman | 222/402.15 |
| 2009/0017243 | A1 | 1/2009 | Person Hei et al. | |
| 2009/0050598 | A1 | 2/2009 | Huang et al. | |
| 2009/0050599 | A1 | 2/2009 | Martin et al. | |
| 2009/0114215 | A1 | 5/2009 | Boeck et al. | |
| 2009/0127293 | A1 | 5/2009 | de Laforcade | |
| 2009/0289086 | A1 | 11/2009 | de Laforcade | |
| 2010/0059551 | A1 * | 3/2010 | Tomkins et al. | 222/402.13 |
| 2011/0017701 | A1 | 1/2011 | Soliman | |

FOREIGN PATENT DOCUMENTS

| | | | |
|---|---|---|---|
| FR | 1556667 | A | 2/1969 |
| FR | 94437 | E | 8/1969 |
| WO | 2007062205 | A2 | 5/2007 |
| WO | 2007140407 | A2 | 12/2007 |
| WO | 2010056724 | A1 | 5/2010 |
| WO | 2012127163 | A1 | 9/2012 |
| WO | 2012127165 | A1 | 9/2012 |
| WO | 2012127166 | A1 | 9/2012 |
| WO | 2012127167 | A1 | 9/2012 |

* cited by examiner

DISPENSING SYSTEM FOR DISPENSING A PRODUCT FROM A HANDHELD CONTAINER

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE DISCLOSURE

1. Field of the Disclosure

The present disclosure relates to a dispensing system that facilitates the emission of a fluid product from a hand-held container.

2. Description of the Background of the Disclosure

Various hand-held dispensing systems are known in the prior art, which comprise a container, an overcap, and a dispensing mechanism that facilitates the release of a fluid product. Generally, these dispensing mechanisms are manufactured without regard to various factors that assist in the use of the dispensing mechanisms and spraying of the fluid product. For example, in one type of system a container is provided with an overcap, which includes a button disposed on a top portion of the overcap to depress a valve stem of the container to release fluid therefrom. In other prior art systems, actuation is accomplished via a trigger that requires a user to exert a significant amount of force on a specific location of a trigger to pivot same about a hinge axis. All of these prior art systems fail to provide a dispensing mechanism that is universally easy to operate for different types of users.

Another significant obstacle to efficient and effective use of hand-held dispensing systems is that many of the prior art containers and overcaps are bulky and unwieldy for a user to hold and operate. Frequently, these systems use elongated cylindrical containers having a uniform diameter throughout a main portion of the container. Containers of this sort are easy to manufacture, but ignore significant challenges that users encounter in grasping and manipulating the container during use.

SUMMARY OF THE INVENTION

According to one aspect of the invention, an overcap for a container includes a body having a sidewall. An opening is provided in the sidewall. An actuation mechanism includes an actuator with an elongate button and a manifold. The elongate button extends through the opening in the sidewall. The actuation mechanism is actuable to open a valve of a container by movement of the elongate button in a direction substantially perpendicular to a longitudinal axis of the overcap.

According to another aspect of the invention, a dispensing system includes an overcap disposed on a container. A portion of a sidewall of the container and the overcap has a continuously varying cross-section, which defines a gripping portion that extends a length L in a direction about a longitudinal axis of the dispensing system. The dispensing system also includes an elongate button extending through an aperture within the sidewall of the overcap. The elongate button has a length l in a direction about the longitudinal axis of the dispensing system. A ratio of the length L of the gripping portion to the length l of the elongate button is between about 1.5:1 to about 10:1.

According to yet another aspect of the invention, a dispensing system includes a container with a valve. An overcap is seated on the container. A sidewall of the overcap includes an opening provided therein. An actuator with an elongate button is also provided. The elongate button extends through the opening in the sidewall and includes an upper portion, a middle portion, and a lower portion. The actuator is adapted to open the valve of the container by movement of the elongate button in a direction substantially perpendicular to a longitudinal axis of the overcap. A force F may be exerted on any one of the upper portion, the middle portion, or the lower portion of the elongate button to open the valve of the container.

DETAILED DESCRIPTION OF THE DRAWINGS

Figure 1:
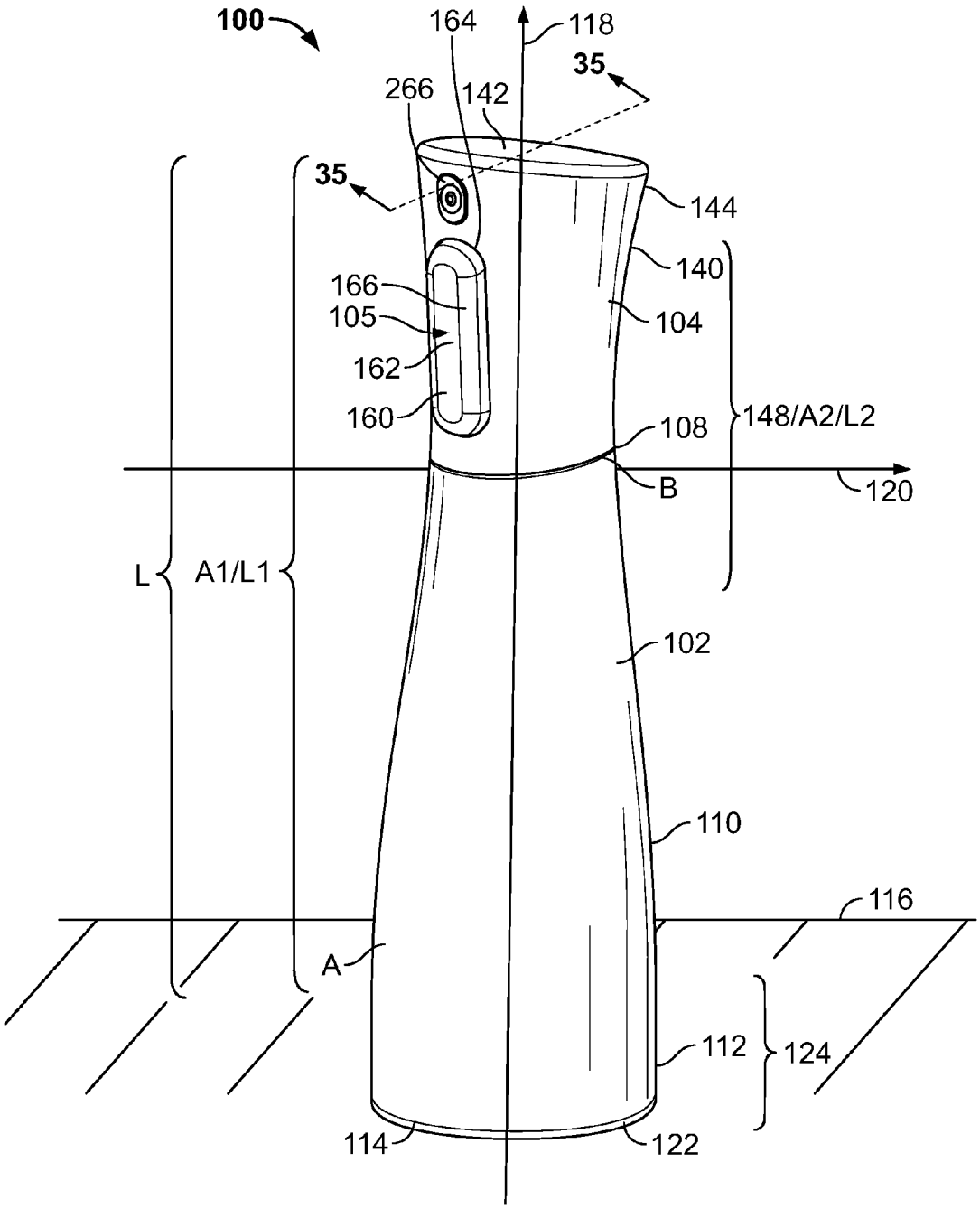
FIG. 1 is an isometric view of a top, front, and left side of a dispensing system, which includes a container and an overcap disposed on a support surface.

FIG. 1 depicts a dispensing system 100, which includes a container 102, an overcap 104 disposed on a top portion 106

(see FIGS. 3 and 4) thereof, and an actuation mechanism 105 (see FIG. 25) disposed within the overcap 104. As shown in FIG. 1, the container 102 and overcap 104 are manufactured or otherwise connected to intersect at a seam 108 to form a unitary structure. The overcap 104 is retained on the container 102 by an interference fit, threads, snap fit, or by any other means known to one of skill in the art.

As shown in FIGS. 2-5, the container 102 comprises a sidewall 110 that extends upwardly from a base portion 112. The base portion 112 is disposed adjacent a bottom end 114 of the container 102. The bottom end 114 is adapted to interact with a substantially planar support surface 116 when the dispensing system 100 is not in use, e.g., a table, a desk, a cabinet, etc. When resting on the substantially planar support surface 116, a central or longitudinal axis 118 of the container 102 is perpendicular with respect to the support surface 116 (see FIG. 1). A latitudinal axis 120 (see FIG. 3) is also defined in a parallel relationship with respect to the support surface 116 and a perpendicular relationship with respect to the longitudinal axis 118.

The bottom end 114 of the present embodiment is also covered by a soft pad 122, which in the present embodiment is circular in shape. In other embodiments, the soft pad 122 extends partially or fully onto the base 112 of the container 102. The soft pad 122 is preferably between about 1 mm to about 50 mm thick. In a preferred embodiment, the soft pad 122 is about 5 mm thick and is made from a material that provides one or more gripping and protective attributes to ensure that the container 102 is resting securely and in a non-marring manner on the support surface 116. In a different embodiment, the soft pad 122 also provides noise dampening attributes. In other embodiments the soft pad 122 is provided with a different geometric shape, such as an oval or square shape. Further, the soft pad 122 may be fashioned to be complementary in shape to all or part of the bottom end 114 and/or base portion 112.

The soft pad 122 is preferably a natural or synthetically produced elastomer such as urethane or plastisol, a flocking material, a cloth material such as felt, and/or the like. In a different embodiment, the soft pad 122 is manufactured from a printed UV polyurethane or may be produced by a roll-coating process. In one embodiment, the soft pad 122 is attached to the bottom end 114 using a thin layer of adhesive. In a different embodiment, the soft pad 122 may be extruded or otherwise formed integrally to the bottom end 114, press fit into a groove provided in the bottom end 114, or otherwise secured by any means known to one of skill in the art.

Figure 6:
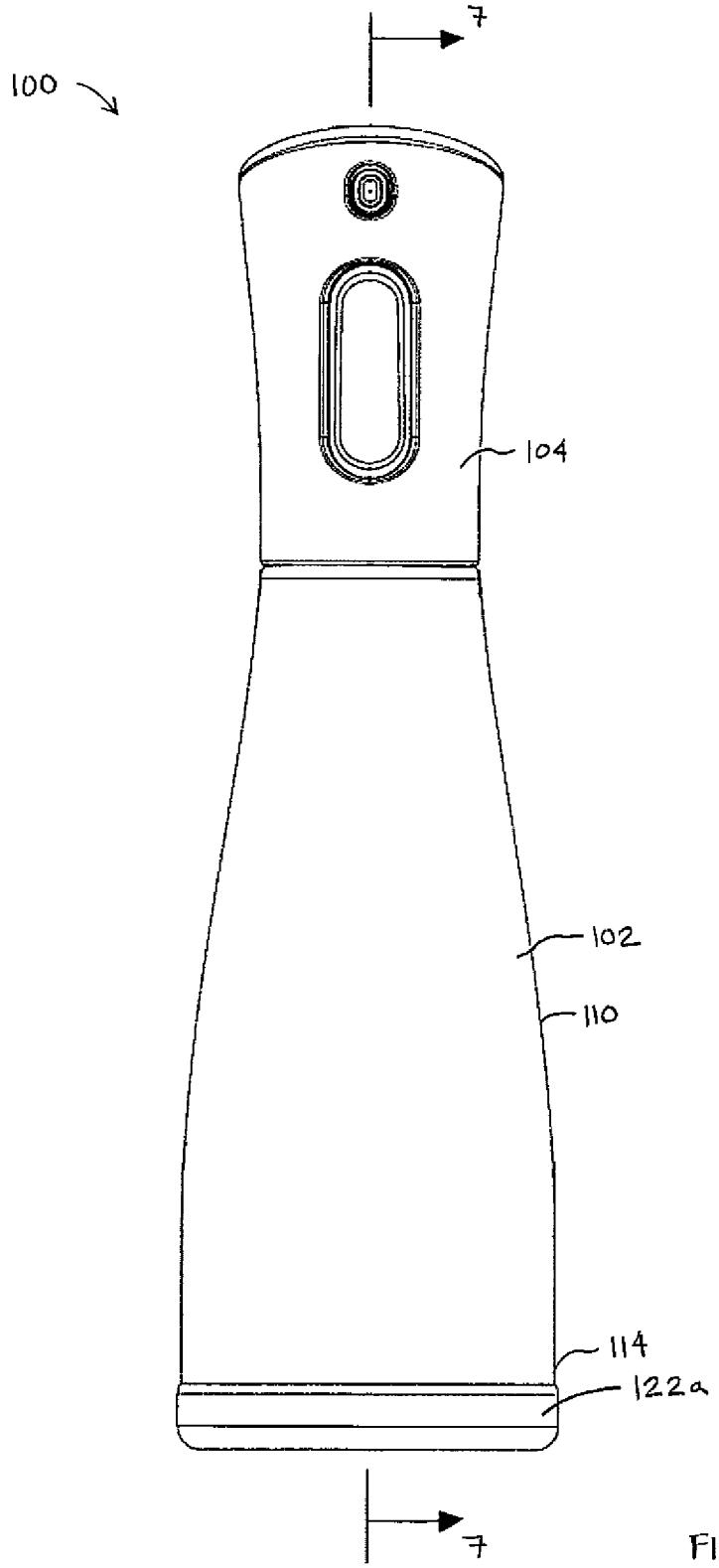
FIG. 6 is a front elevational view of the dispensing system of FIG. 1, which includes a cap piece.
Figure 7:
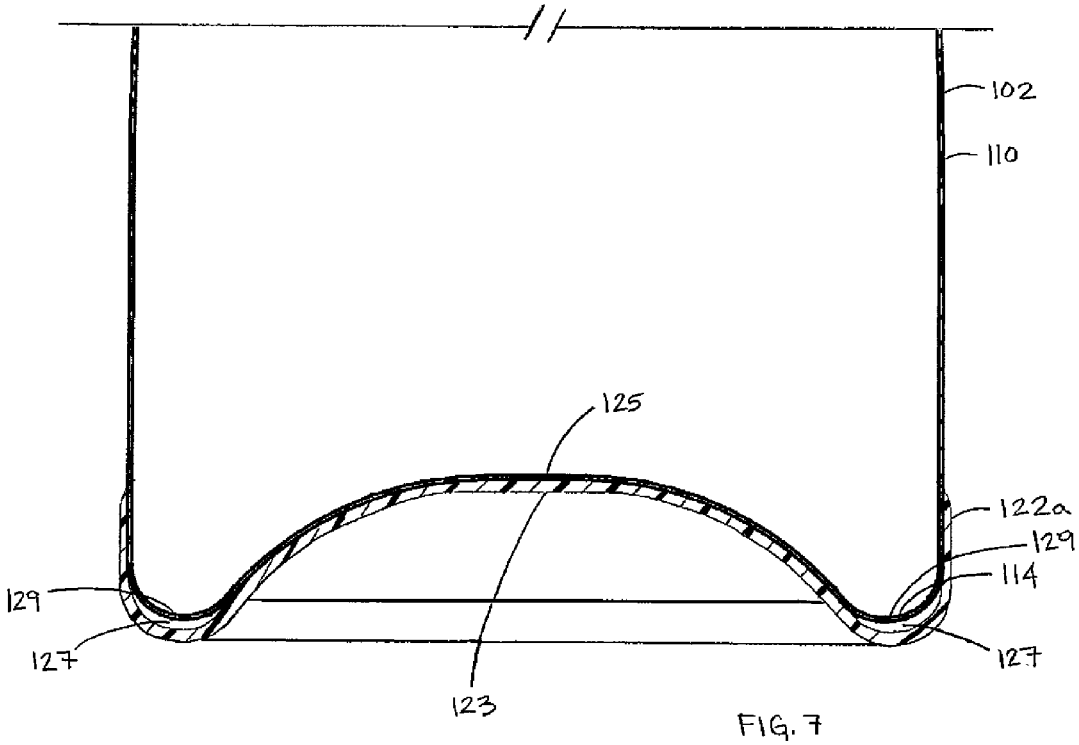
FIG. 7 is a partial cross-sectional view of the dispensing system of FIG. 1 generally taken along the line 7-7 of FIG. 6.

In one particular embodiment, shown in FIGS. 6 and 7, the soft pad comprises a molded cap piece 122*a* capable of being slid over the bottom end 114 of the container 102. Peripheral portions of the cap piece 122*a* fit snugly around the sidewall 110 to retain the cap piece 122*a* on the container 102. Further, the cap piece 122*a* includes an upraised central domed portion 123, which is substantially complementary in shape to a bottom wall 125 of the container 102. An adhesive is applied to the domed portion of the cap piece 122*a* to connect the cap piece 122*a* to the bottom wall 125. Additionally, an air pocket 127 is provided between the cap piece 122*a* and the weight bearing portion 129 of the container 102. The air pocket 127 provides additional noise dampening when the dispensing system 100 is placed on a surface 116. In one embodiment, the cap piece 122*a* is made from a polyolefin such as Softcell CA 02 A, Hifax CA 10 A, or Hifax CA 207 A manufactured by Lyondel Bassell. The soft bottom cap piece 122*a* may also be made from a plastomer such as Versify 4200 or an elastomer such as Engage, both manufactured by Dow Chemical Company, or an elastomer such as Dynaflex 7650-9, G7670-9, or G7690-9 manufactured by GLS. This list of materials is not exclusive, and it is contemplated that the soft bottom cap piece 122*a* could be made from other similar materials known to one of ordinary skill in the art.

The thickness of the soft pad 122 may be varied depending on the desired use for the dispensing system 100. Specifically, assuming a constant height for the dispensing system 100, which may be dictated by the maximum shelf space found in a typical retail store, the thickness of the soft pad 122 will impact the overall volume capacity of the dispensing system 100 such that the thicker the soft pad 122, the less volume available for product within the dispensing system 100. In addition to the benefits discussed previously herein, the soft pad 122 provides other benefits to users including protecting the bottom end 114 of the container 102 from rusting, dampening of the noise that the dispensing system 100 makes when the user places the dispensing system 100 onto the support surface 116, and assisting the user as a spraying aid, e.g., by allowing a user to rest a portion of the dispensing system 100 on a support surface, which will allow a user to properly aim the system 100 for accurate spraying. Additionally, the soft pad 122 may include absorbent properties, which may be useful in capturing liquid residue or other moisture that travels downwardly toward the bottom end 114 of the container 102 or upwardly from the support surface 116.

It is also contemplated that other embodiments of the dispensing system 100 may omit the soft pad 122 from the bottom end 114 of the container 102. In these embodiments, the container 102 is provided with a conventional container bottom end as known to those of skill in the art. The omission of the soft pad 122 may have the added benefit of allowing for an increased volumetric capacity of the container 102 or in decreased manufacturing costs.

Figure 2:
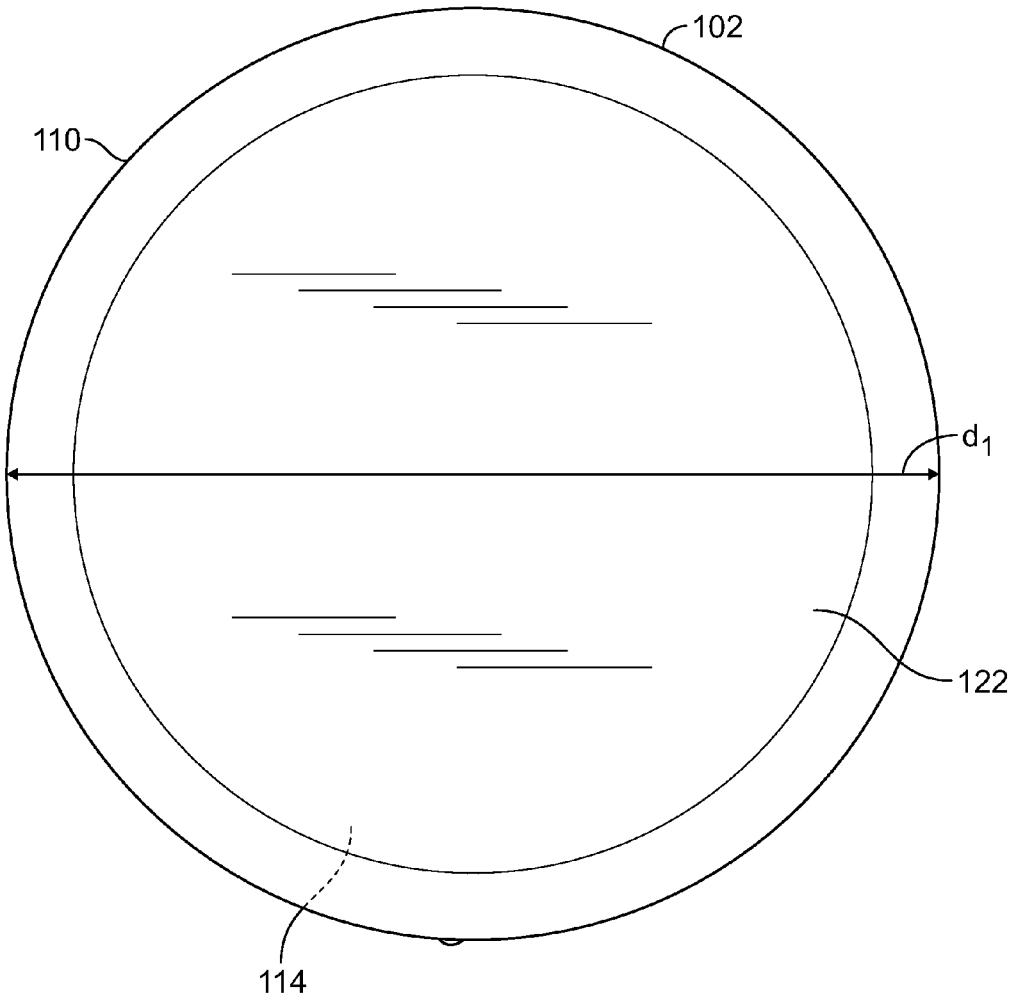
FIG. 2 is a bottom elevational view of the container of FIG. 1.
Figure 3:
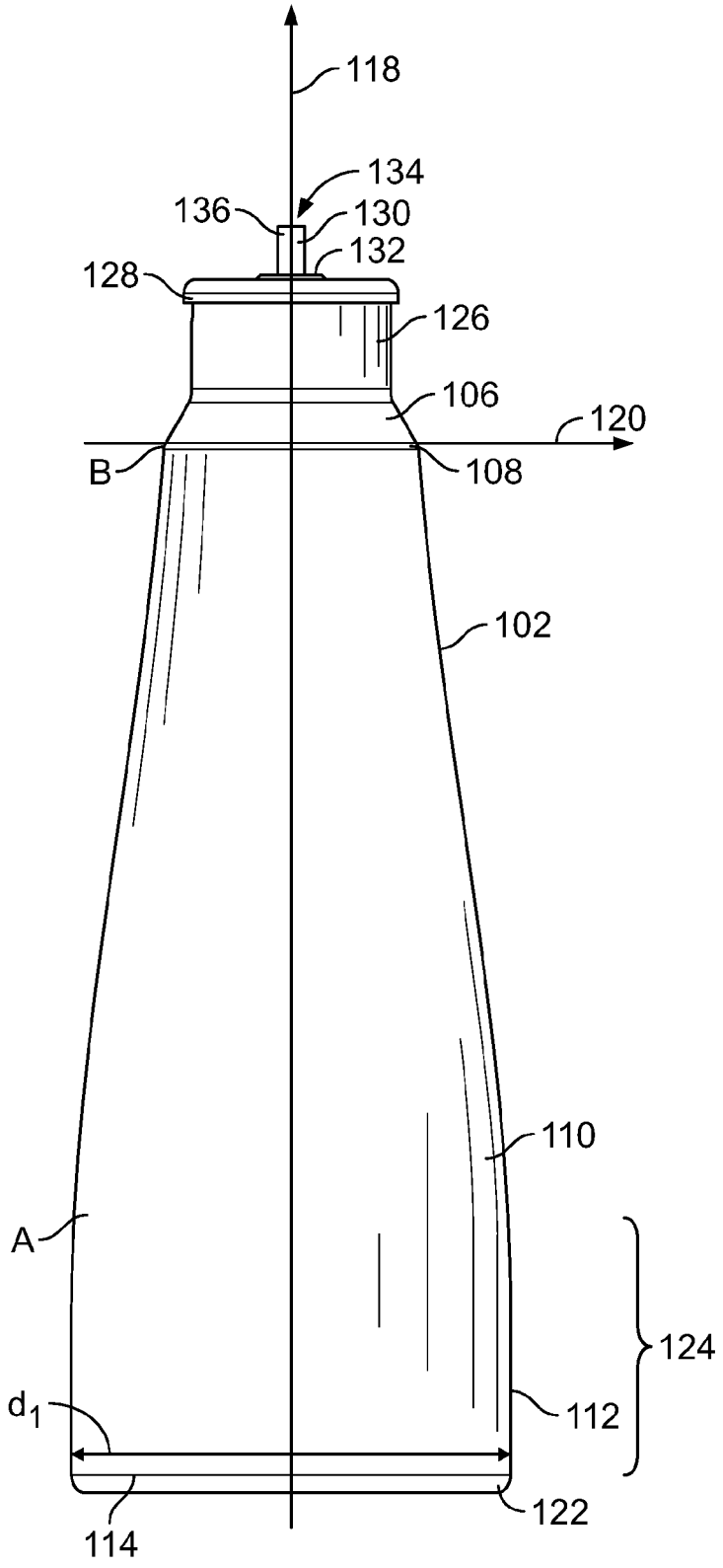
FIG. 3 is a front elevational view of the container of FIG. 1, wherein the rear elevational view is a mirror image of the front elevational view.

As best seen in FIG. 3, the sidewall 110 is substantially cylindrical from the bottom end 114 through a first region 124. As shown in FIGS. 2 and 3, the sidewall 110 is at its widest point at the bottom end 114 with a diameter $d_1$. The diameter $d_1$ of the bottom end 114 is preferably between about 40 mm to about 100 mm, more preferably between about 58 mm to about 69 mm, and most preferably about 66 mm. The sidewall 110 starts to slowly taper inwardly at a point A, which is approximately one quarter of the total height of the container 102 as measured from the soft pad 122 to the seam 108. In one preferred embodiment point A is located 38 mm from the bottom end 114 of the container 102. In a different embodiment, the sidewall 110 starts to taper at a point above point A. In a further embodiment, the sidewall 110 starts to taper at a point below point A.

Figure 5:
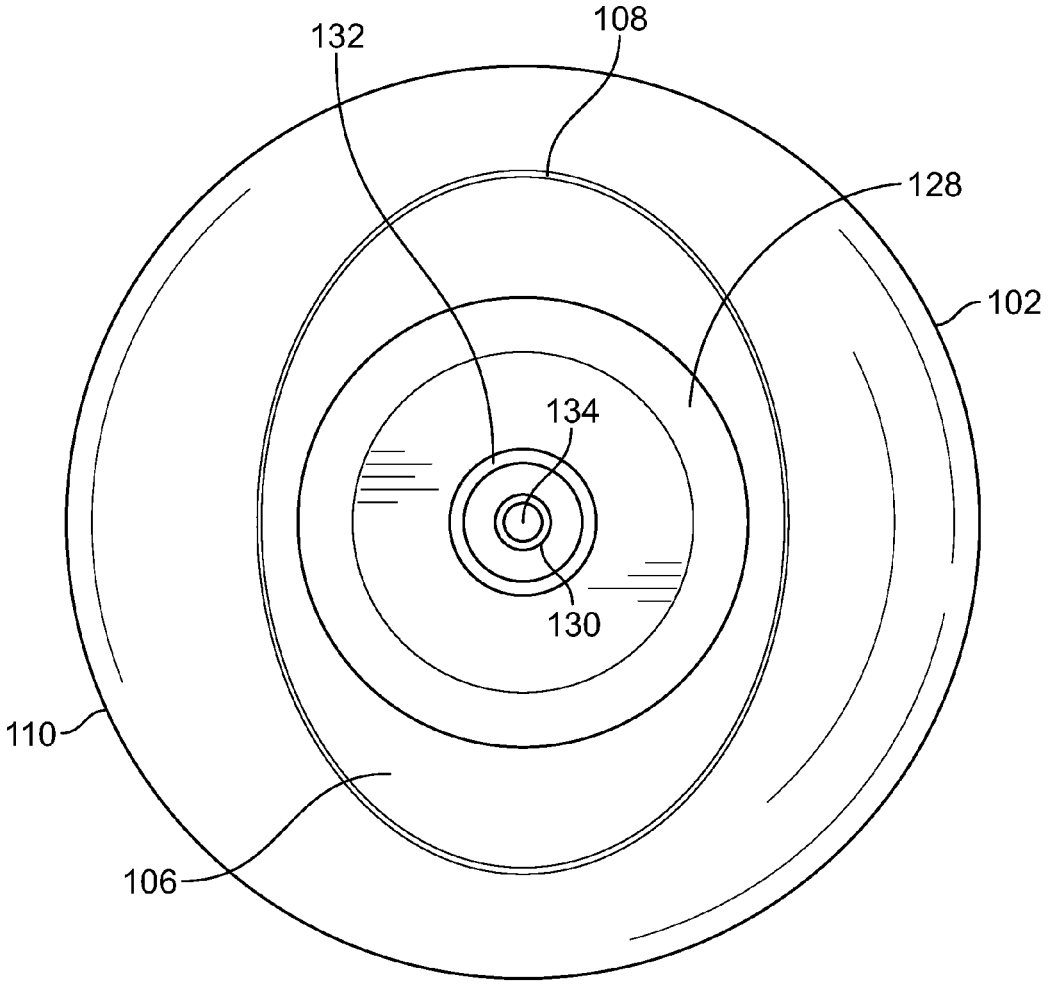
FIG. 5 is a top plan view of the container of FIG. 1.

Still referring to FIG. 3, the sidewall 110 tapers inwardly with respect to the longitudinal axis 118 until a point B. More specifically, the sidewall 110 has a generally convex shape until an inflection point adjacent a medial portion of the sidewall 110, wherein the sidewall 110 is imparted with a concave appearance thereafter. The concave portions of the sidewall have a greater radius of curvature as they approach the point B. The sidewall 110 tapers inwardly at an acute angle above point B toward a cylindrical-shaped neck 126. The neck 126 has a uniform cross-section throughout a length thereof. The neck 126 preferably has a diameter within a range of about 24 mm to about 36 mm. In the present embodiment the neck 126 has a diameter of about 30 mm. It is preferable that the diameter of the neck 126 be smaller than the diameter of the container 102 at point B to allow for attachment of the overcap 104 and effective actuation of laterally activated triggers and/or actuation mechanisms. As best seen in FIG. 5, the sidewall 110 is imparted with a cylindrical shape that tapers upwardly into a generally oval shape throughout the remainder of the container 102 until the top portion 106.

Figure 4:
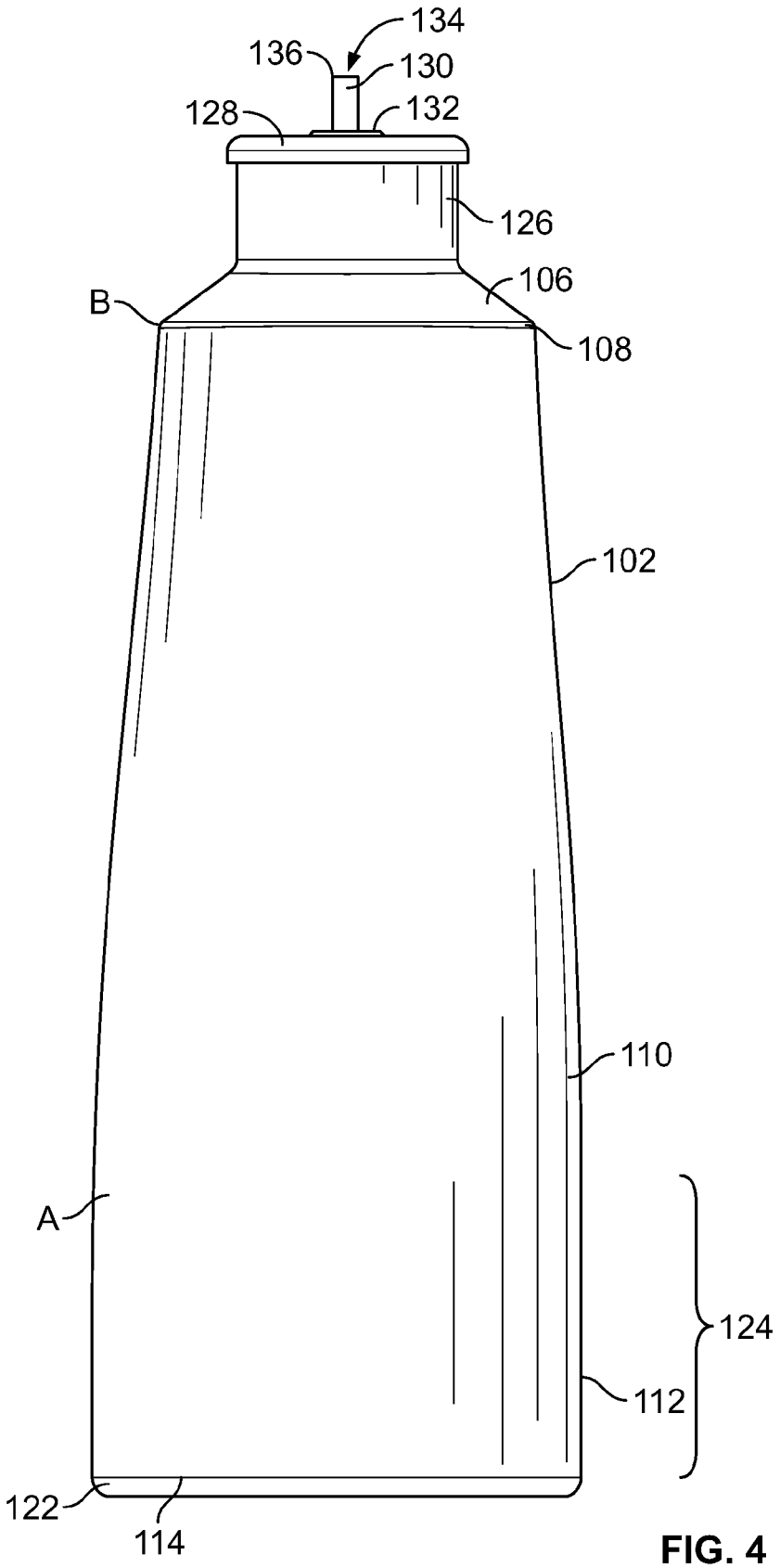
FIG. 4 is a left side elevational view of the container of FIG. 1, wherein the right side elevational view is a mirror image of the left side elevational view.

Referring to FIGS. 3-5, a mounting cup 128 is disposed within the neck 126 of the container 102. A valve assembly (not shown) is disposed within an upper portion of the container 102 and includes a valve stem 130 that extends through a pedestal 132 centered within the mounting cup 128. The valve stem 130 is generally a cylindrical tube having a passage 134 (see FIG. 5) disposed longitudinally therethrough. A distal end 136 of the valve stem 130 extends upwardly away from the mounting cup 128 and a proximal end (not shown) is disposed within the valve assembly. Axial compression of the valve stem 130 opens the valve assembly, which allows a pressure difference between an interior of the container 102 and the atmosphere to force the contents of the container 102 out through the valve stem 130.

The container 102 has a height component preferably within a range of about 83 mm to about 289 mm, and more preferably between about 127 mm to about 229 mm as measured between the mounting cup 128 and the bottom end 114. In a particular embodiment, the height is about 184.2 mm.

The container 102 holds a fluid product or other substance that is to be dispensed. The product may be in any suitable form including liquid or gas. The container 102 may include a propellant or other compressed gases to facilitate the release thereof. The fluid may be a fragrance or insecticide disposed within a carrier liquid, a deodorizing liquid, a cleaning and/or polishing formulation or the like. For example, the fluid may comprise PLEDGE®, a surface cleaning composition for household, commercial, and institutional use, or GLADE®, a household deodorant, both sold by S. C. Johnson and Son, Inc., of Racine, Wis. The fluid may also comprise other actives, such as personal care products, automotive car products, food products, paints, sanitizers, air fresheners, odor eliminators, mold or mildew inhibitors, insect repellents, insecticides, anti-allergens, anti-bacterials, and the like, or that have aromatherapeutic properties. The fluid alternatively comprises any fluid known to those skilled in the art that can be dispensed from the container 102. The dispensing system 100 is therefore adapted to dispense any number of different fluid formulations.

The dimensions of the dispensing system 100 may be varied as appropriate for the intended use. However, it has been found that a the volume of the dispensing system 100, which is directly correlated to the size of the container 102 for holding the product, impacts the ergonomic qualities of the dispensing system 100. The dispensing system 100 volume parameters may therefore be adjusted based on the need for more or less product volume in light of the desired ergonomic qualities for the dispensing system 100. Specifically, the volume capacity of the container 102 may be increased, but the dispensing system 100 is therefore harder to grip and less ergonomic. The volume capacity of the container 102 may be decreased, which makes the dispensing system 100 more ergonomic to a finite point. Decreasing the volume of the container 102 too much causes the tapering to be extreme and the container 102 difficult to hold. Therefore, the parameters discussed herein provide a balance between appropriate volumetric capacity of the container 102 while maintaining the ergonomic features of the dispensing system 100.

As shown in FIGS. 8-17, the overall height h dimension of a container and overcap as well as a greatest diameter $d_1$ dimension of the container are important considerations in the volumetric capacity of the container. For purposes of our analysis, the height h dimension was manipulated between about 228 mm to about 249 mm to mirror a conventional maximum size of a shelf space found in a typical retail store. Further, the greatest diameter $d_1$ was manipulated between about 66 mm to about 69 mm to mirror conventional maximum width sizes required by retail stores and in light of conventional manufacturing tolerances. Finally, the tapering of the sidewall was manipulated to provide greater or less volumetric capacity within the container while taking into consideration the ergonomic characteristics of the dispensing system, i.e., the container in combination with the overcap.

Figure 8:
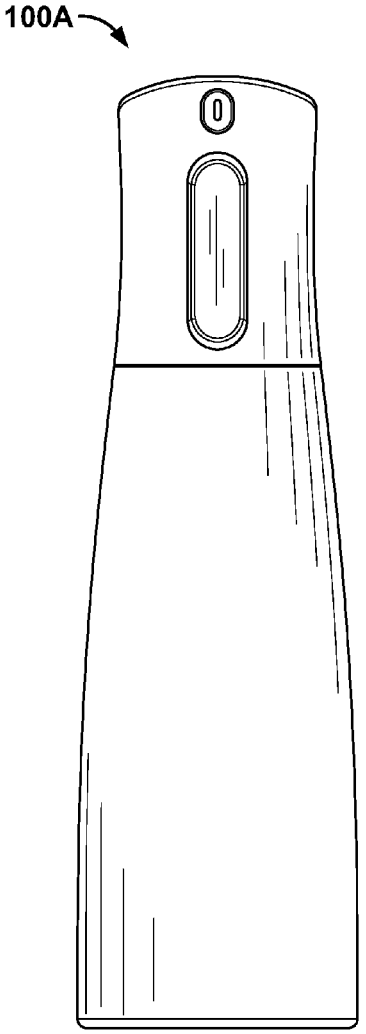
FIG. 8 is a front elevational view of a dispensing system.
Figure 9:
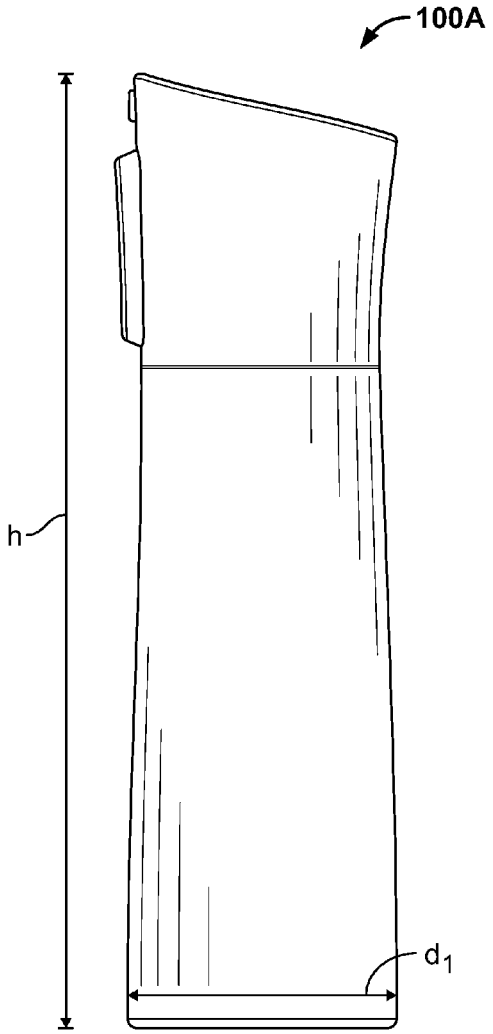
FIG. 9 is a left side elevational view of the dispensing system of FIG. 8.
Figure 10:
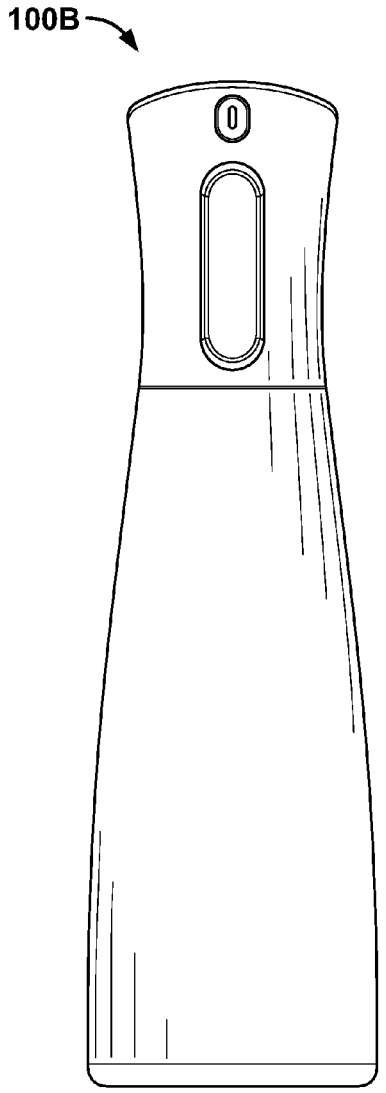
FIG. 10 is a front elevational view of a second embodiment of a dispensing system, which has a smaller volumetric capacity than the dispensing system shown in FIGS. 8 and 9.
Figure 11:
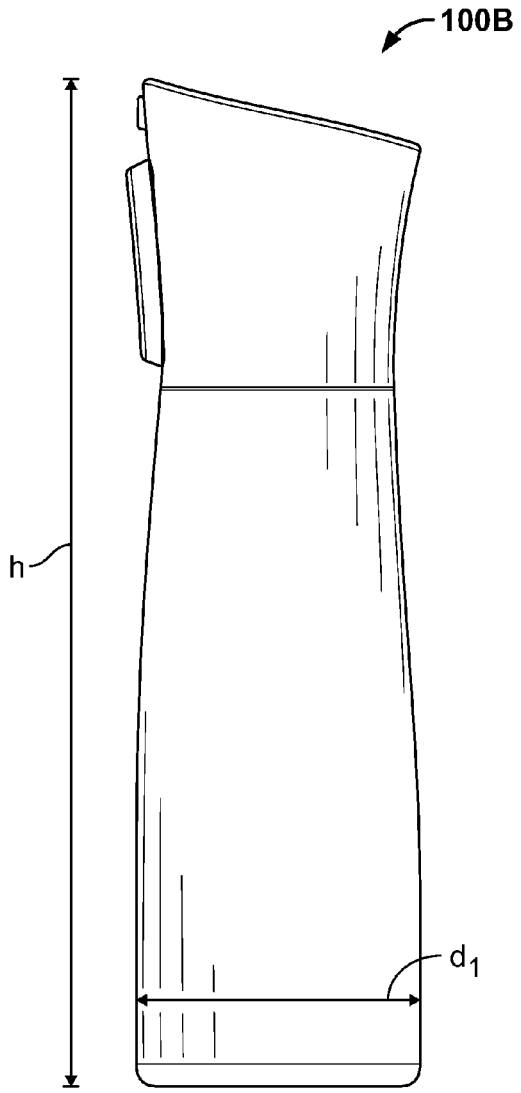
FIG. 11 is a left side elevational view of the dispensing system of FIG. 10.
Figure 12:
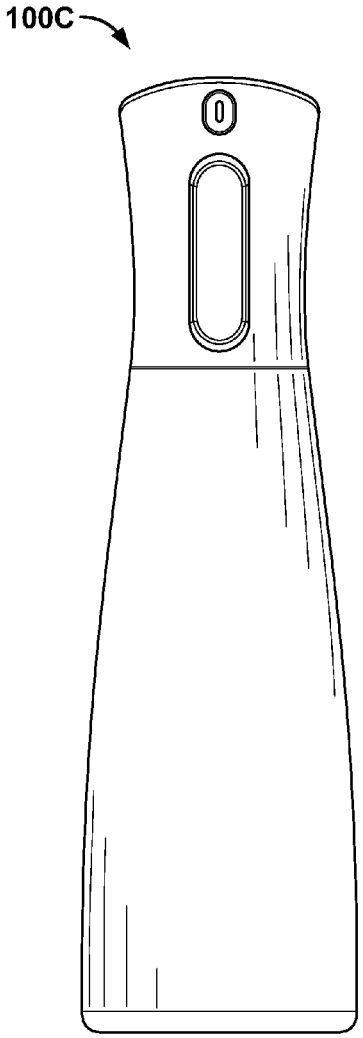
FIG. 12 is a front elevational view of a third embodiment of a dispensing system, which has a smaller volumetric capacity than the dispensing systems shown in FIGS. 8-11.
Figure 13:
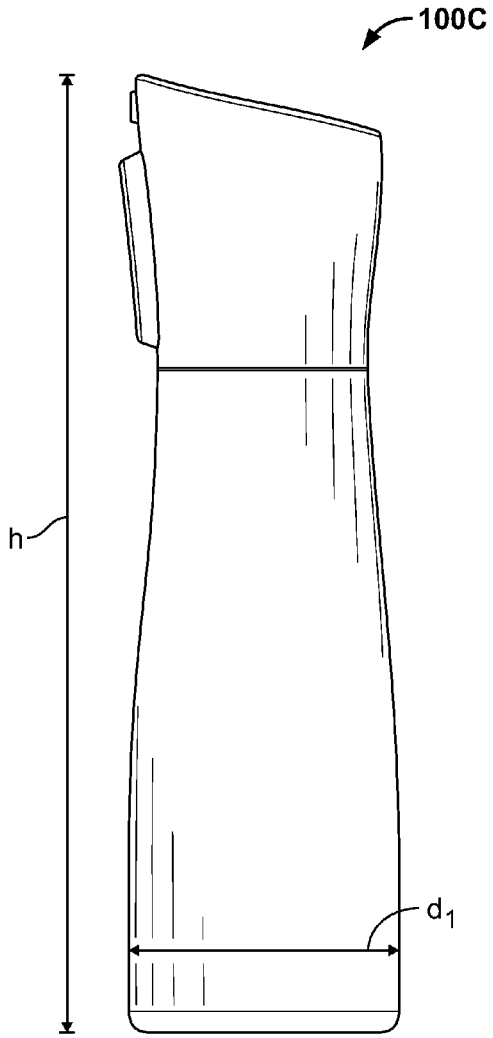
FIG. 13 is a left side elevational view of the dispensing system of FIG. 12.
Figure 14:
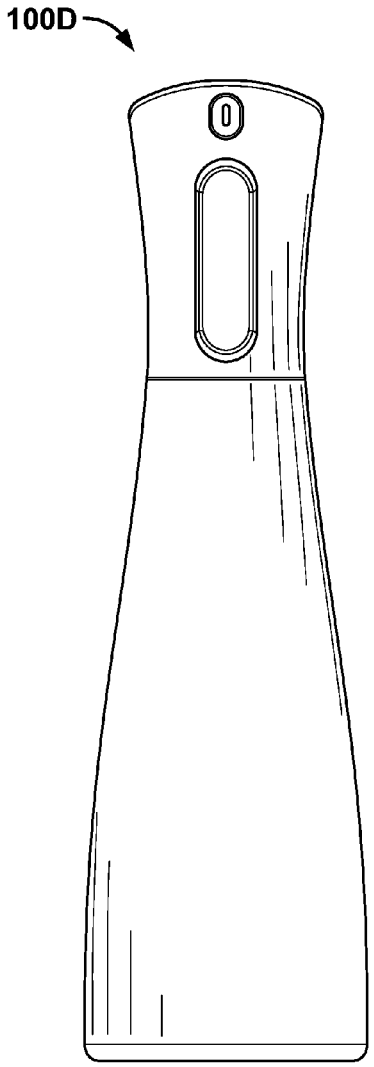
FIG. 14 is a front elevational view of a fourth embodiment of a dispensing system, which has a smaller volumetric capacity than the dispensing systems shown in FIGS. 8-13.
Figure 15:
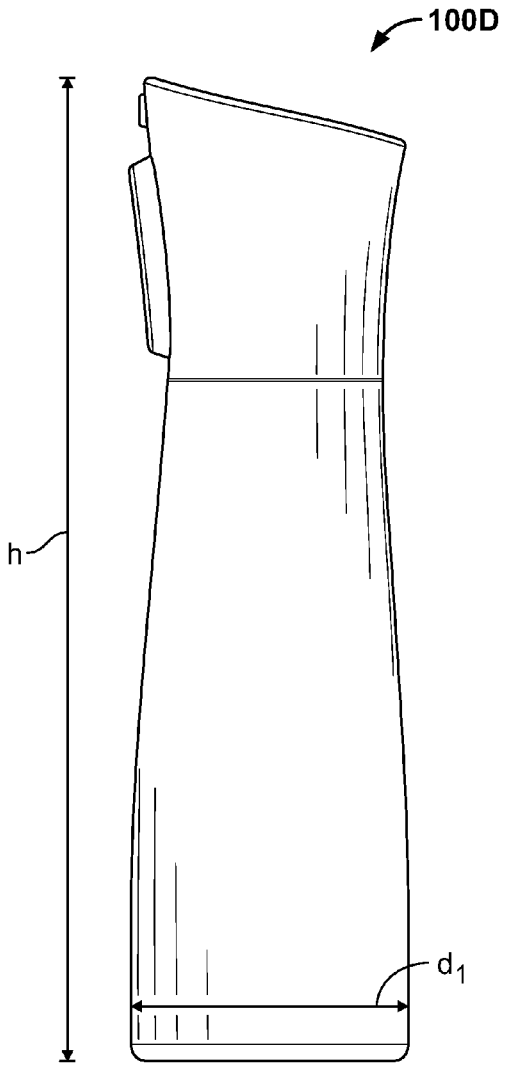
FIG. 15 is a left side elevational view of the dispensing system of FIG. 14.
Figure 16:
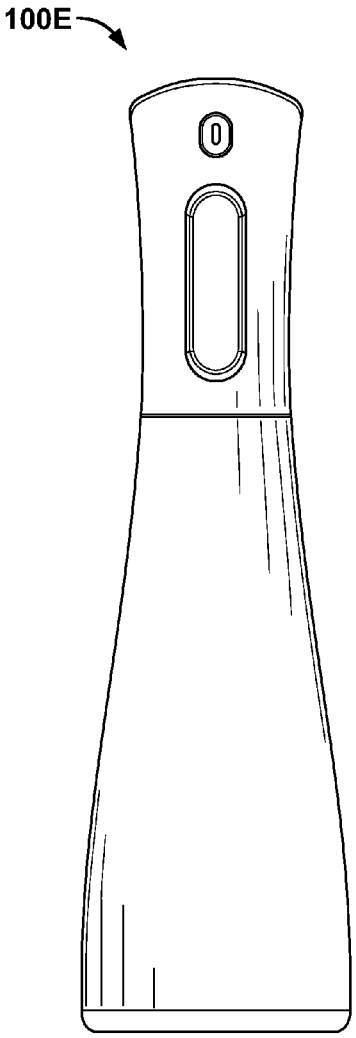
FIG. 16 is a front elevational view of a fifth embodiment of a dispensing system similar to the one shown in FIG. 1, which has a smaller volumetric capacity than the dispensing systems shown in FIGS. 8-13.
Figure 17:
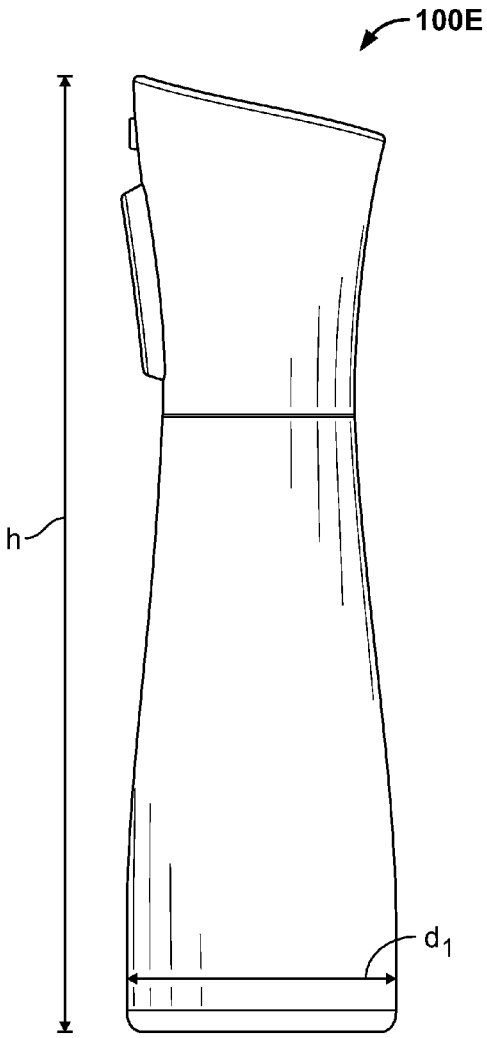
FIG. 17 is a left side elevational view of the dispensing system of FIG. 16.

Turning to FIGS. 8 and 9, a dispensing system 100A is depicted that has a height dimension h of about 228 mm, a greatest diameter $d_1$ of about 66 mm, and an overall container volume of about 483 $cm^3$. Although the container includes a significant volumetric capacity for product, the ergonomic characteristics of the dispensing system, while better than standard dispensers, are still not conducive to effective and comfortable holding by consumers. FIGS. 10 and 11 depict a dispensing system 100B that has been modified to have a height dimension h of about 228 mm, a greatest diameter $d_1$ of about 66 mm, and an overall volume of about 460 $cm^3$. As compared to dispensing system 100A, in this embodiment, the height h and diameter $d_1$ have been kept constant, but the sidewall of the container has been tapered to reduce the volumetric capacity of same and to increase the ergonomic characteristics of the container. In a continuing effort to increase the ergonomic characteristics of the dispensing systems 100A and 100B, a dispensing system 100C, depicted in FIGS. 12 and 13, was modified by further tapering the sidewall of the container to create a container with an overall volume of about 441 $cm^3$. Another test was run to increase the ergonomic characteristics of a dispensing system 100D beyond those found in dispensing systems 100A-100C by yet again tapering the sidewall of the container until an overall container volume of about 409 $cm^3$ was achieved. While good ergonomic characteristics were observed by users for dispensing system 100D (shown in FIGS. 14 and 15), another test was run to attempt to increase the volumetric capacity of the container while retaining the ergonomic benefits. Turning to FIGS. 16 and 17, a dispensing system 100E is depicted that is similar to the dispensing system 100D except for a modification of the tapering of the sidewall to account for an increase in the diameter $d_1$ and height h of the container to about 69 mm and about 249 mm, respectively, which resulted in an increase in the overall volumetric capacity of the container to about 435 $cm^3$. It has been determined that the dispensing system 100E offers an appropriate balance in terms of volumetric capacity and ergonomics as compared to the other dispensing systems 100A-100D.

Now turning to FIGS. 18-22, the overcap 104 is shown to comprise a body 140 and a top end 142. The body 140 includes a substantially oval-shaped sidewall 144. A bottom end 146 of the body 140 interacts with the container 102 at the seam 108 to provide a smooth transition between the container 102 and the overcap 104. Preferably, there is no substantial interruption between the container 102 and the overcap 104 to facilitate the user's grip and the appearance of a seamless dispensing system 100. Further, portions of the container 102 and the overcap 104 substantially mirror one another on opposing sides of the seam 108 to provide an ergonomic gripping surface. The overall shape of the overcap 104 will assist a user or manufacturer in properly orienting the overcap 104 onto the container 102, i.e., when the overcap 104 is lowered onto the container 102, the top portion 106 of the container 102 (see FIG. 4) will engage with the overcap 104 to position the two components accordingly.

As shown in FIG. 1, the ergonomic gripping surface broadly comprises the tapered sections of the container 102 above point A on the container 102 and tapered sections of the body 140 below the top end 142 of the overcap 104. A narrowest section 148 of the dispensing system 100 is provided in an area adjacent a medial portion of a button (described below), which spans portions of the container 102 and overcap 104 as seen in FIG. 1. The narrowest section 148 provides an ergonomic design that allows a user to comfortably grip the dispensing system 100. Further, the narrowest section 148 gives a visual indication to the user as to where to grip the dispensing system 100. Still further, the narrowest section 148 orients the user as to the dispensing direction of the dispensing system 100 so that the user correctly grips and positions the dispensing system 100 for use.

As generally shown in FIGS. 1, and 3-5, major and minor diameters about the length of the longitudinal axis 118 above point A are provided, which provide for tapered areas of the container 102 and overcap 104 to act as an ergonomic gripping surface extending a length L. An area A1 extending between point A and the top end 142 of the overcap 104 (see FIG. 1) defines a first gripping surface and has been found to exhibit consumer friendly ergonomic characteristics such as those noted above. The diameters that extend through a length L1 of area A1 are preferably within a range of about 38 mm to about 69 mm. In connection with the present embodiment that has a bottom end 114 diameter $d_1$ of 66 mm (see FIGS. 2 and 3), a preferred range of major diameters, which is defined as the widest diameter at a specific point, and minor diameters, which is defined as the diameter that bisects the major diameter, are provided. In the present embodiment, an area adjacent point A (see FIG. 1) preferably has a major diameter of about 66 mm to about 56 mm and a minor diameter of about 66 mm to about 50 mm, and more preferably has a major diameter of about 66 mm to about 60 mm and a minor diameter of about 66 mm to about 58 mm. The area A1 also defines the gripping length L1, which is preferably between about 90 mm and about 228 mm. An area A2, otherwise referred to as the narrowest section 148, defines a second gripping surface, which exhibits the greatest consumer friendly ergonomic characteristics such as those noted above. The narrowest section 148 preferably includes diameters therethrough within a range of about 38 mm to about 67 mm and is typically large enough to receive all or a substantial portion of an average human hand. The average length of a human hand in the United States as measured from a wrist crease of the hand to a top of a middle finger of the hand is 190.3 mm for a male and 175.7 mm for a female hand as provided in *The Handbook of Adult Anthropometric and Strength Measurements* created by the Department of Trade and Industry in the United Kingdom. The Area A2 also defines a second gripping length L2, which is described in more detail below.

With respect to the present embodiment, which has a bottom end 114 diameter $d_1$ of about 66 mm, preferred major and minor diameters are provided. Specifically, it is preferred to have a major diameter of about 65 mm to about 38 mm and a minor diameter of about 64 mm to about 38 mm, and more preferably to have a major diameter of about 52 mm to about 48 mm and a minor diameter of about 41 mm to about 38 mm. Both major and minor diameters are smaller than the diameter $d_1$ of the base portion 112.

In other embodiments, the major and minor diameters of portions of the container 102 are preferably changed depending on the bottom end 114 diameter $d_1$ to maintain the desired ergonomic characteristics of the dispensing system 100. It has been found that when the container 102 has a bottom end 114 diameter $d_1$ of 58 mm that the area adjacent point A (see FIG. 3) preferably has a major diameter of about 58 mm to about 56 mm and a minor diameter of about 58 mm to about 50 mm, and more preferably has a major diameter of about 58 mm to about 56 mm and a minor diameter of about 58 mm to about 56 mm. Further, the narrowest section 148 preferably has a major diameter of about 65 mm to about 38 mm and a minor diameter of about 64 mm to about 38 mm, and more preferably has a major diameter of about 52 mm to about 48 mm and a minor diameter of about 41 mm to about 38 mm. It has also been found that when the bottom end 114 diameter $d_1$ is 69 mm that it is preferable for the area adjacent point A to have a major diameter of about 69 mm to about 56 mm and a minor diameter of about 69 mm to about 50 mm, and more preferably to have a major diameter of about 66 mm to about 60 mm and a minor diameter of about 66 mm to about 58 mm. Further, the narrowest section 148 preferably has a major diameter of about 67 mm to about 38 mm and a minor diameter of about 67 mm to about 38 mm, and more preferably has a major diameter of about 52 mm to about 48 mm and a minor diameter of about 41 mm to about 38 mm.

Figure 22:
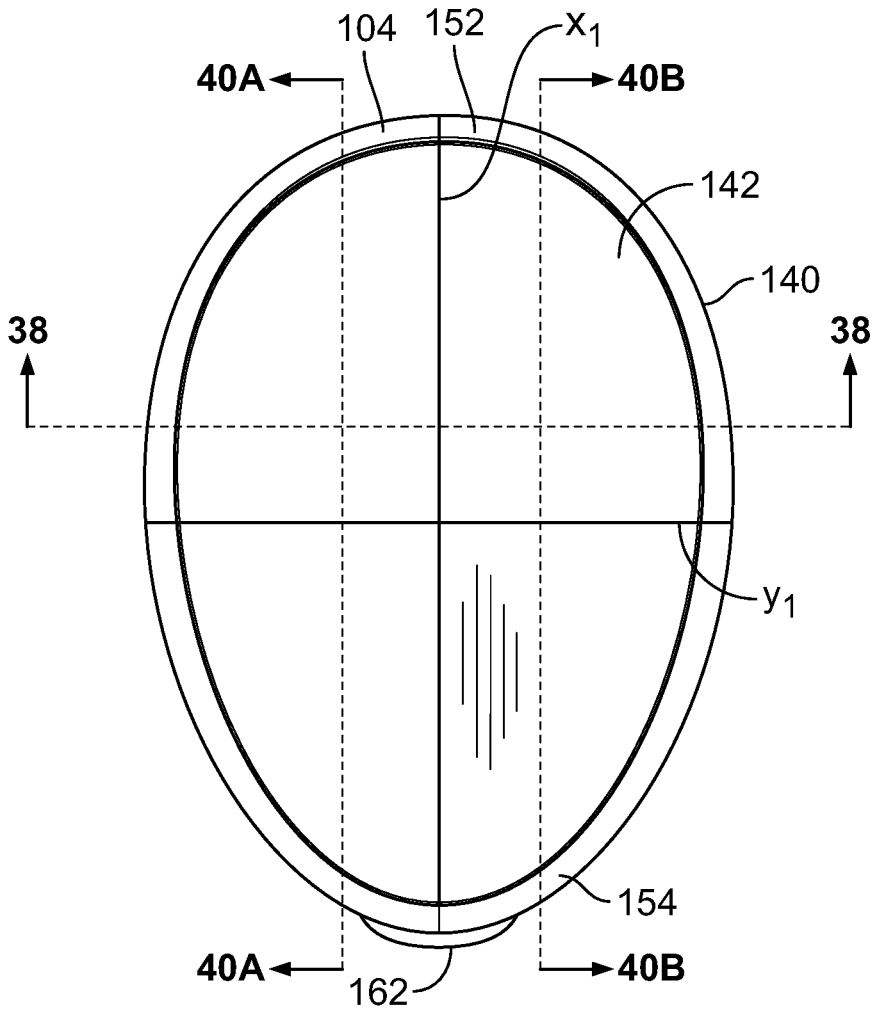
FIG. 22 is a top plan view of the overcap of FIG. 1.

Referring to FIGS. 18-22, the sidewall 144 of the overcap 104 extends upwardly from the bottom end 146 of the body 140 in a substantially uniform or slightly tapered manner. At a point C, the sidewall 144 tapers outwardly and away from the longitudinal axis 118 to a greater degree than below the point C until terminating at the substantially flat top end 142. The sidewall 144 is imparted with a generally concave appearance between the bottom end 146 and the top end 142. An upper portion 150 of the body 140 is truncated so that the top end 142 is angled upwardly from a back side 152 of the overcap 104 to a front side 154 of the overcap 104. In the present embodiment, the top end 142 is a separate piece that is attached to the overcap 104. However, in other embodiments the top end 142 could be made integral with the body 140. As depicted in FIG. 22, the top end 142 has a general egg-shaped appearance with one axis of symmetry as shown by axis $x_1$, which has a length dimension of about 66 mm. An axis $y_1$, which bisects axis $x_1$, has a length dimension of about 46.5 mm. However, it is contemplated that the dimensions of the top end 142 may be modified to any dimension commensurate with the dimensions of the remainder of the overcap 104.

Figure 20:
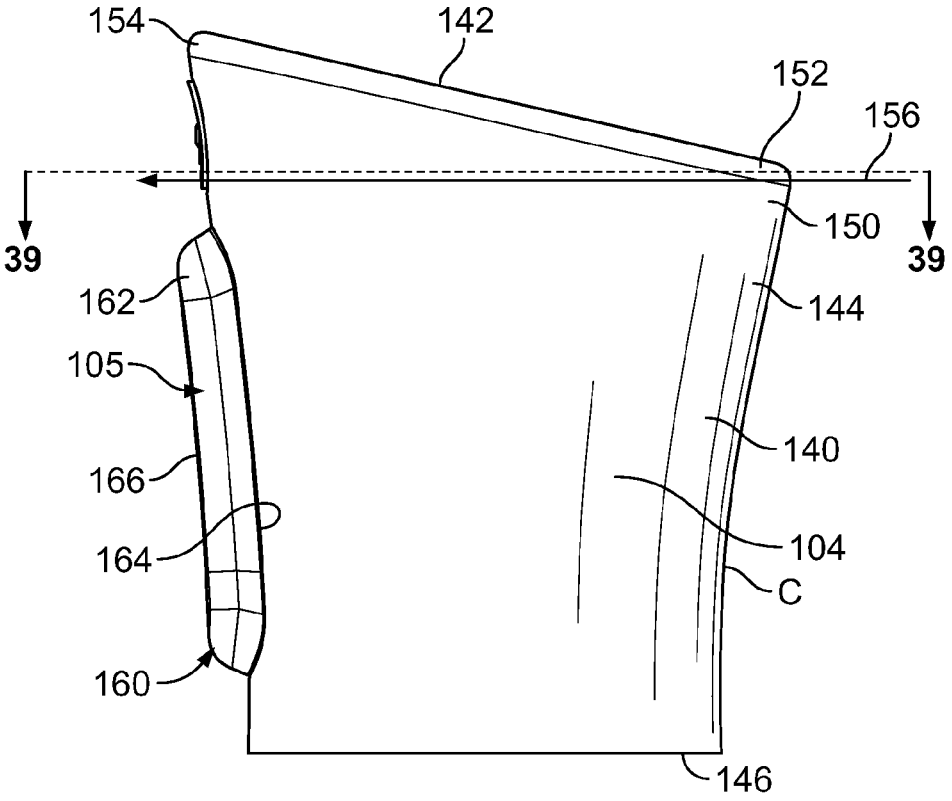
FIG. 20 is a left side elevational view of the overcap of FIG. 1, wherein the right side elevational view is a mirror image of the left side elevational view.
Figure 21:
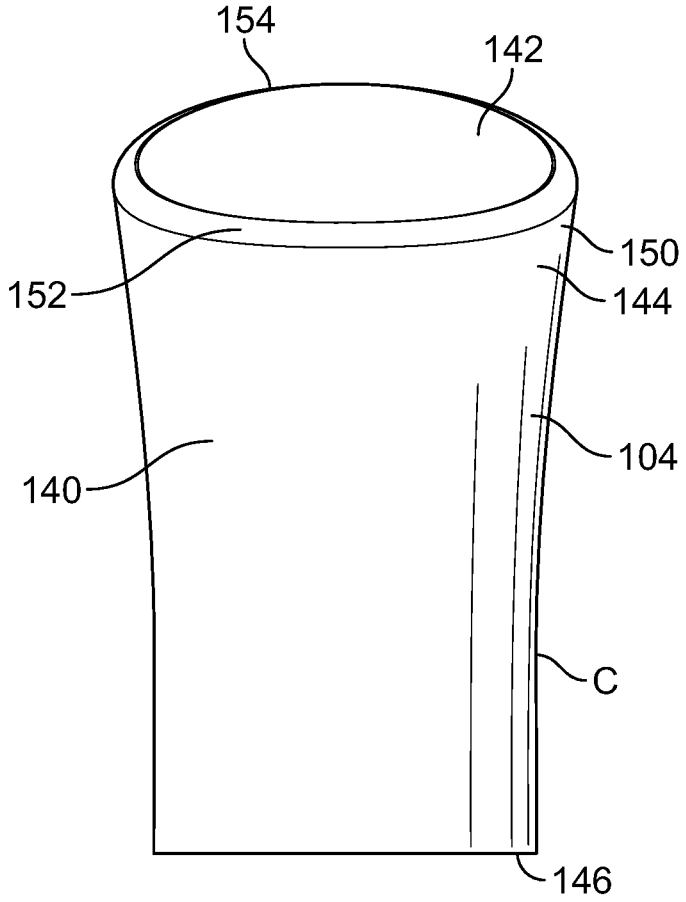
FIG. 21 is a rear elevational view of the overcap of FIG. 1.

As shown in FIG. 20, the top end 142 is sloped at an angle of about 5 degrees to about 30 degrees with respect to an axis 156, which is parallel with the bottom end 146 of the overcap 104. In the present embodiment, the top end 142 is sloped at an angle of about 13 degrees. The axis 156 also defines a major axis of the overcap 104 adjacent an upper limit of the area A1 (see FIG. 1), which comprises the first gripping surface. In connection with the present embodiment that has a bottom end 114 diameter $d_1$ of 66 mm (see FIGS. 2 and 3), it is preferable to have a major diameter about the axis 156 of about 67 mm to about 45 mm and a minor diameter of about 66 mm to about 40 mm, and more preferable to have a major diameter of about 67 mm to about 62 mm and a minor diameter of about 48 mm to about 44 mm. Further, in an embodiment with a diameter $d_1$ of 58 mm it is preferable to have a major diameter about the axis 156 of about 63 mm to about 45 mm and a minor diameter of about 58 mm to about 40 mm, and more preferable to have a major diameter of about 63 mm to about 58 mm and a minor diameter of about 48 mm to about 44 mm. Still further, in an embodiment with a diameter $d_1$ of 69 mm it is preferable to have a major diameter about the axis 156 of about 69 mm to about 45 mm and a minor diameter of about 69 mm to about 40 mm, and more preferable to have a major diameter of about 67 mm to about 62 mm and a minor diameter of about 48 mm to about 44 mm.

Turning again to FIGS. 18 and 19, an outlet orifice 158 is provided within the front side 154 of the body 140 adjacent the top end 142. The outlet orifice 158 has a substantially racetrack shaped appearance. Although a racetrack shaped outlet orifice 158 is shown, other shapes may be used as well, such as a square, a circle, a triangle, or any other geometric shape. In one embodiment, the shape of the outlet communicates to the consumer the type of spray pattern that will be emitted during use of the dispensing system 100. For example, an oval-shaped outlet orifice 158 may be indicative of an oval-shaped spray pattern.

Figure 18:
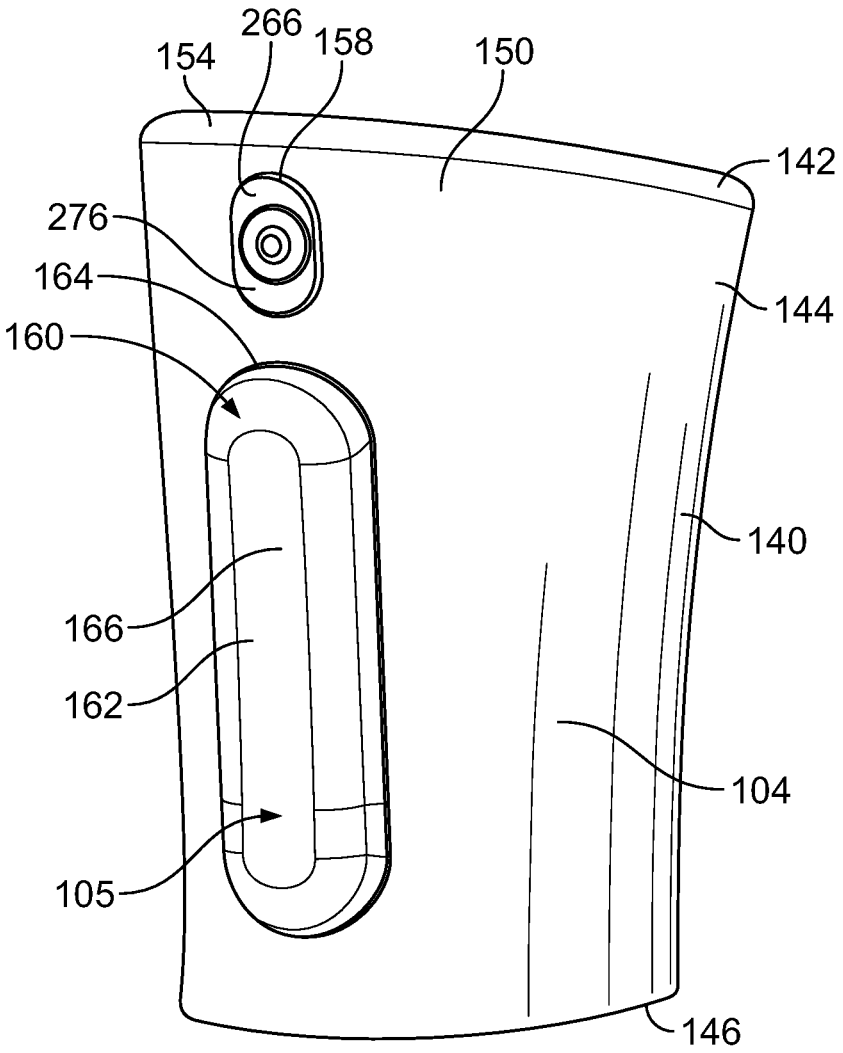
FIG. 18 is an isometric view of a top, front, and left side of the overcap of FIG. 1.
Figure 19:
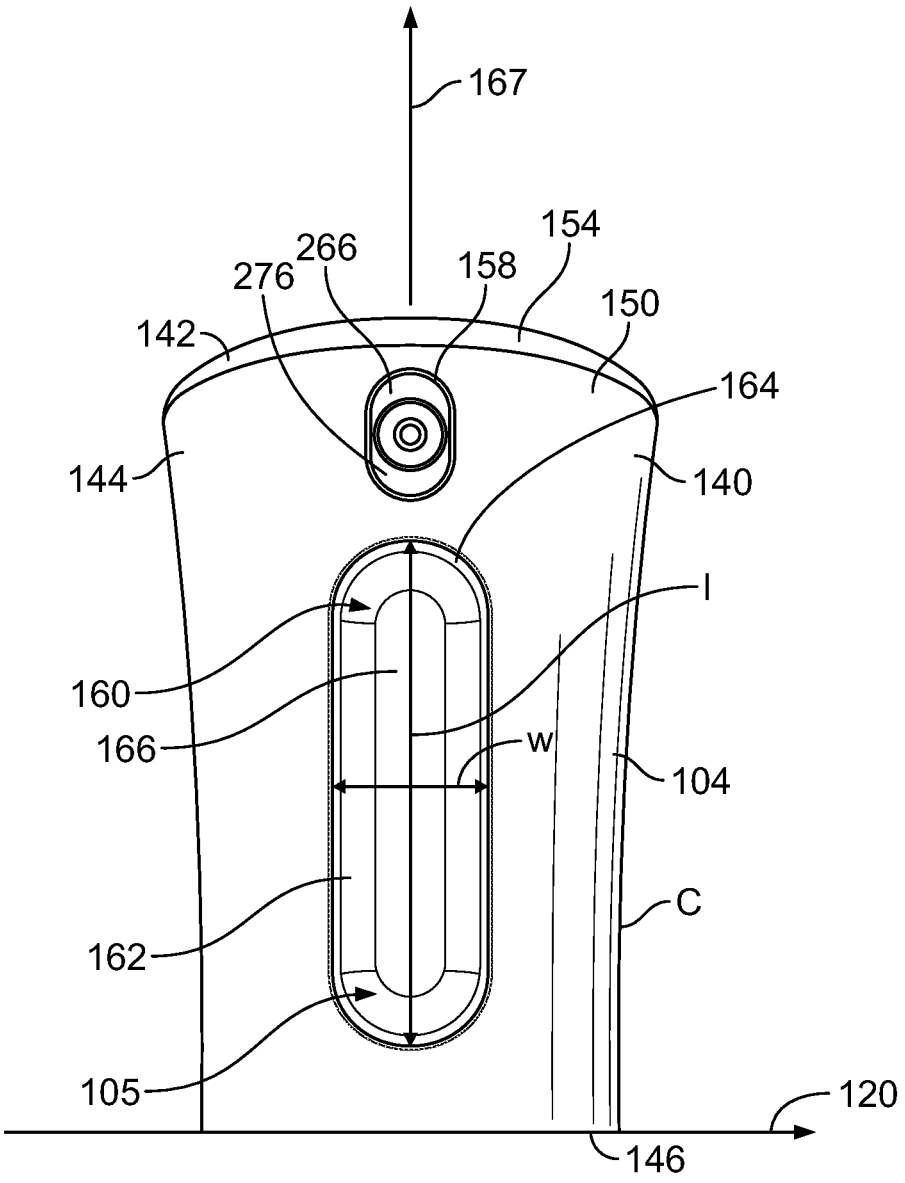
FIG. 19 is a front elevational view of the overcap of FIG. 1.

Referring to FIGS. 18-20, the actuation mechanism 105 is disposed within the overcap 104 and comprises an actuator 160 and a manifold 250. The actuator 160 includes an elongate button 162 disposed within the body 140 of the overcap 104. The elongate button 162 extends through a similarly shaped opening 164 within the body 140. Portions of the elongate button 162 extend outwardly from the opening and curve inwardly in a convex manner toward a raised portion 166, which is substantially flat with respect to the remainder of the elongate button 162 and acts as a surface for the user to grasp during actuation of the dispensing system 100. The elongate button 162 is positioned adjacent the front side 154 of the body 140 between the outlet orifice 158 and the seam 108. The elongate button 162 is disposed in alignment with the outlet orifice 158 and is adapted to be depressed to emit product from the dispensing system 100.

As shown in FIG. 19, the elongate button 162 is disposed substantially parallel to a longitudinal axis 167 of the overcap 104, which is perpendicular to the axis 120. The elongate button 162 includes a length dimension l and a width dimension w perpendicular to and bisecting the length dimension l. The elongate button 162 is preferably about 25 mm to about 60 mm long to accommodate a plurality of user fingers. In one preferred embodiment, the elongate button 162 is about 40 mm in length, which may accommodate about 2½ fingers of an average human hand. The average widths of male and female fingers, as provided for in *The Handbook of Adult Anthropometric and Strength Measurements* created by the Department of Trade and Industry in the United Kingdom, are listed in Table 1 below:

TABLE 1

| | INDEX | MIDDLE | RING |
|---|---|---|---|
| DISTAL JOINT | | | |
| Female | 15.1 mm | 15.1 mm | 14.0 mm |
| Male | 18.3 mm | 17.9 mm | 17.0 mm |
| PROXIMAL JOINT | | | |
| Female | 17.8 mm | 17.8 mm | 16.0 mm |
| Male | 20.9 mm | 21.1 mm | 19.9 mm |

The elongate button 162 is preferably about 10 mm to about 20 mm wide to allow the users' fingers to rest comfortably on the elongate button 162 to actuate same. The ratio of length to width for the elongate button 162 is preferably between about 5:1 to about 1:1. In one particular embodiment, the length to width ratio is about 2:1. As shown in FIG. 20, the elongate button 162 protrudes outwardly from the body 140 of the overcap 104 and includes a slight curve that mirrors the contour of the sidewall 144 of the body 140. Portions of the elongate button 162 extend inwardly through the opening 164 in the sidewall 144 toward a chamber 168 within the overcap 104 to act on and displace the valve stem 130 as described in more detail hereinbelow.

One of the benefits of the dispensing system 100 described herein is the increased surface area of the elongate button 162 that may be utilized for actuation. Typical prior art systems include a trigger or actuation button that can only accommodate one finger. Further, these prior art systems assume that all users can comfortably reach or manipulate the trigger or actuation button with their finger and/or hand without undue strain or fatigue. In fact, these systems do not provide for a plurality of operational positions in which a user may place their hand and/or finger to operate a dispensing system. The present dispensing system 100 includes an elongate button adapted to afford a variety of users with different hand and/or finger sizes the ability to comfortably position their hand and/or finger(s) in an optimum position to combat strain or fatigue and to provide a comfortable and enjoyable user experience when using the dispensing system 100. Further, increased comfort affords a user better control over aiming the dispensing system 100 to effectively spray product therefrom.

The dispensing system 100 described herein overcomes the aforementioned drawbacks of prior art systems by providing an ergonomic gripping surface in which the narrowed neck portion allows differently sized hands to properly grasp the dispensing system 100. As previously noted, the ergonomic gripping surface may be broadly characterized as an area of narrowing or changing cross-section, e.g., see L1 of FIG. 1 defined by curved walls of the overcap and container, in which a hand may grasp a dispensing system and actuate a button thereon. In the present embodiment, the area A1 extends between an area of uniform cross-section, e.g., see area A of FIG. 1, and a top end of a dispensing system. In other embodiments, the area A1 could comprise a continuously narrowing section extending downwardly from an area adjacent a top end or nozzle of an overcap or upwardly from an upper, medial, or lower portion of a container. In other embodiments, the area A1 may comprise concave, convex, and/or variously curved segments comprising a gripping area. While numerous gripping surfaces may comprise the gripping area A1, the area A1 does not include areas of uniform cross-section, as such areas do not facilitate the comfortable gripping of containers and overcaps. Such a tapered and/or narrowed cross-section provides a comfortable gripping area for any number of hand sizes and users. The provision of an elongate button, e.g., button 162, within this gripping area A1, and more particularly at least partly within an area A2, allows for a user to easily actuate the dispensing system while affording the user the ability to grip the dispensing system anywhere within area A1. It is believed that such a system allows for users to grip such dispensing systems in a comfortable and ergonomic manner without having to move their hand from their area of ideal gripping.

Figure 23:
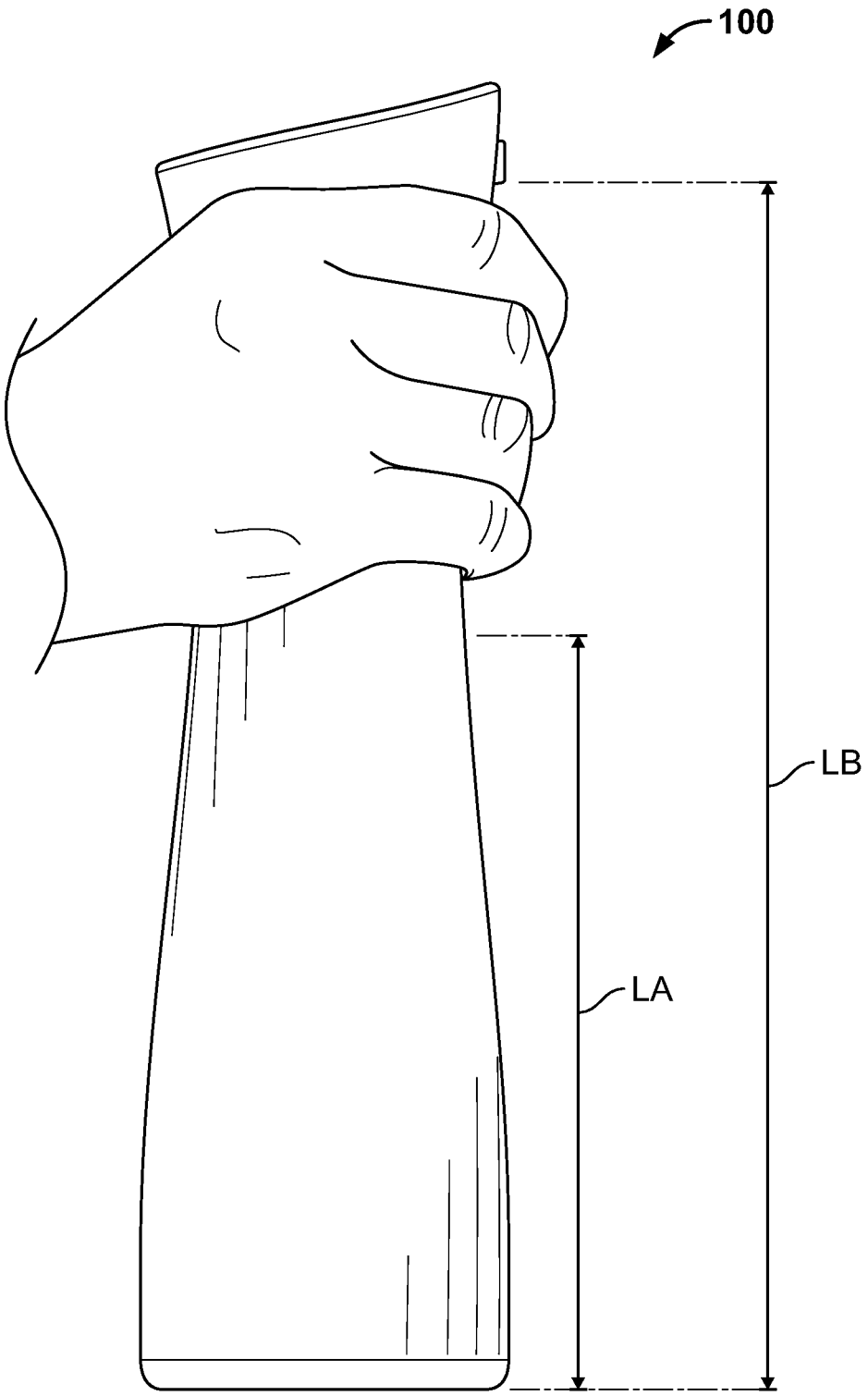
FIG. 23 is a left side elevational view of the dispensing system of FIG. 1 in a dispensing position.
Figure 60:
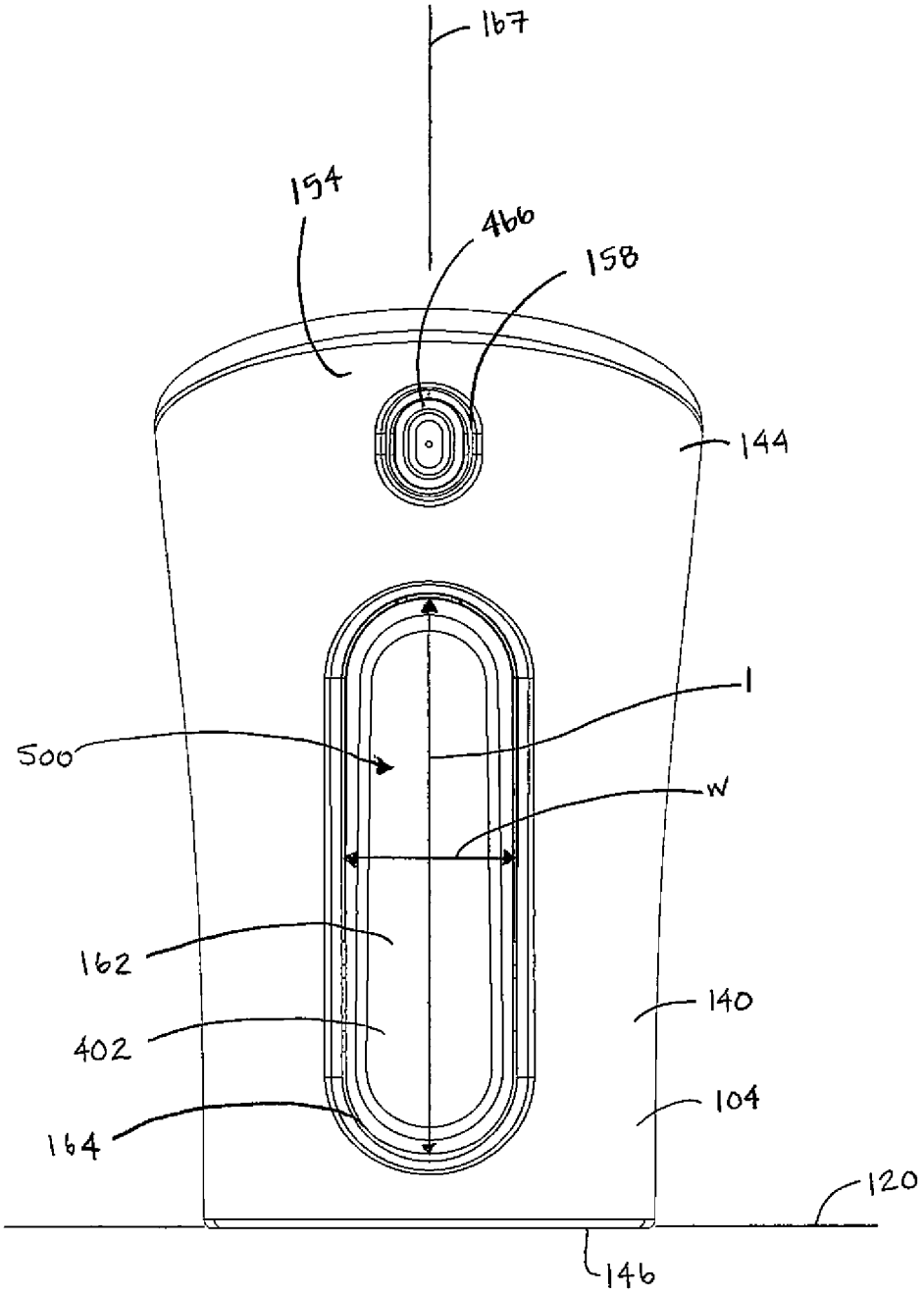
FIG. 60 is a front elevational view of the overcap of FIG. 59.

To confirm our understandings of the advantages of the present dispensing system, a test was performed to determine where users grip the dispensing system with two types of elongate triggers. Thirty-four users, both male and female, were asked to pick up the dispensing system as if they were planning to use it in the normal fashion for purposes of spraying a fluid. Measurements were taken from the bottom end 114 of the container to the bottom of the user's hand LA and from the bottom end 114 to the top of the user's hand LB (see FIG. 23). The first elongate button had a length of 44 mm, e.g., see the button 162 of FIG. 60, and the second elongate button had a length of 34 mm, e.g., see the button 162 of FIG. 44.

Figure 24:
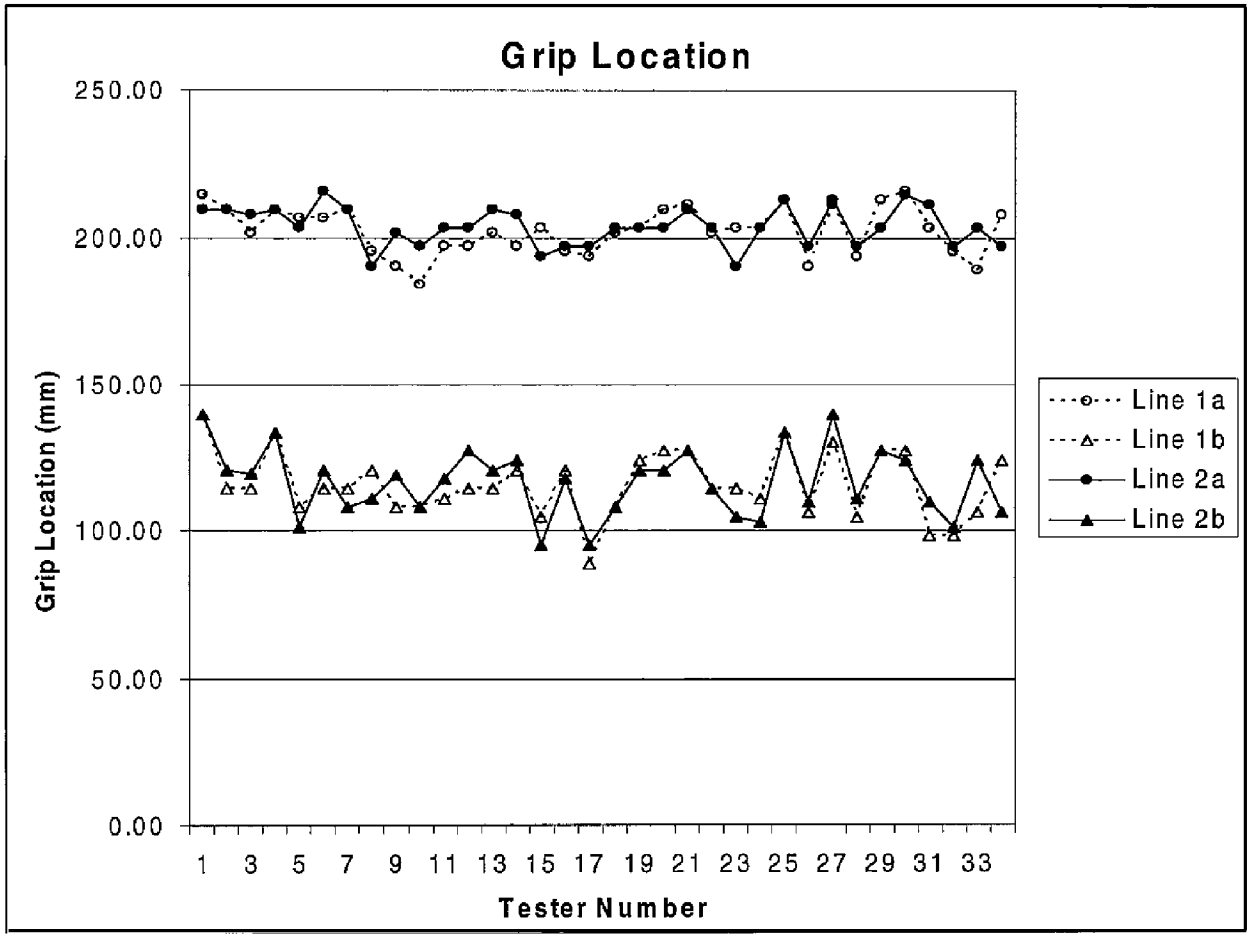
FIG. 24 is a graphical representation of a gripping length of the dispensing system in FIG. 43.

The results of the test are generally graphically represented in FIG. 24. The lines 1*a* and 1*b* in FIG. 24 illustrate the distance from the bottom end 114 of the container to the top and the bottom of the users' hand, respectively, for the dispensing system with the first longer elongate button. The mean hand placement for the top of the users' hands for the first elongate button was 202.27 mm, with a maximum top hand placement of 215.90 mm, a minimum top hand placement of 184.15 mm, and a standard deviation of 8.09 mm. The mean hand placement for the bottom of the users' hands for the first elongate button was 115.61 mm, with a maximum bottom hand placement of 139.70 mm, a minimum bottom hand placement of 88.90 mm, and a standard deviation of 11.21 mm. The lines 2*a* and 2*b* represent the distance between the bottom end 114 of the container and the top and bottom of the users' hand, respectively, for the dispensing system with the second elongate button with a shorter length dimension l. The mean hand placement for the top of the users' hands for the second elongate button was 203.72 mm, with a maximum top hand placement of 215.90 mm, a minimum top hand placement of 190.50 mm, and a standard deviation of 6.76 mm. The mean hand placement for the bottom of the users' hands for the second elongate button was 116.54 mm, with a maximum bottom hand placement of 139.70 mm, a minimum bottom hand placement of 95.25 mm, and a standard deviation of 11.52 mm.

The results indicate that users prefer to place their hands along a spectrum of the gripping length L of the dispensing system, which encompasses the length L1 and the length L2. The provision of the elongate button 162 allows users to choose where they place their hands within the gripping length L. Specifically, it has been found that buttons with a length l of between about 25 mm and about 60 mm, and more particularly within about 34 mm to about 44 mm, are effective in conjunction with the gripping length L preferably extending between about 90 mm and about 249 mm, and more preferably extending between about 95 mm to about 130 mm. The relationship between the elongate button 162 and the gripping length L provides an effective means for providing a dispensing system that maximizes ergonomic benefits to users. Particularly, the ratio of the gripping length L, which comprises L1 and L2, and the length l of the button, is preferably between about 1.5:1 to about 10:1, and more preferably between about 1.6:1 to about 5.2:1, and most preferably between about 2.1:1 to about 4:1. The results also indicate that when dispensing systems are provided with a ratio of the length l of the button to the length L of the gripping area within the above-noted ranges, that users grip the dispensing system 100 at the same location regardless of the specific length of the elongate button. This indicates that the user is able to grasp the dispensing system 100 where it is more comfortable, regardless of the button length, which is an advantage over prior art systems in which the location for the user to grip the device is dictated by the trigger or other actuation mechanism on the device.

Another advantage over the prior art is that the elongate button 162 allows for a plurality of fingers or a single finger positioned anywhere along the elongate button 162 to be supported and to effectuate actuation. The provision of a plurality of fingers by the user on the elongate button 162 also assists in distributing the weight of the dispensing system 100 over a greater surface area of the user's hand, which gives the user a better grip, more control and aim over the dispensing of product from the dispensing system 100, and an overall more comfortable experience. Still further, the elongate button 162 exhibits the additional characteristic of requiring substantially the same amount of force along the entire length l of the elongate button 162 to actuate same, which is a further benefit not seen in prior art systems and which will be described in further detail hereinbelow.

Figure 27:
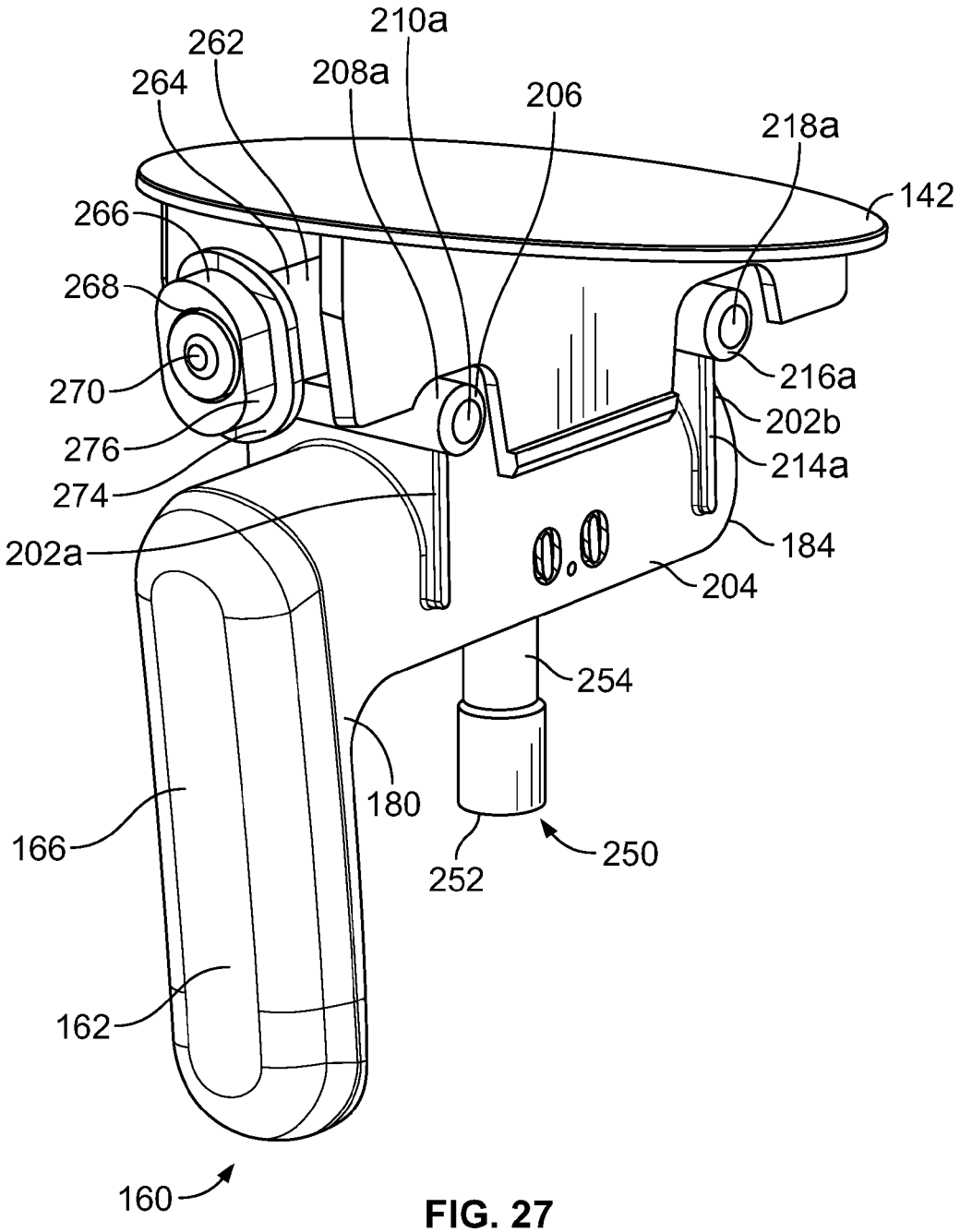
FIG. 27 is an isometric view of the top, front, and left side of the actuator and manifold of FIG. 25 with a top portion of the overcap of FIG. 1 disposed thereon.
Figure 28:
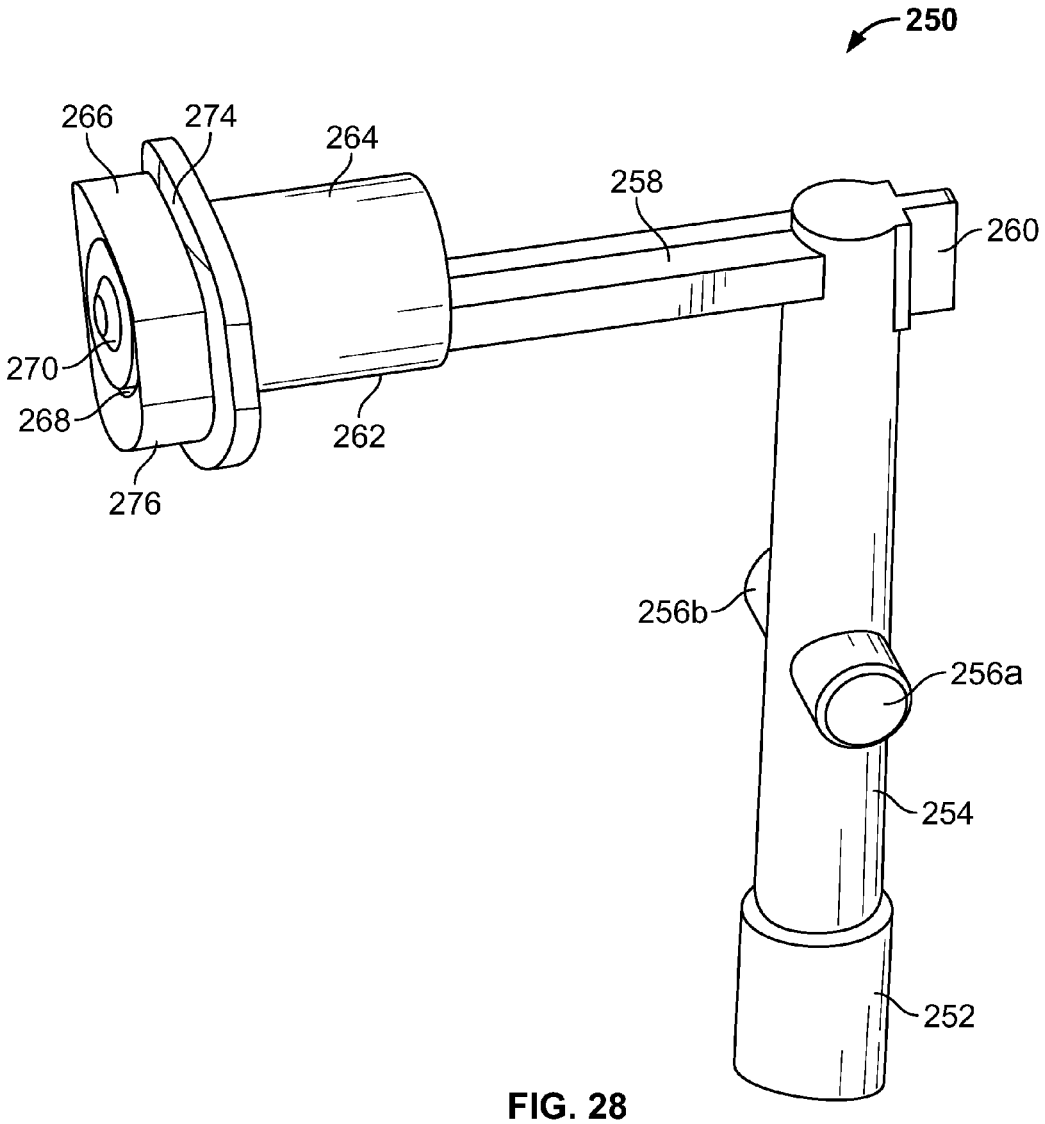
FIG. 28 is an isometric view of a top, front, and left side of the manifold of FIG. 25.
Figure 29:
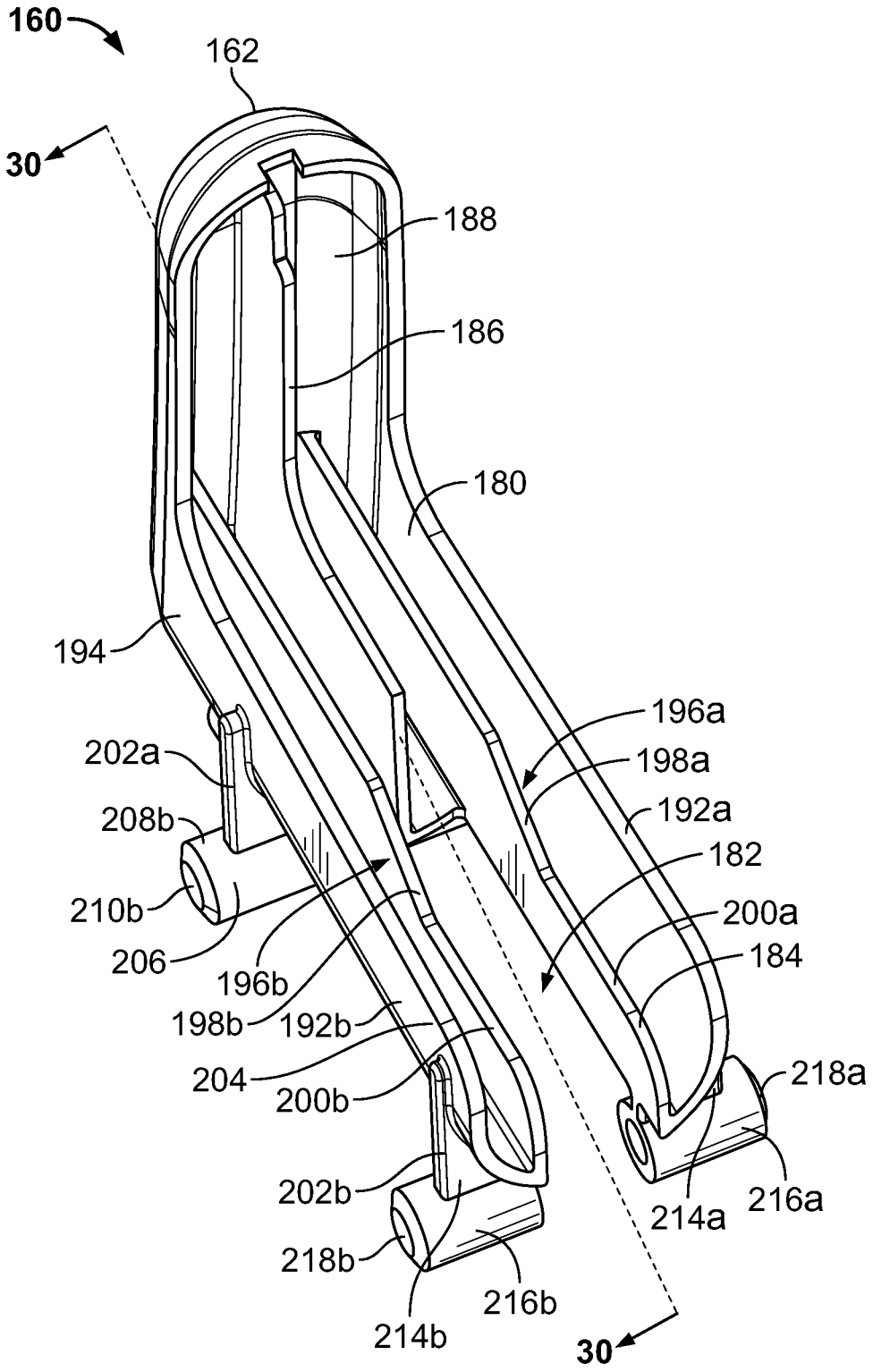
FIG. 29 is an isometric view of a bottom, rear, and right side of the actuator depicted in FIG. 25.
Figure 30:
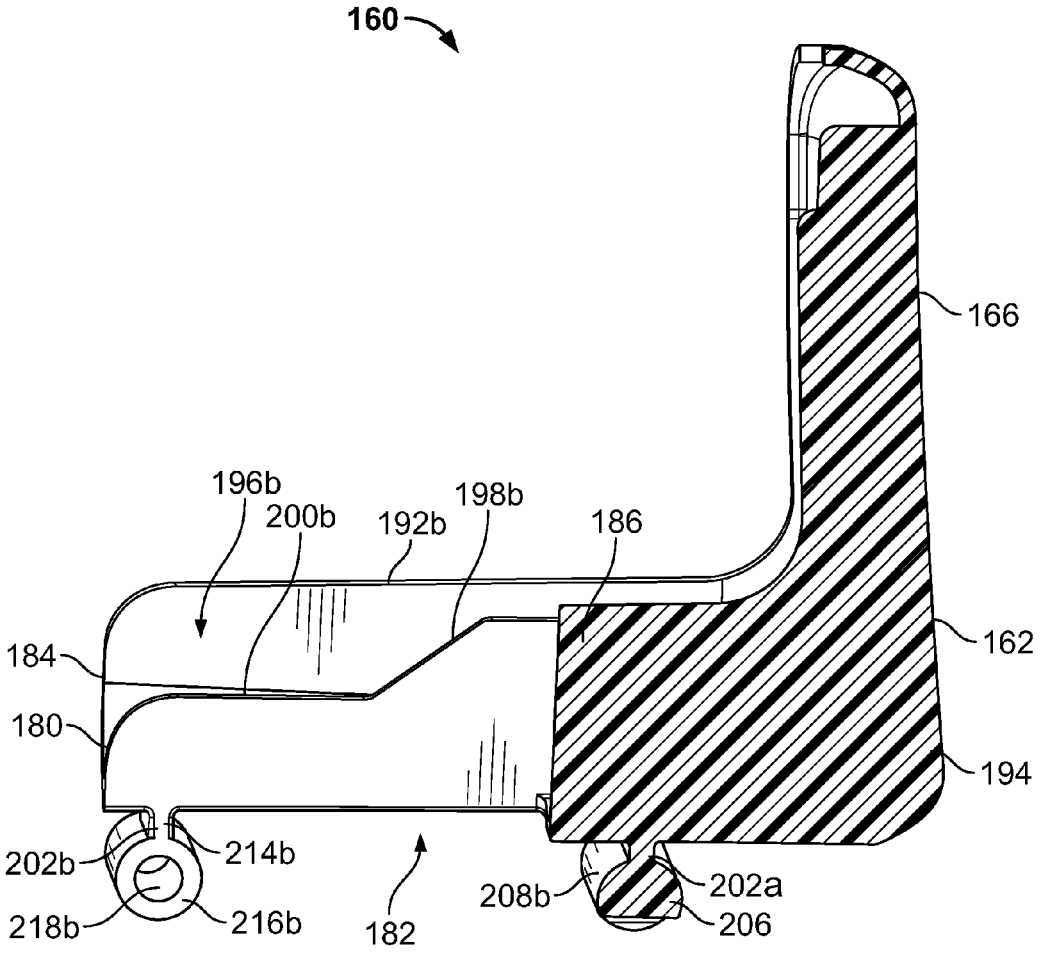
FIG. 30 is a cross-sectional view of the actuator of FIG. 29, generally taken along the line 30-30 of FIG. 29.
Figure 31:
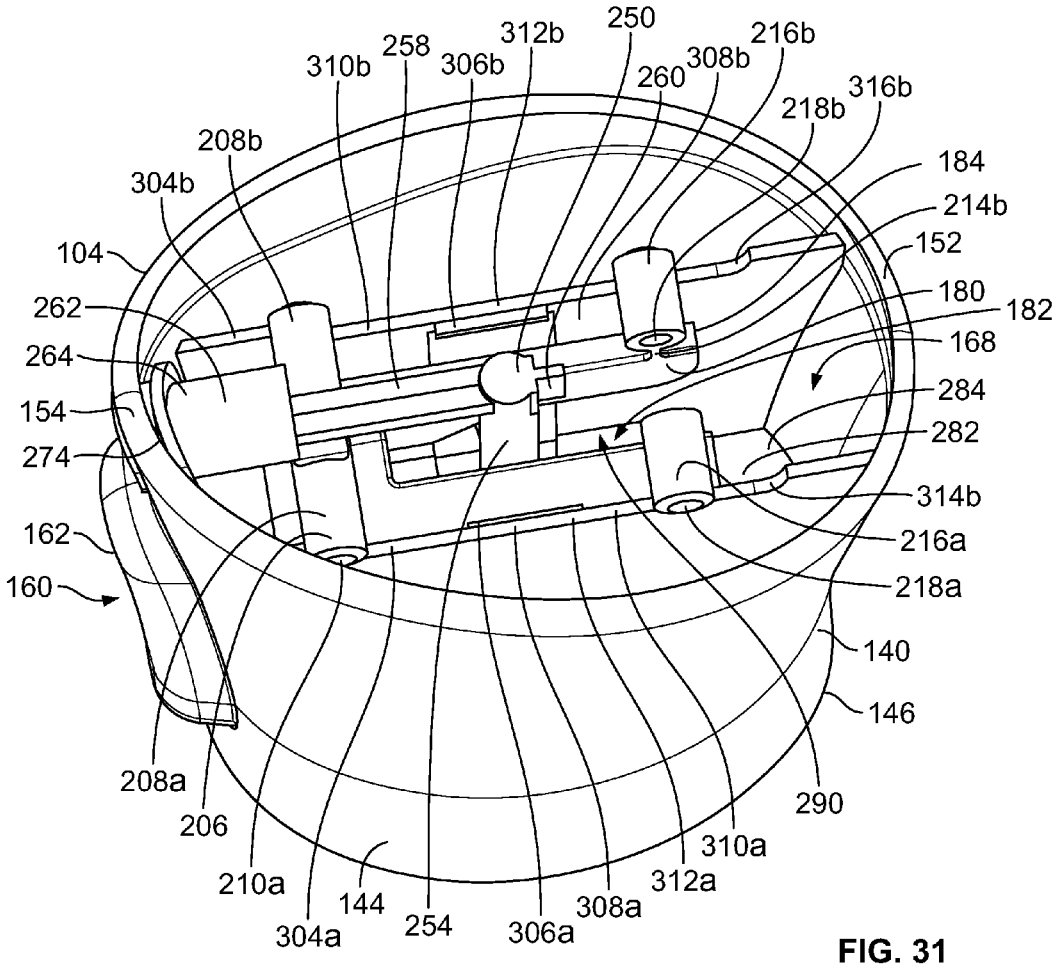
FIG. 31 is an isometric view of a top, front, and left side of the overcap of FIG. 1 with the actuation mechanism of FIG. 25 disposed therein, wherein a top portion is removed therefrom for purposes of clarity.

Referring now to FIGS. 25-30, the actuator 160 includes a U-shaped wall 180 extending rearwardly from the elongate button 162. With reference to FIG. 29, the U-shaped wall 180 includes a channel 182 extending from a distal end 184 thereof toward a medial portion of the U-shaped wall 180. A centrally disposed L-shaped wall 186 extends from a rear surface 188 of the elongate button 162 toward the medial portion of the U-shaped wall 180 on an underside of same. Similarly, opposing interior walls 192*a* and 192*b* extend from an upper end 194 of the rear surface 188 of the elongate button 162 to the distal end 184 of the U-shaped wall 180. The opposing interior walls 192*a* and 192*b* extend past the L-shaped wall 186 and define a lower boundary to the channel 182. FIGS. 29 and 30 depict the opposing interior walls 192*a* and 192*b* being partially defined by grooves 196*a*, 196*b*, which truncate the opposing interior walls 192*a* and 192*b* from an area adjacent the medial portion of the U-shaped wall 180 to the distal end 184 thereof. The opposing interior walls 192*a* and 192*b* within this truncated area are defined by inclined sections 198*a*, 198*b*, and extension sections 200*a*, 200*b*, respectively. The extension sections 200*a*, 200*b* are substantially parallel with the remainder of the non-truncated opposing interior walls 192*a*, 192*b*, except for curved portions adjacent the distal end 184. The inclined sections 198*a*, 198*b* are angled with respect to the remainder of the opposing interior walls 192*a*, 192*b* and are disposed adjacent the medial portion of the U-shaped wall 180.

Figure 25:
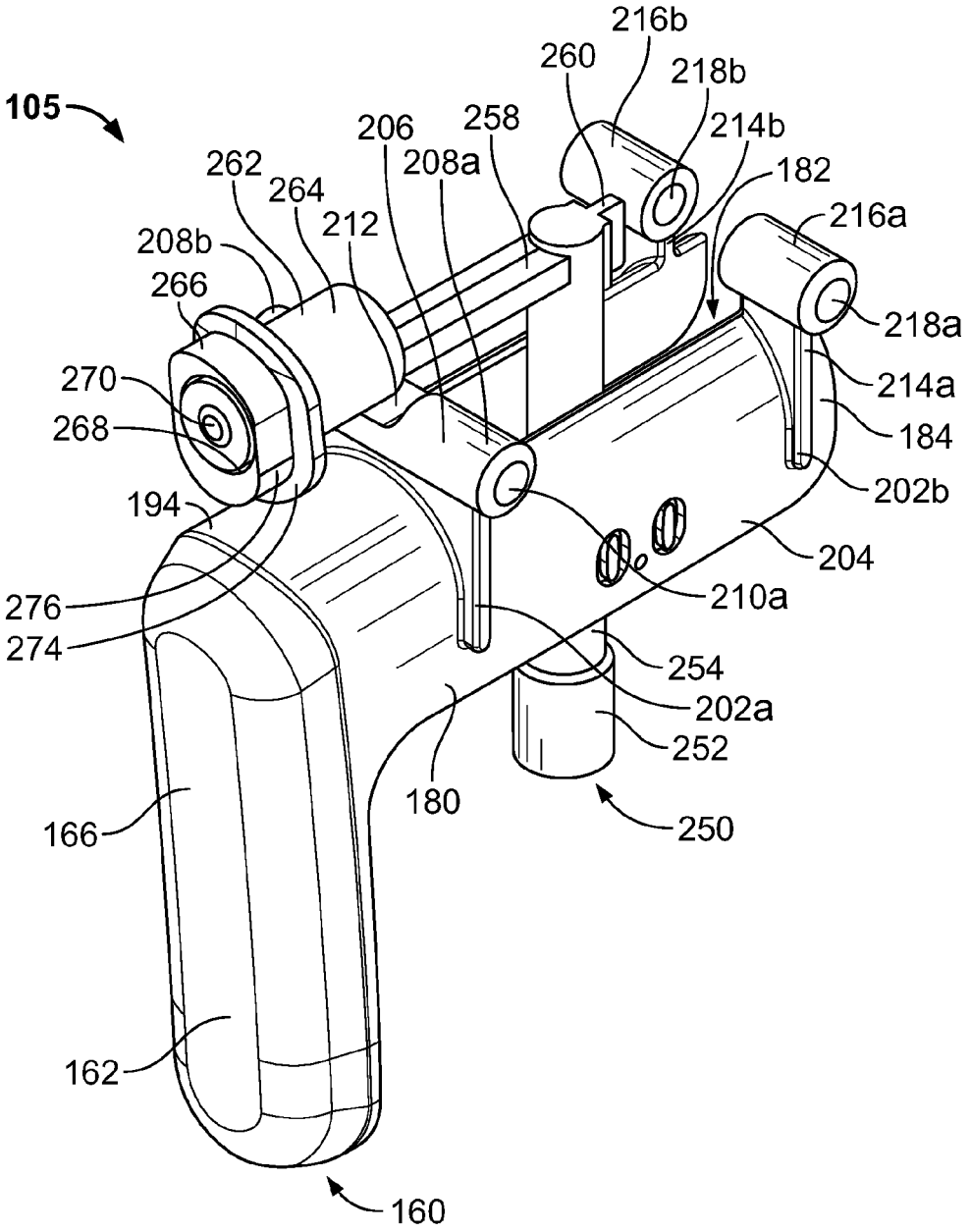
FIG. 25 is an isometric view of a top, front, and left side of a first actuation mechanism, which includes an actuator and a manifold disposed therein.
Figure 26:
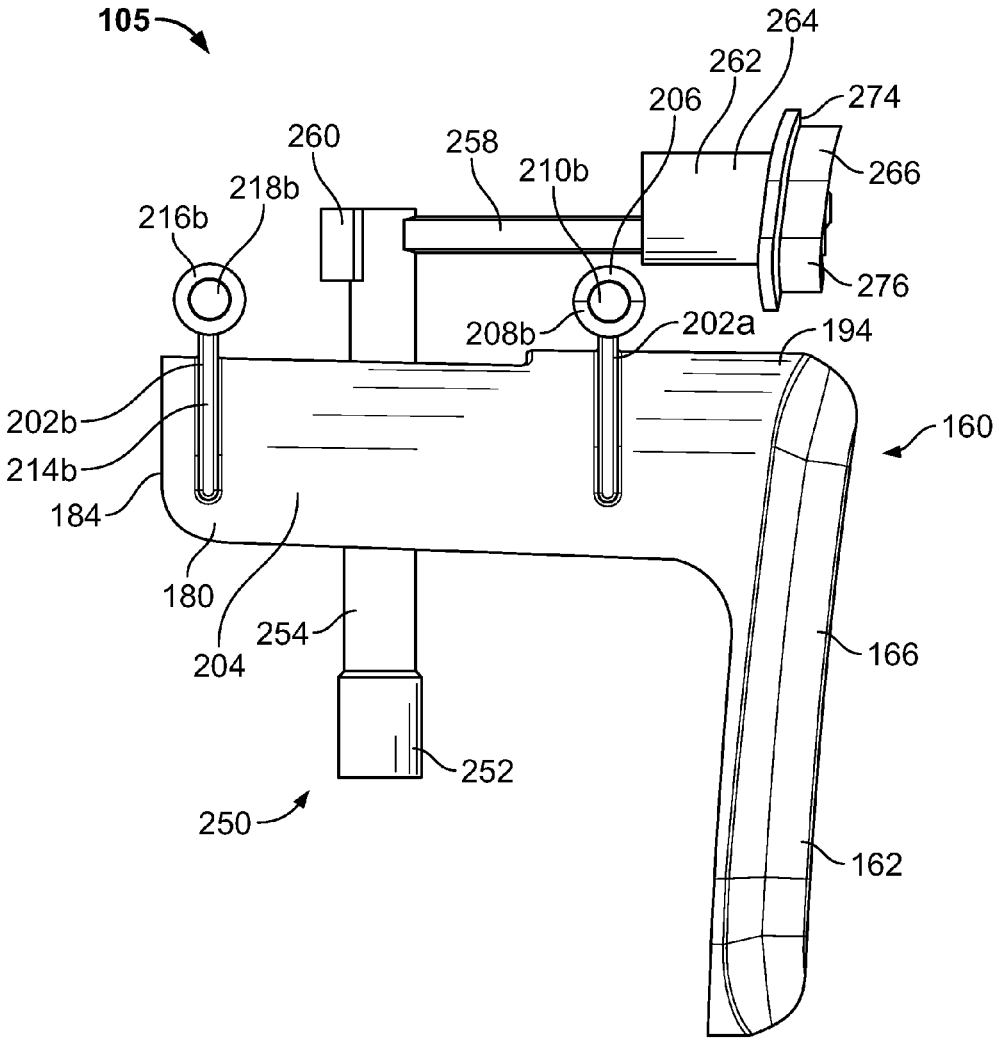
FIG. 26 is a right side elevational view of the actuator and manifold of FIG. 25.

As best seen in FIGS. 25-27, first and second planar projections 202*a*, 202*b*, respectively, extend upwardly from an exterior surface 204 of the U-shaped wall 180. The planar projection 202*a* is disposed between the medial portion of the U-shaped wall 180 and the elongate button 162. A cylindrical portion 206 with first and second ends 208*a*, 208*b* is disposed on a distal end of the planar projection 202*a* and includes opposing holes 210*a*, 210*b*, respectively, extending partially therethrough. A rectangular notch 212 is provided within a central portion of the cylindrical portion 206. The planar projection 202*b* is disposed adjacent the distal end 184 of the U-shaped wall 180. The planar projection 202*b* is truncated into first and second sections 214*a*, 214*b* by the channel 182. Both sections 214*a*, 214*b* include cylindrical portions 216*a*, 216*b* with holes 218*a*, 218*b* extending therethrough, respectively.

With reference to FIG. 28, the substantially L-shaped manifold 250 is provided, which is adapted to allow product to be dispensed therethrough. The manifold 250 includes a cylindrical base 252 adapted to receive and be in fluidic communication with the distal end 136 of the valve stem 130 of the container 102. A first tube 254 extends upwardly from the base 252. Opposing cylindrical protrusions 256*a*, 256*b* extend from an exterior surface of the first tube 254. A second tube 258 is in fluidic communication with the first tube 254 and extends at a substantially 90 degree angle from same. A rectangular projection 260 extends from an opposite side of the first tube 254. A bezel 262 is attached to and in fluid communication with a distal end of the second tube 258. The bezel 262 comprises an enlarged cylindrical section 264. A stepped racetrack shaped outlet member 266 extends from the cylindrical section 264. A circular opening 268 is provided within the race-track shaped outlet member 266, which provides access for a nozzle 270 to emit fluid into the surrounding environment. The nozzle 270 comprises an engine or swirl chamber for imparting pre-defined turbulent flow characteristics to the fluid product to be emitted.

The stepped race-track shaped outlet member 266 is shaped to correspond to the outlet orifice 158 formed in the front side 154 of the body 140 (see FIGS. 18 and 19). With reference to FIGS. 18 and 28, when the outlet member 266 is inserted into and through the outlet orifice 158, a first portion 274 abuts an interior of the body 140 surrounding the outlet orifice 158 and a second portion 276 extends through the outlet orifice 158. Preferably, there is a tight fit between the second portion 276 and the outlet orifice 158 so there are no discernable gaps therebetween. A distal portion of the outlet member 266 extends through the orifice 158 and beyond a surface of the front side 154 of the body 140. The outlet member 266 is adapted to communicate various information about the dispensing system 100 to a user. In one embodiment, the outlet member 266 is provided with a shape commensurate with the spray pattern to be emitted. In another embodiment, the outlet member 266 is a contrasting color from other portions of the dispensing system 100 to assist the user in identifying and properly orienting the outlet member 266.

Referring to FIGS. 25 and 26 again, the manifold 250 is disposed within the channel 182 of the actuator 160. More specifically, the first tube 254 extends through the channel 182 and a portion of the second tube 258 and the enlarged cylindrical section 264 is disposed above the notch 212.

Figure 32:
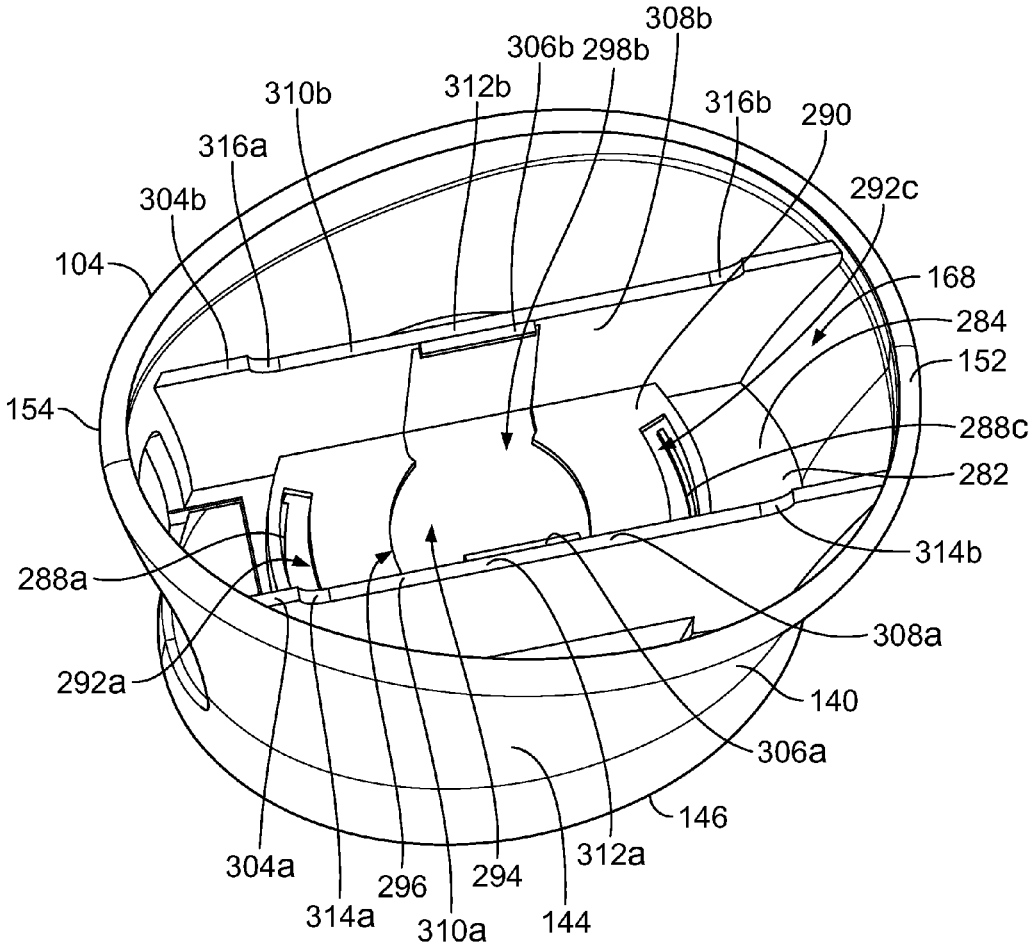
FIG. 32 is an isometric view of a top, front, and left side of the overcap of FIG. 31, wherein the actuator and the manifold are removed therefrom for purposes of clarity.
Figure 33:
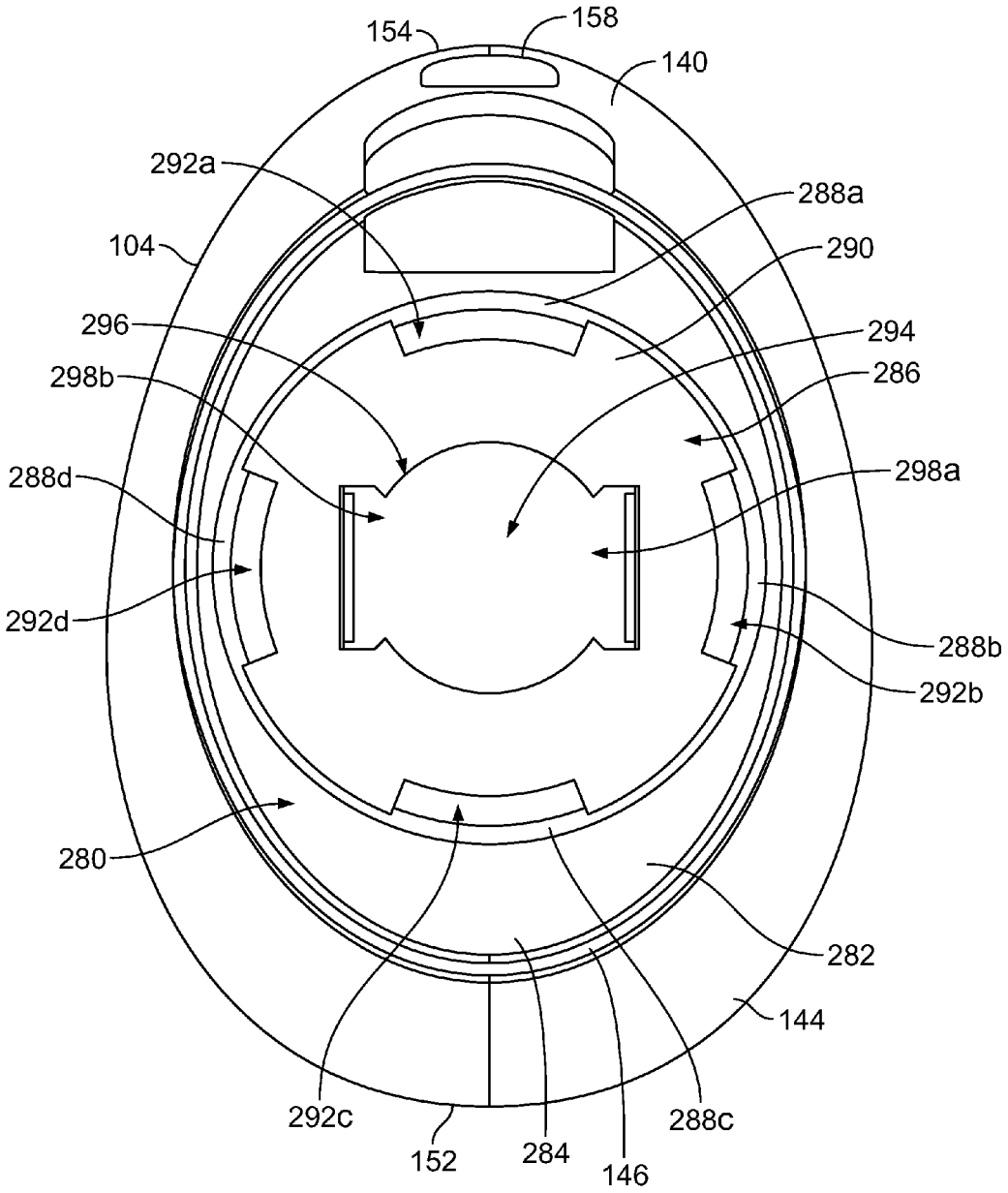
FIG. 33 is a bottom elevational view of the overcap of FIG. 32.
Figure 34:
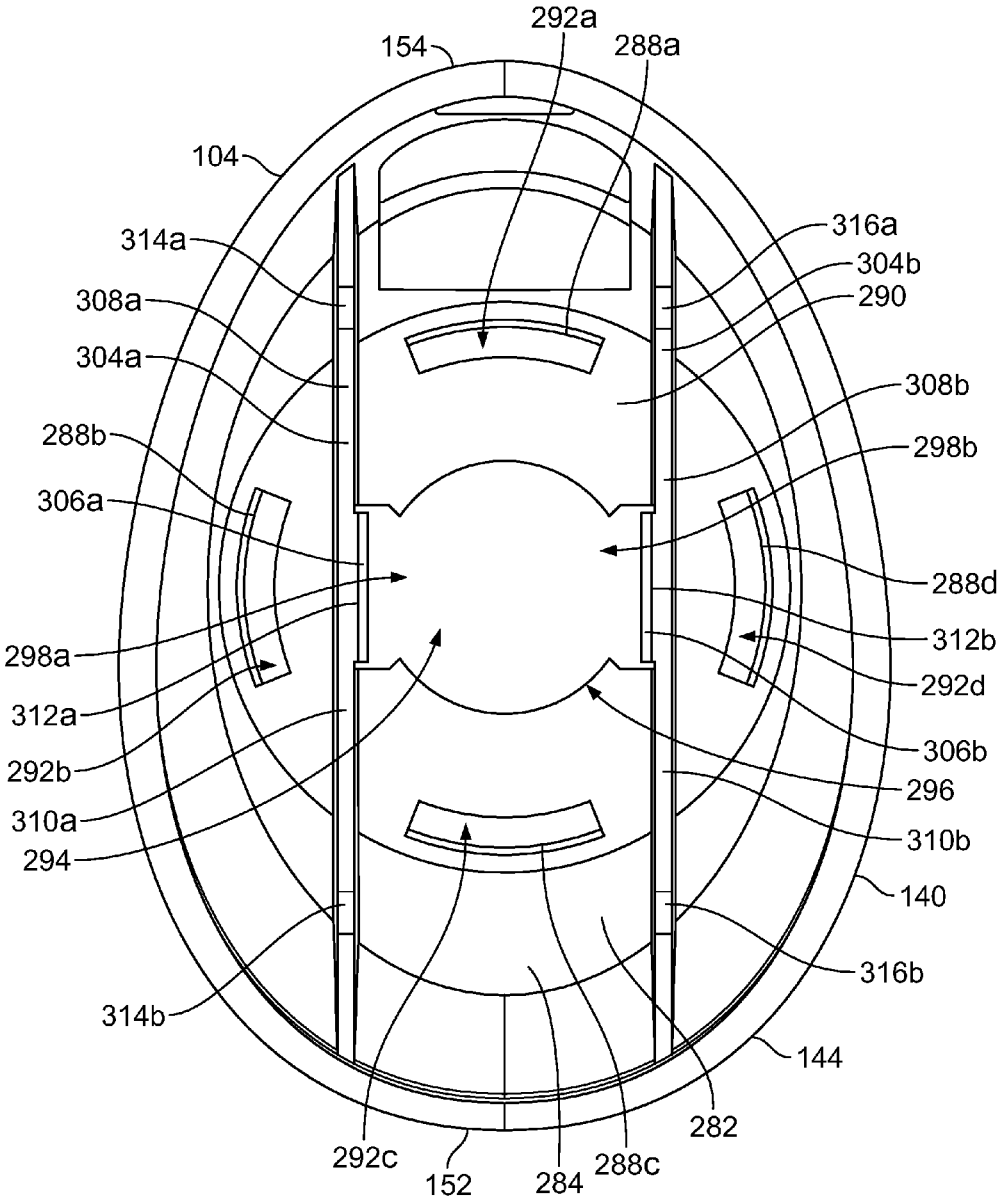
FIG. 34 is a top plan view of the overcap of FIG. 33.

Now referring to FIGS. 31-34, the actuator 160 and the manifold 250 are depicted within the chamber 168 of the overcap 104. The manifold 250 extends upwardly through an aperture 280 located in a support structure 282 (see FIGS. 32-34). With reference to FIG. 33, the support structure 282 is shown to comprise an oval-shaped platform 284 with a circular opening 286 extending therethrough. Four equidistantly spaced prongs 288*a*, 288*b*, 288*c*, 288*d* extend into the circular opening 286 from portions of the platform 284. A circular platform 290 defines an upper boundary of the circular opening 286. Four curvilinear openings 292*a*, 292*b*, 292*c*, 292*d* are provided within the circular platform 290 above the spaced prongs 288*a*, 288*b*, 288*c*, 288*d*, respectively. A central opening 294 is also provided within the circular platform 290, which comprises a substantially circular central portion 296 truncated by two opposing rectilinear extensions 298*a*, 298*b*. The manifold 250 also extends through the circular central portion 296 and into a cavity on the opposite side of the circular platform 290.

Figure 35:
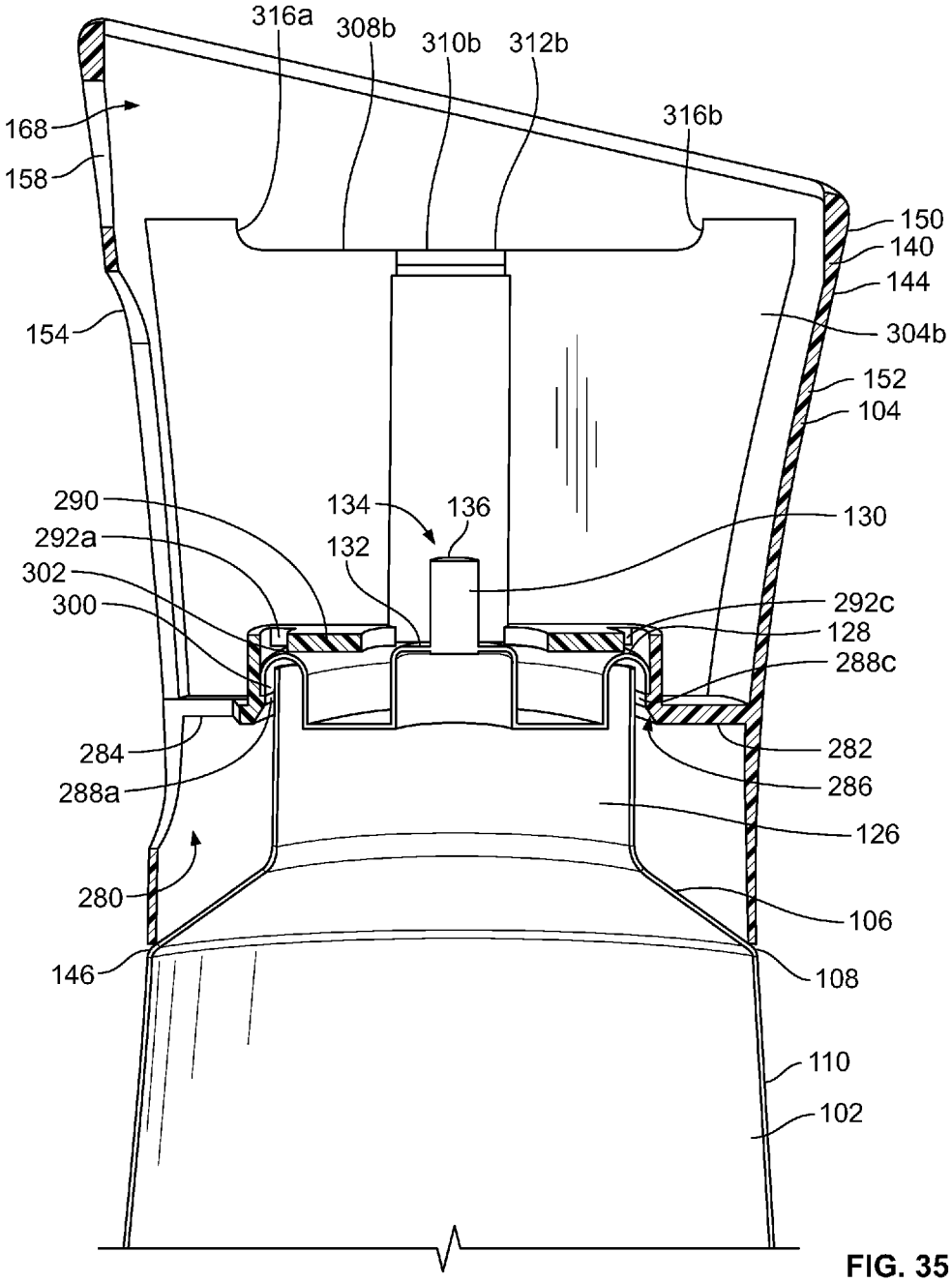
FIG. 35 is a partial cross-sectional view of the dispensing system of FIG. 1, generally taken along the line 35-35 of FIG. 1, wherein a top portion, an actuator, and a manifold are removed therefrom for purposes of clarity.

With reference to FIG. 35 the cylindrical neck 126 of the container 102 is shown extending through the bottom end 146 of the overcap 104, through the aperture 280, and into the circular opening 286. Peripheral edges of the mounting cup 128 pass the four equidistantly spaced prongs 288*a*, 288*b*, 288*c*, 288*d* (shown in FIG. 33) when the container 102 is fitted to the overcap 104. The container 102 is attached to the overcap 104 by allowing the resilient spaced prongs 288*a*, 288*b*, 288*c*, 288*d* to bend and lock into place beneath an undercut 300 of the mounting cup 128 upon an upper portion 302 of the mounting cup 128 being disposed adjacent the circular platform 290. Upon insertion of the container 102 in this manner, the container 102 is locked within the overcap 104 to prevent removal. In other embodiments, the overcap 104 may be removed from the container 102 by appropriately sizing the spaced prongs 288*a*, 288*b*, 288*c*, 288*d* and applying a suitable force to disengage the container 102 from the overcap 104. It is also contemplated that any other attachment means known to one of skill in the art may be practiced in connection with the presently described container and overcap.

Turning again to FIGS. 31, 32, 34, and 35, the opposite side of the circular platform 290 is depicted with two divider walls 304*a*, 304*b* extending upwardly therefrom. The divider walls 304*a*, 304*b* extend between the front side 154 and the back side 152 of the overcap 104 and are substantially aligned with and parallel to the rectilinear extensions 298*a*, 298*b* of the circular platform 290, respectively. The divider walls 304*a*, 304*b* also include inwardly extending projections 306*a*, 306*b* disposed adjacent distal ends 308*a*, 308*b* of the divider walls 304*a*, 304*b* in alignment with the rectilinear extensions 298*a*, 298*b* of the circular platform 290. FIG. 32 illustrates how distal ends 308*a*, 308*b* of the divider walls 304*a*, 304*b* are truncated by elongate grooves 310*a*, 310*b*, respectively. The portions of the divider walls 304*a*, 304*b* defining the grooves are substantially flat in central portions 312*a*, 312*b* thereof, respectively, and are imparted with curved ends 314*a*, 314*b* and 316*a*, 316*b*, respectively.

Figure 36:
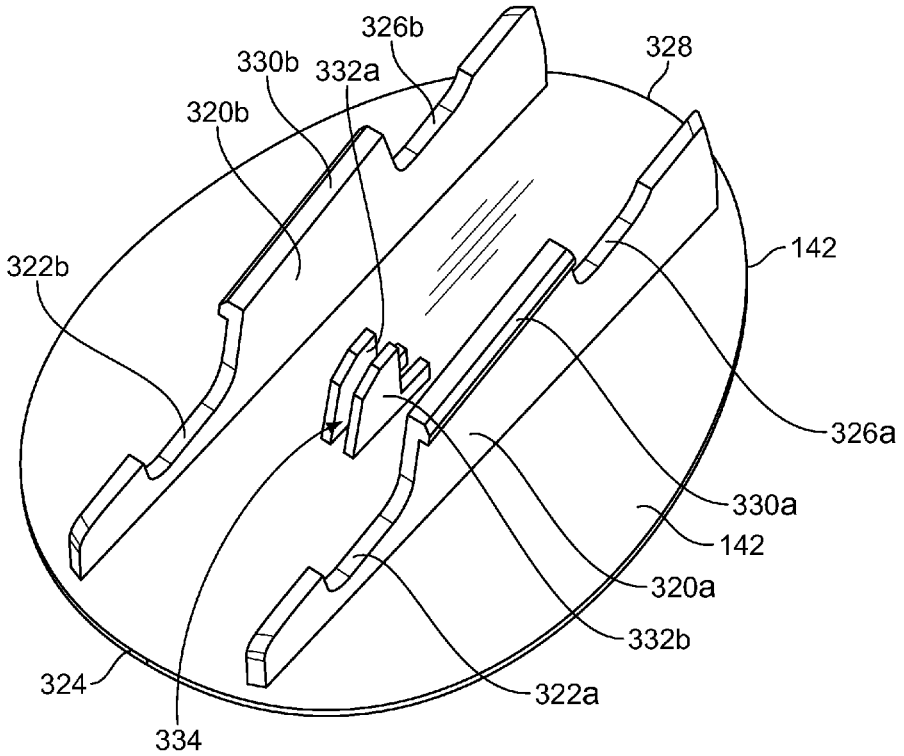
FIG. 36 is an isometric view of a bottom, rear, and left side of a top portion of the overcap depicted in FIG. 1.
Figure 37:
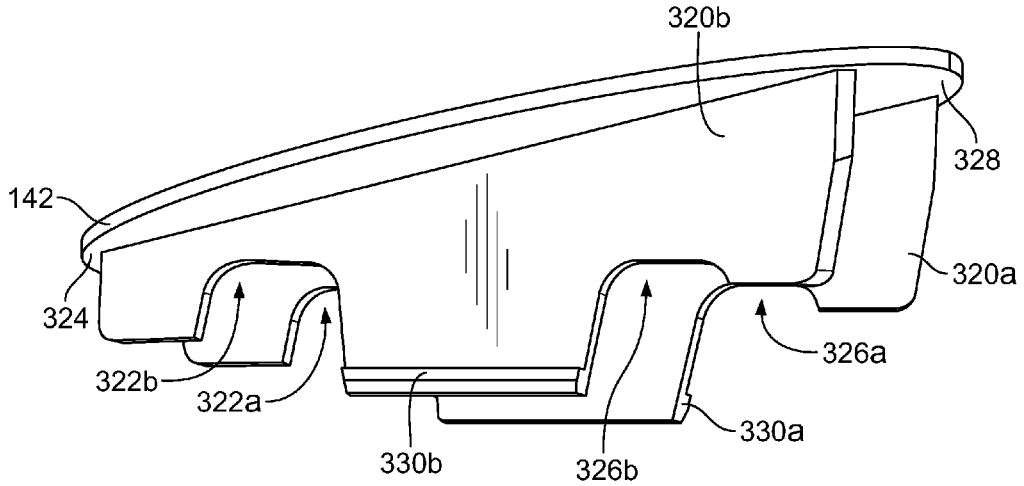
FIG. 37 is an isometric view of a bottom, front, and right side of the top portion of FIG. 36.
Figure 38:
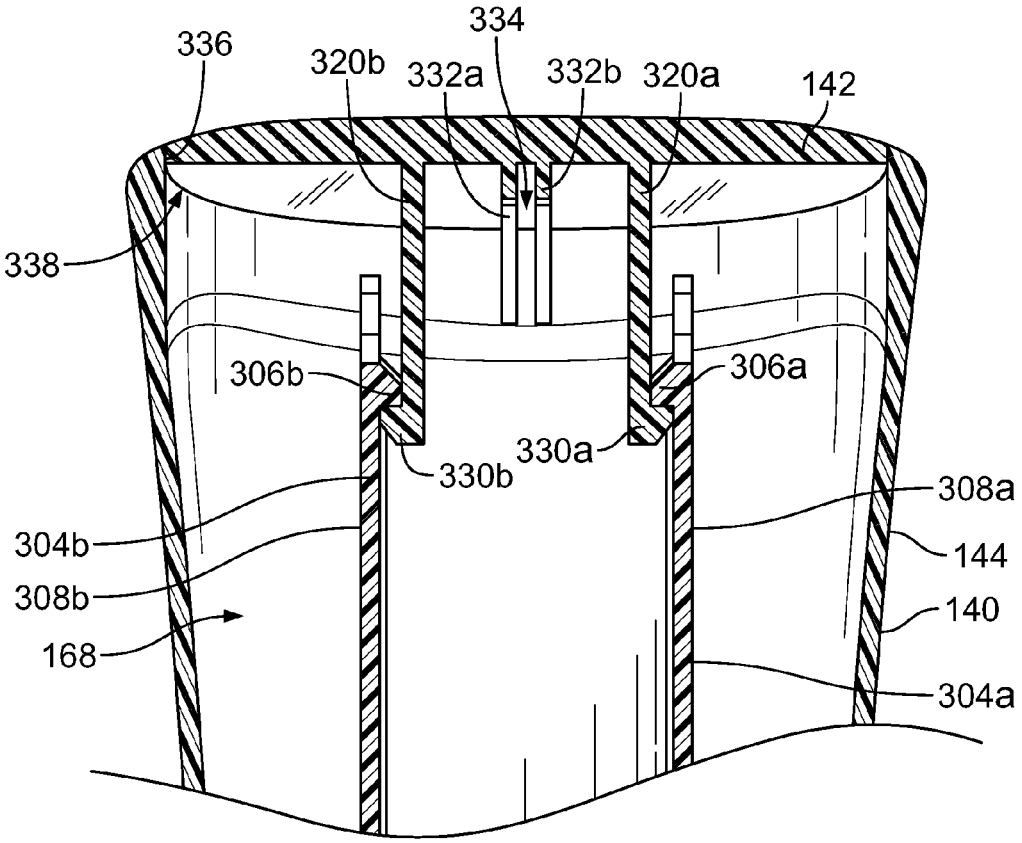
FIG. 38 is a partial cross-sectional view of the overcap of FIG. 1 taken along the line 38-38 of FIG. 22, with the actuator and manifold removed therefrom for purposes of clarity.

As shown in FIGS. 36-38, the top end 142 of the overcap 104 is disposed on the body 140. With reference to FIG. 36, the top end 142 is shown to have depending top end walls 320*a*, 320*b*. The top end walls 320*a*, 320*b* include opposing slots 322*a*, 322*b* adjacent a rear side 324 of the top end 142 and opposing slots 326*a*, 326*b* adjacent a front side 328 of the top end 142. Ribs 330*a*, 330*b* extend outwardly from the top end walls 320*a*, 320*b*, respectively, between the slots 322*a*, 326*a* and 322*b*, 326*b*, respectively. Two angled wall portions 332*a*, 332*b* also depend from the top end 142 between the top end walls 320*a*, 320*b* and define a space 334 therebetween.

As depicted in FIG. 38, the top end 142 is attached to the body 140 by aligning the top end walls 320*a*, 320*b* and the corresponding ribs 330*a*, 330*b* with the divider walls 304*a*, 304*b* and the corresponding projections 306*a*, 306*b*, respectively. Upon proper alignment, the top end 142 and the body 140 may be forced together so as to snap fit the ribs 330*a*, 330*b* over the projections 306*a*, 306*b* to retain the top end 142 and the body 140 together. It is contemplated that one or more of the ribs 330*a*, 330*b* and the projections 306*a*, 306*b* are resilient to allow deformation during the fitting procedure and to preclude any accidental breakage of portions of the overcap 104. When fitted properly, lower portions of the top end walls 320*a*, 320*b* will rest interiorly of the distal end 308 of the divider walls 304*a*, 304*b*, respectively. Further, peripheral portions 336 of the top end 142 will rest within an aperture 338 of the body 140.

Figure 39:
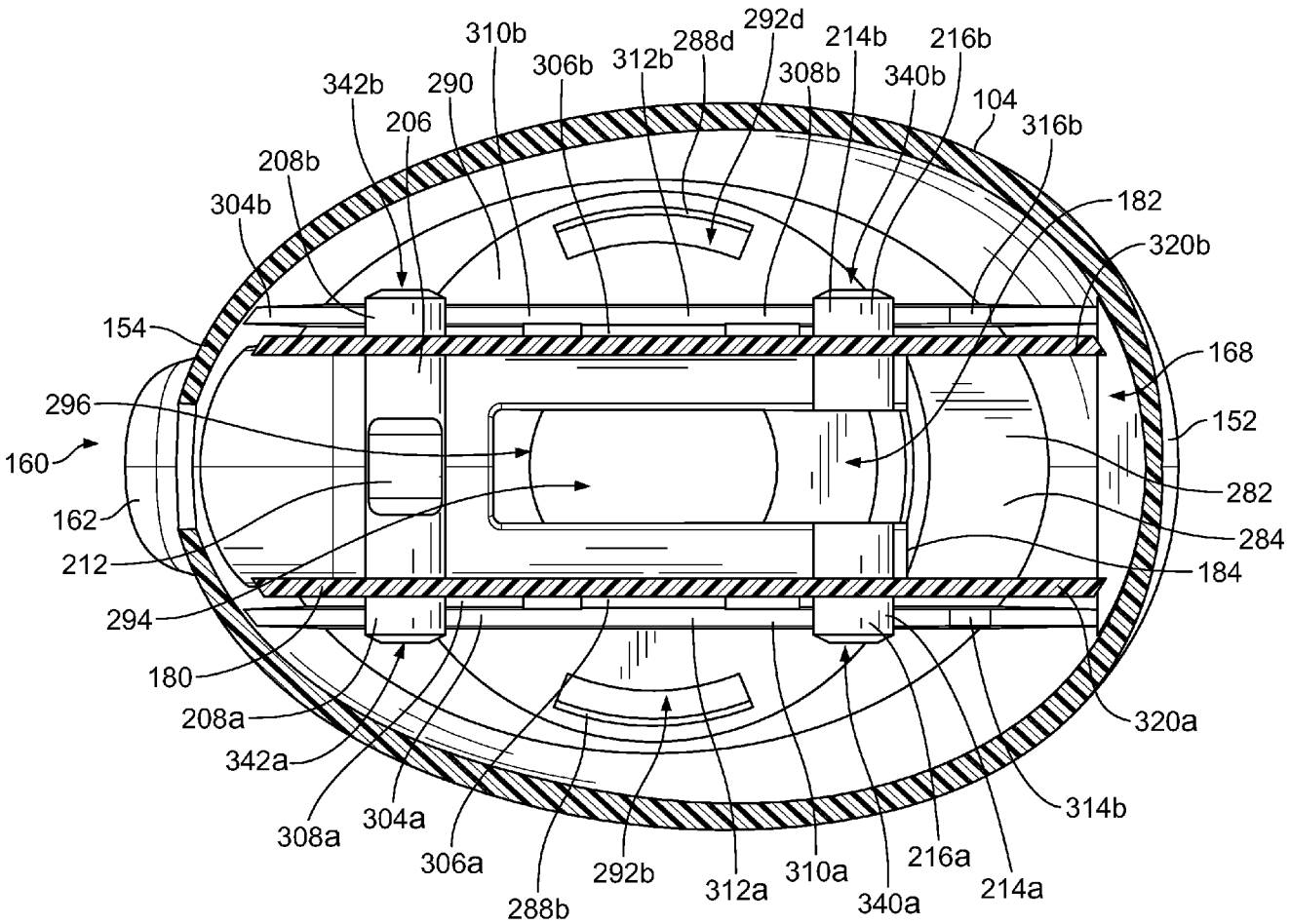
FIG. 39 is a partial cross-sectional, top plan view of the overcap of FIG. 1 with the actuator of FIG. 25 disposed therein taken along the line 39-39 of FIG. 20.
Figure 40A:
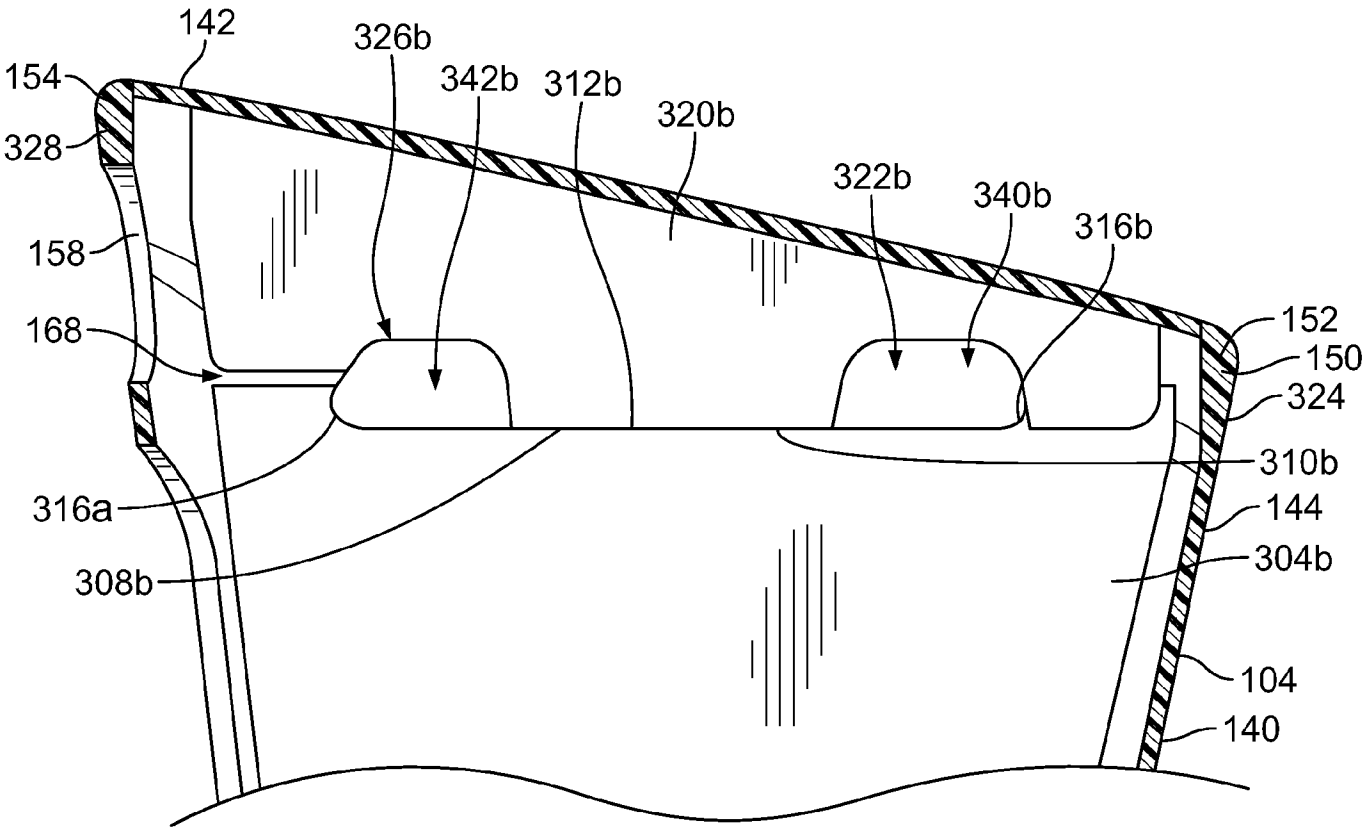
FIG. 40A is a partial cross-sectional, left side view of the overcap of FIG. 1, with portions removed from an interior thereof, generally taken along the line 40A-40A of FIG. 22.
Figure 40B:
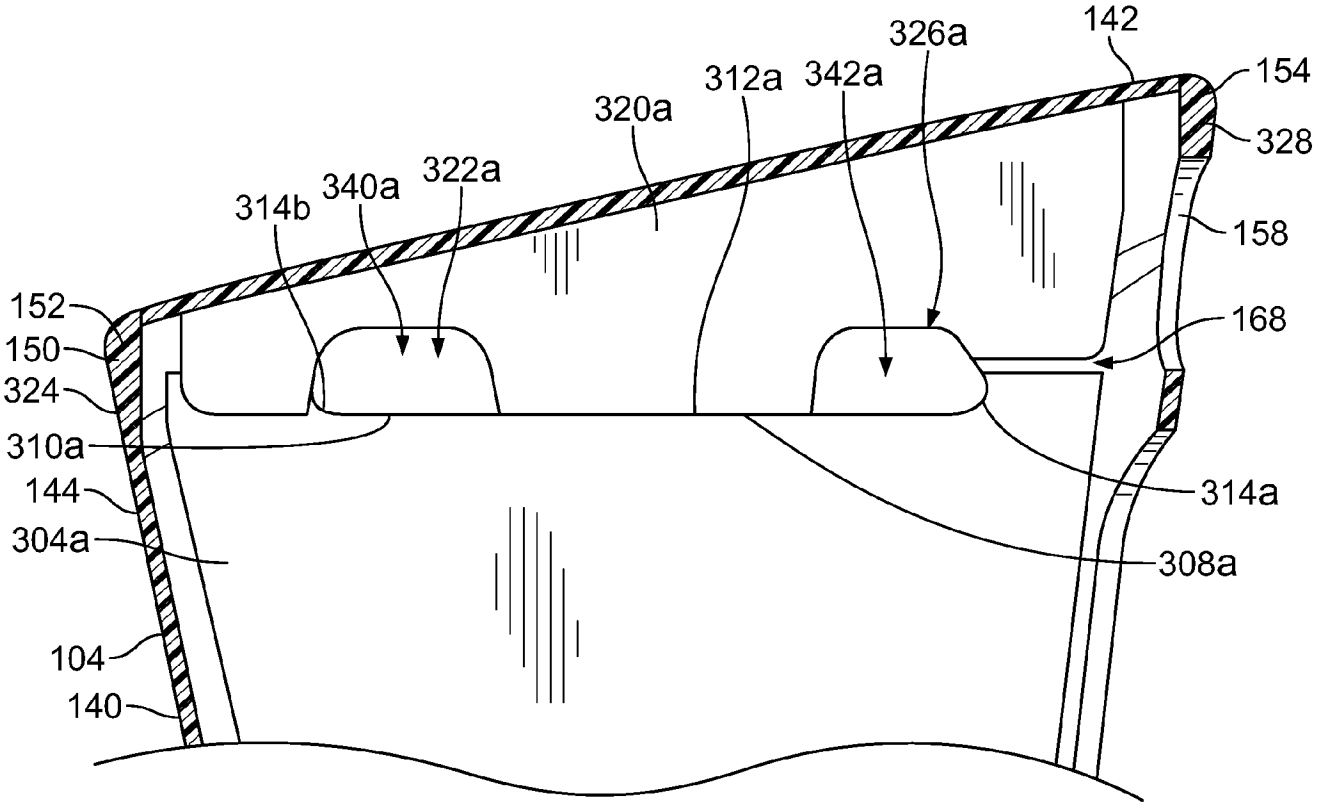
FIG. 40B is a partial cross-sectional, right side view of the overcap of FIG. 1, with portions removed from an interior thereof, generally taken along the line 40B-40B of FIG. 22.

Turning to FIGS. 39, 40A, and 40B, it may be seen that channels are formed by portions of the divider walls 304*a*, 304*b* and portions of the top end walls 320*a*, 320*b*. Specifically, channels 340*a*, 340*b* are defined by portions of the top end wall 320*a*, 320*b* forming the slots 322*a*, 322*b* in combination with the central portions 312*a*, 312*b* and the curved ends 314*b*, 316*b*, respectively. The cylindrical portions 216*a*, 216*b* of the first and second sections 214*a*, 214*b*, respectively, on the actuator 160 are disposed within the channels 340*a*, 340*b*. Similarly, channels 342*a*, 342*b* are defined by portions of the top end wall 320*a*, 320*b* forming the slots 326*a*, 326*b* in combination with the central portions 312*a*, 312*b* and the curved ends 314*a*, 316*a*, respectively. The cylindrical portion 206 of the planar projection 202*a* on the actuator 160 is disposed within the channels 342*a*, 342*b*. The channels 340*a*, 340*b*, 342*a*, 342*b* allow the first and second cylindrical portions 216*a*, 216*b* and the first and second ends 208*a*, 208*b* of the cylindrical portion 206 to be retained therein and slid laterally as described further hereinbelow.

The actuator 160 is constructed to act as a lateral actuation mechanism that has a path of motion substantially parallel to the latitudinal axis 120 of the dispensing system 100. When a user applies an actuation force about any portion of the length l of the elongate button 162, the actuator 160 is engaged to dispense fluid from the container 102. More particularly, the present embodiment allows for a substantially equal amount of force to be applied anywhere along the length l of the elongate button 162 to actuate the dispensing system 100. This is particularly useful when it is desirous to provide a dispensing system with a uniform actuation force profile for any number of different people with unique preferences in the placement of their fingers and or hand on a dispensing system for actuating same.

Figure 41:
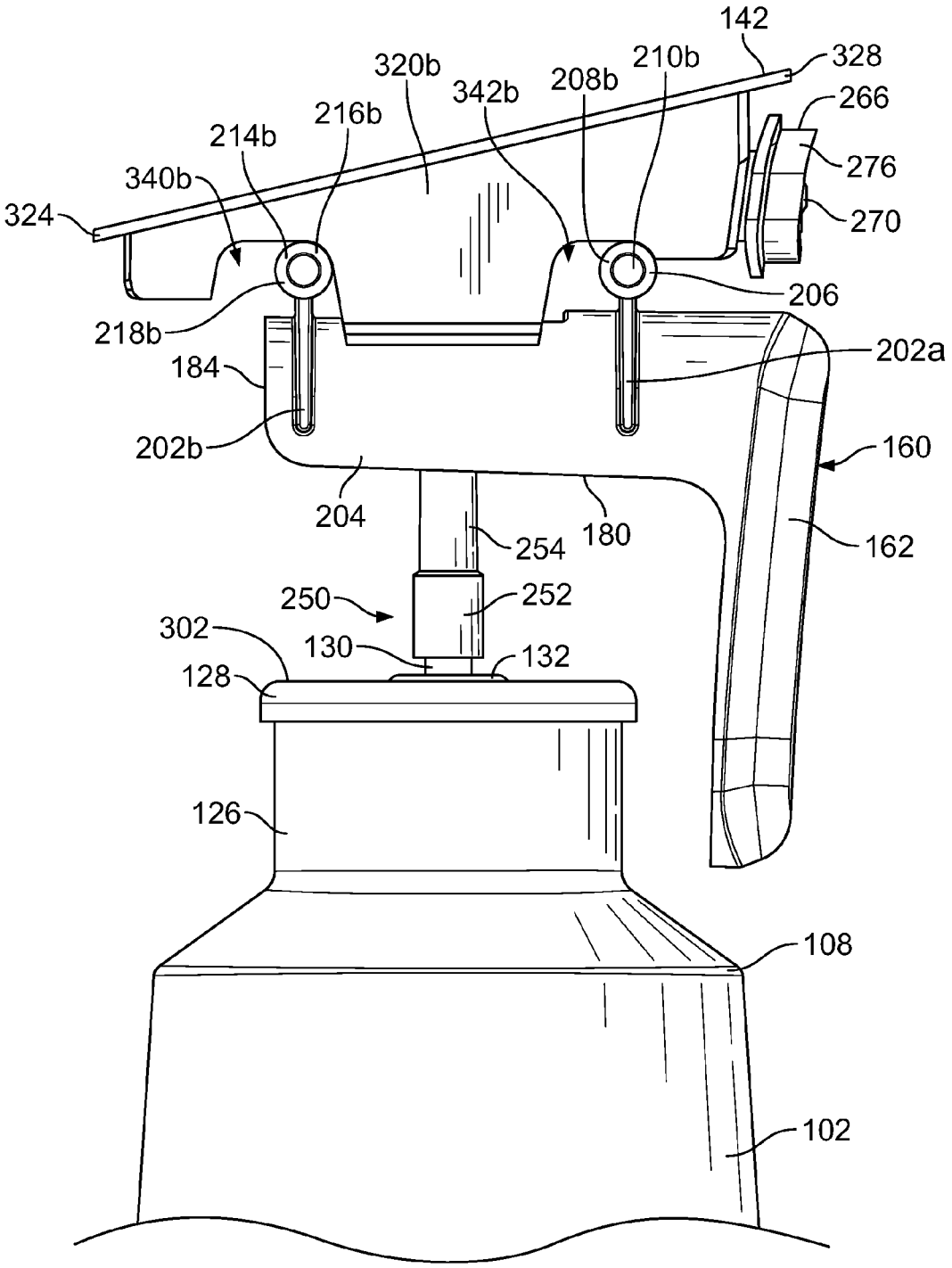
FIG. 41 is the dispensing system of FIG. 1 with a body of the overcap removed to better depict the actuator of FIG. 25 in a first, non-actuating position.
Figure 42:
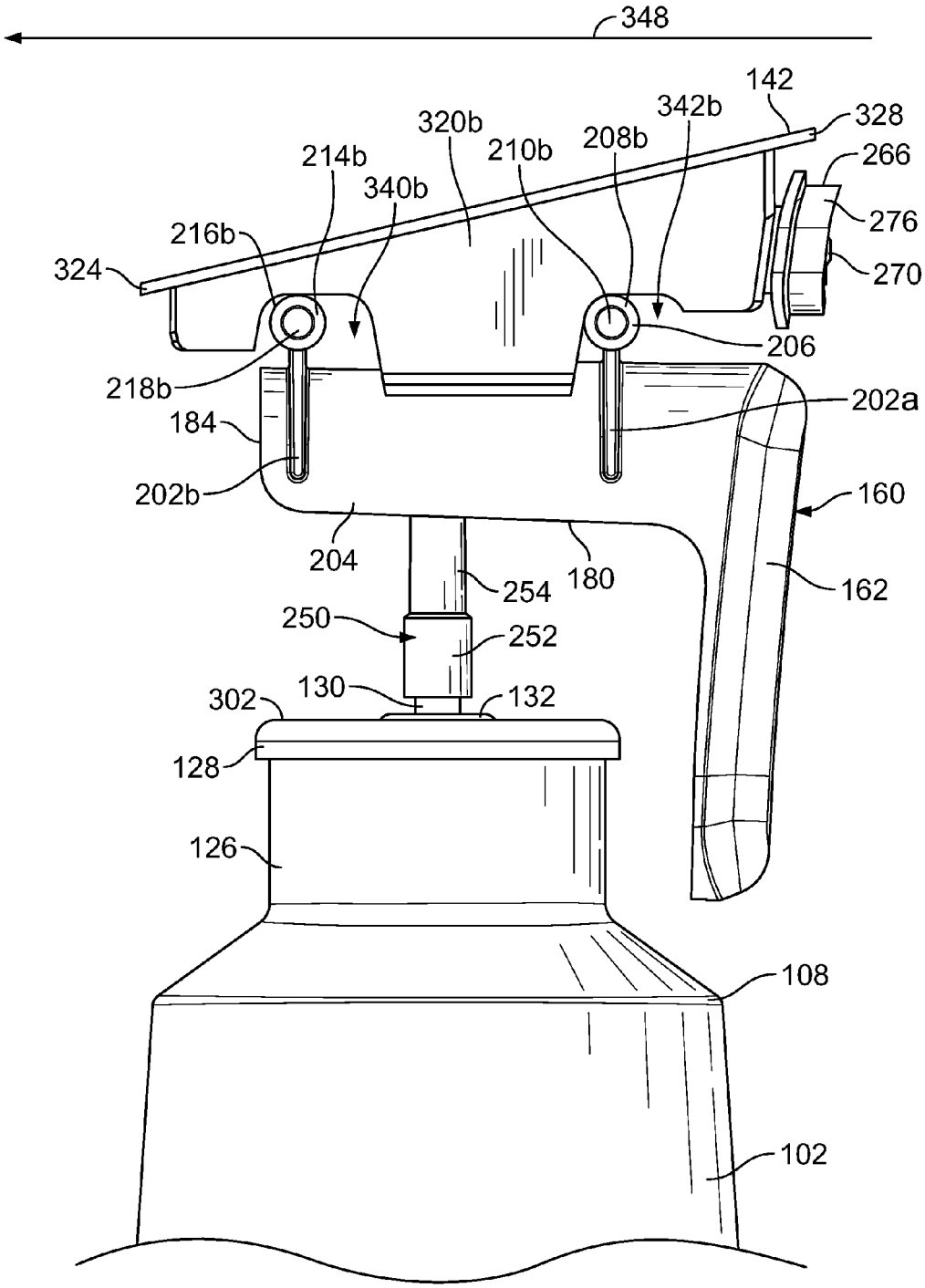
FIG. 42 is a view of the dispensing system of FIG. 41 depicting the actuator in a second, actuating position.
Figure 43:
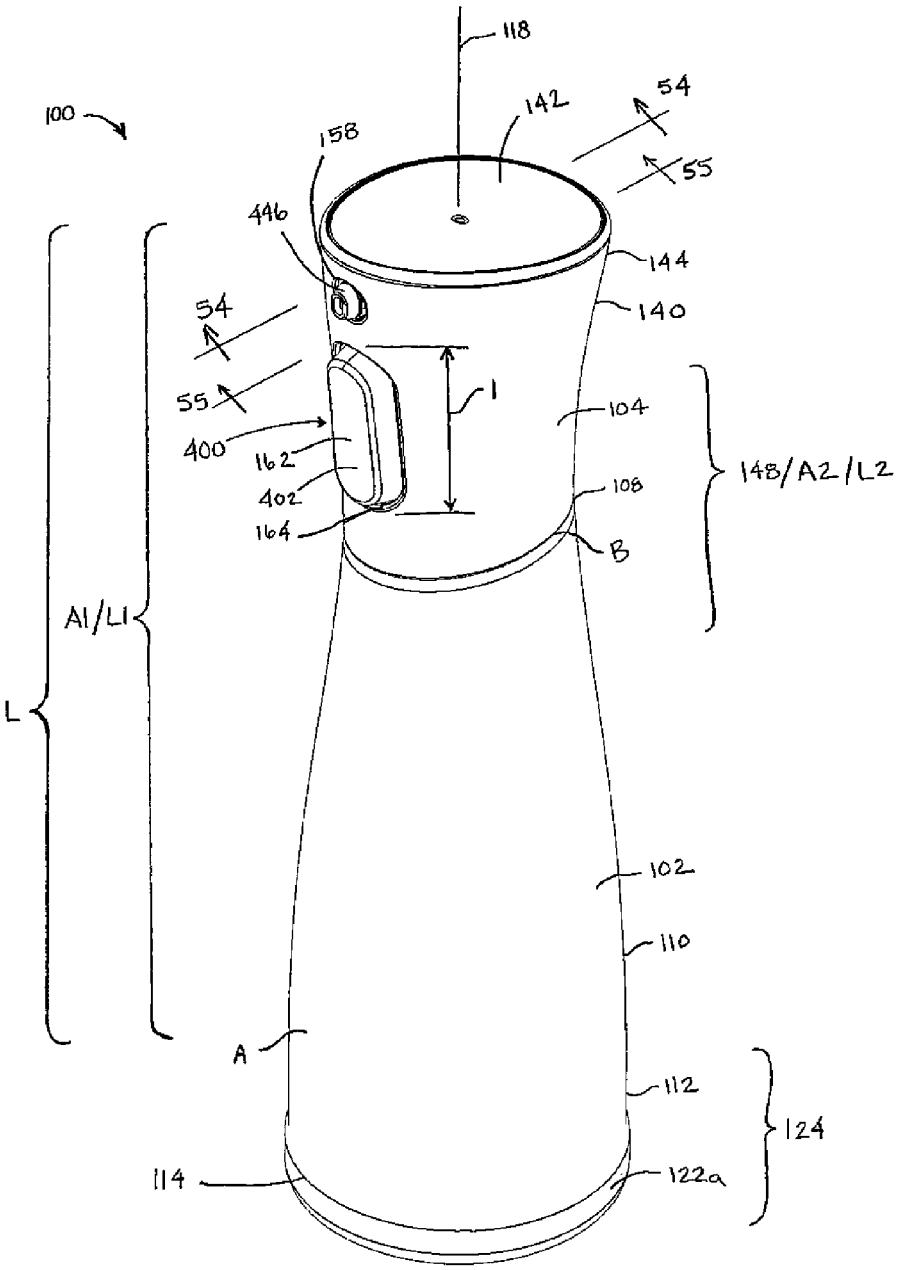
FIG. 43 is an isometric view of a top, front, and left side of the dispensing system of FIG. 1, which includes a second embodiment of an actuation mechanism.

In use, the actuator 160 is in a first, non-dispensing position as shown in FIG. 41. The first and second ends 208*a*, 208*b* of the cylindrical portion 206 rest within the channels 342*a*, 342*b* in a first position, which corresponds with an area of the channels 342*a*, 342*b* closer to the elongate button 162. Similarly, the first and second cylindrical portions 216*a*, 216*b* of the planar projection 202*b* rest within the channels 340*a*, 340*b* in a first position, which corresponds to an area of the channels 340*a*, 340*b* closer to the elongate button. As a user applies lateral force on the elongate button 162 in the direction shown by the arrow 348, the U-shaped wall 180 is forced laterally in the direction of the arrow 348 within the overcap 104 (see FIG. 42). The movement of the U-shaped wall is constrained into lateral motion by way of the channels 340*a*, 340*b*, 342*a*, 342*b*, which preclude substantial longitudinal or rotational movement of the first and second cylindrical portions 216*a*, 216*b* and the first and second ends 208*a*, 208*b*, respectively. Continued lateral movement is prevented by the abutment of one or more of the first and second cylindrical portions 216*a*, 216*b* and the first and second ends 208*a*, 208*b* against corresponding portions of the top end walls 320*a*, 320*b* and the divider walls 304*a*, 304*b* that define distal portions of the channels 340*a*, 340*b* and 342*a*, 342*b*, respectively. In the present embodiment, a user needs to laterally move the first and second cylindrical portions 216*a*, 216*b* and the first and second ends 208*a*, 208*b* within the channels 340*a*, 340*b*, 342*a*, 342*b* about 3.84 mm to actuate the valve stem 130, as described in more detail below. In other preferred embodiments the actuator 160 is moved between about 1 mm to about 26 mm to actuate the valve stem 130.

The lateral movement of the elongate button 162 also causes the inclined sections 198*a*, 198*b* of the opposing interior walls 192*a* and 192*b* to abut against the opposing cylindrical protrusions 256*a*, 256*b* that extend from the exterior surface of the first tube 254 of the manifold 250, respectively. Due to the constraint of the actuator 160 to purely lateral movement during actuation, the inclined sections 198*a*, 198*b* force the cylindrical protrusions 256*a*, 256*b* and the first tube 254 downwardly in a direction substantially parallel to the longitudinal axis 118. Downward movement of the first tube 254 causes the depression of the valve stem 130, which in turn opens the valve assembly of the container 102. The opening of the valve assembly causes fluid product to be emitted through the base 102, the first and second tubes 254, 258, into the nozzle 270, and out into the atmosphere.

FIGS. 43-58 depict a second embodiment of an actuation mechanism 400 disposed within the overcap 104 for use in the dispensing system 100. The actuation mechanism 400 and overcap 104 are similar to the previously described embodiments except for the below noted differences and elements common to the embodiment shown in FIGS. 43-58 are assigned like reference numerals. The actuation mechanism 400 of the present embodiment broadly includes an actuator 402 and a manifold 404.

Figure 44:
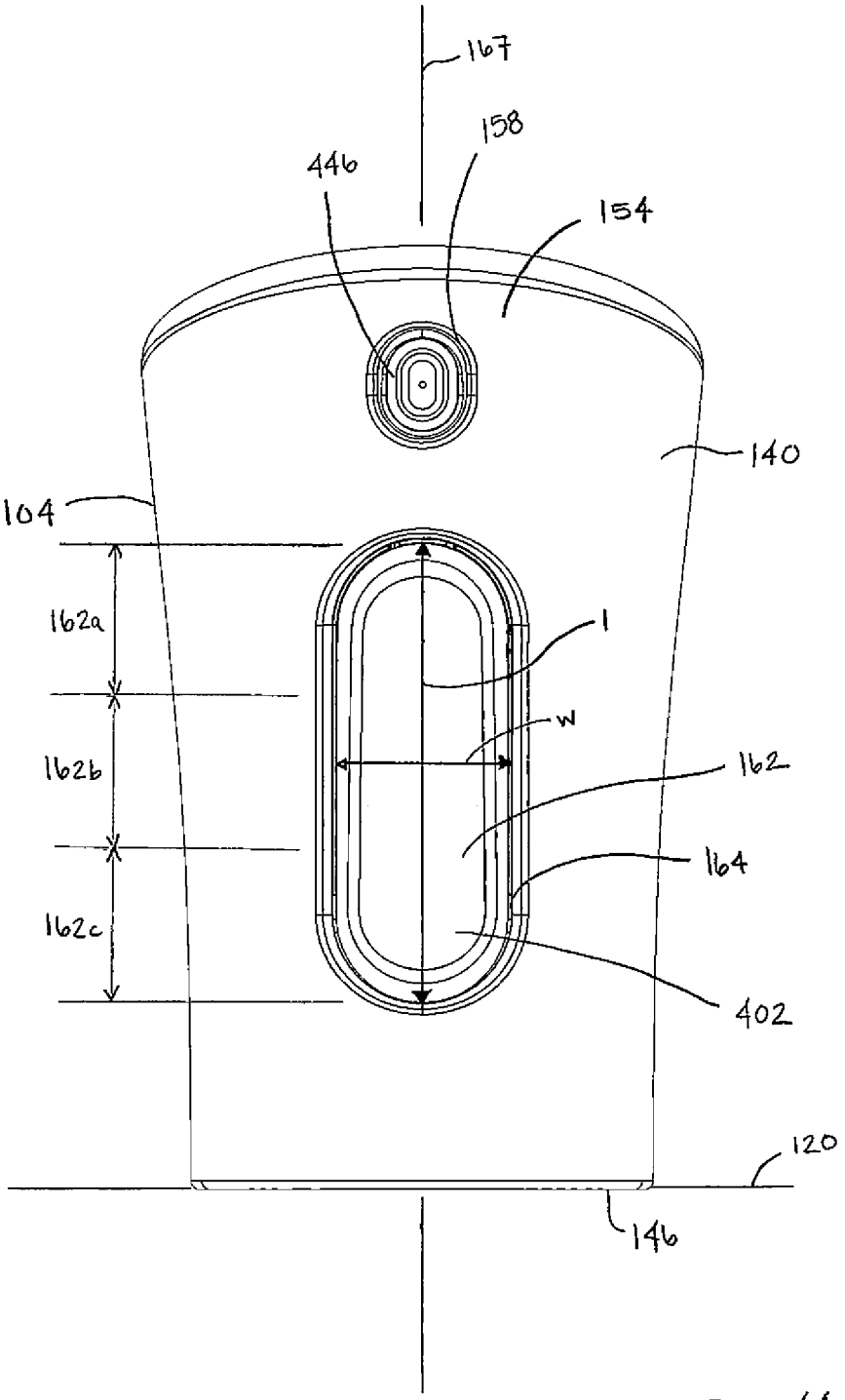
FIG. 44 is a front elevational view of the overcap of FIG. 43.

Referring to FIGS. 44-47, the actuator 402 of the present embodiment includes the elongate button 162 disposed within the body 140 of the overcap 104. The elongate button 162 extends through a similarly shaped opening 164 within the body 140 as previously described. The length dimension l and the width dimension w of the elongate button 162 are similar to the dimensions described above. As shown in FIG. 44, the button 162 includes an upper, middle, and lower portion 162*a*, 162*b*, 162*c*, respectively.

Figure 45:
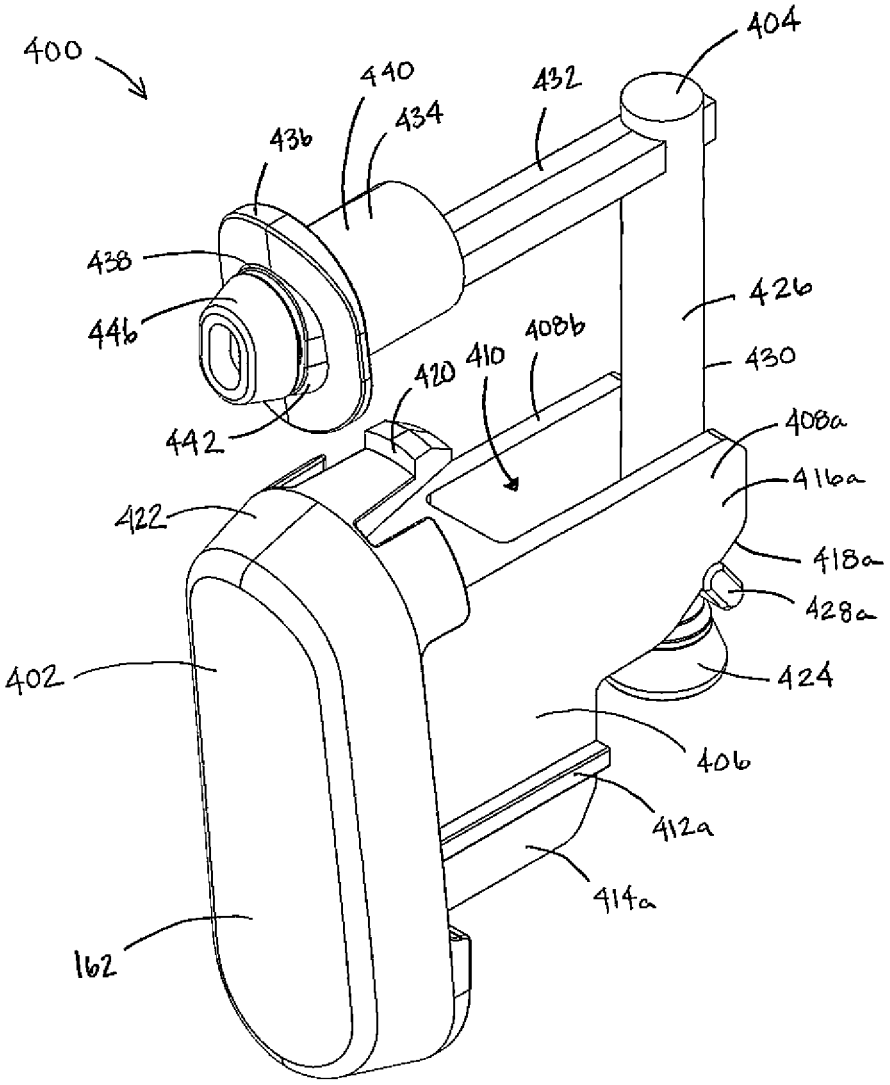
FIG. 45 is an isometric view of a top, front, and left side of the second embodiment of the actuation mechanism of FIG. 43, which includes an actuator and a manifold.
Figure 46:
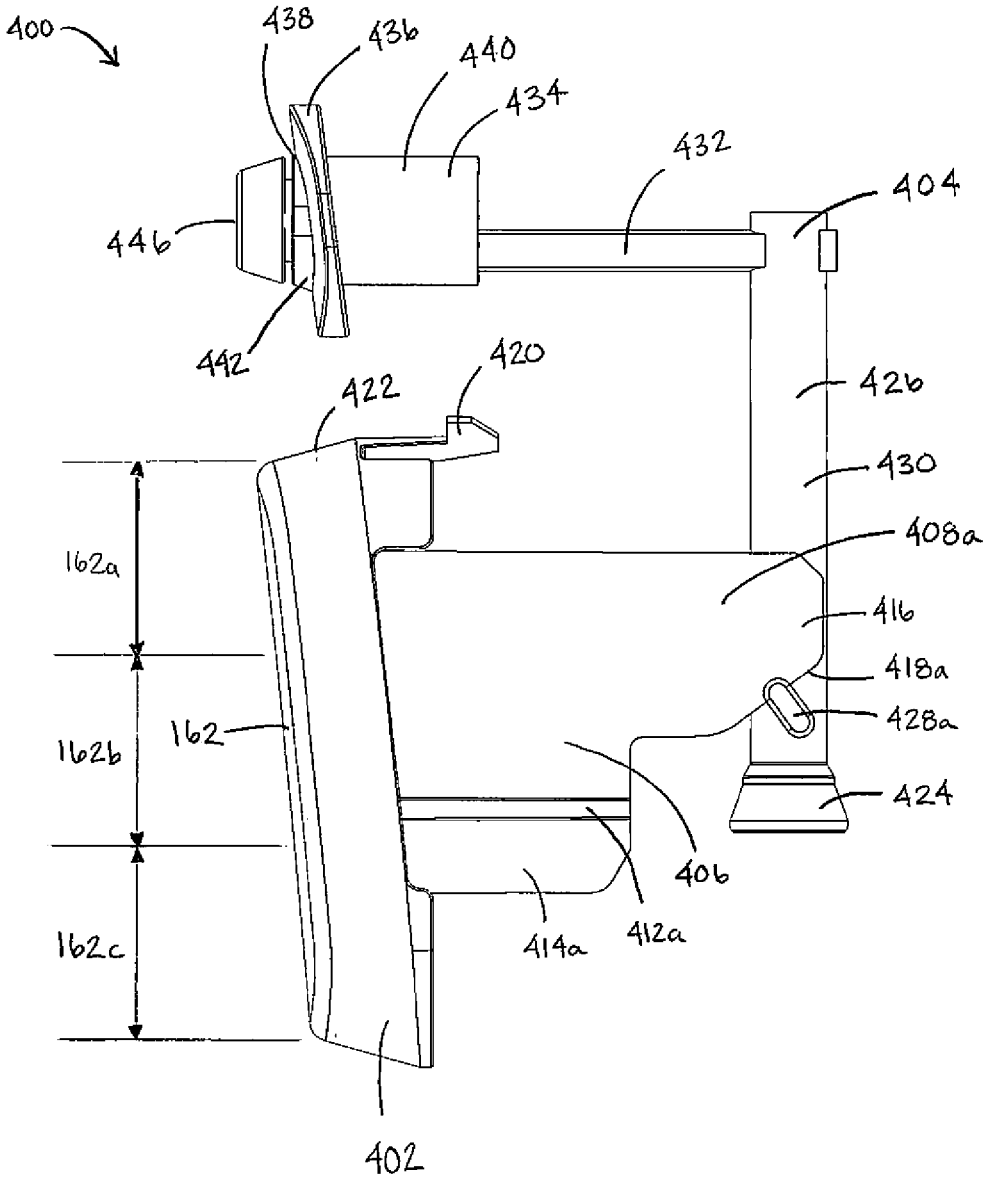
FIG. 46 is a left side elevational view of the actuation mechanism of FIG. 45.
Figure 47:
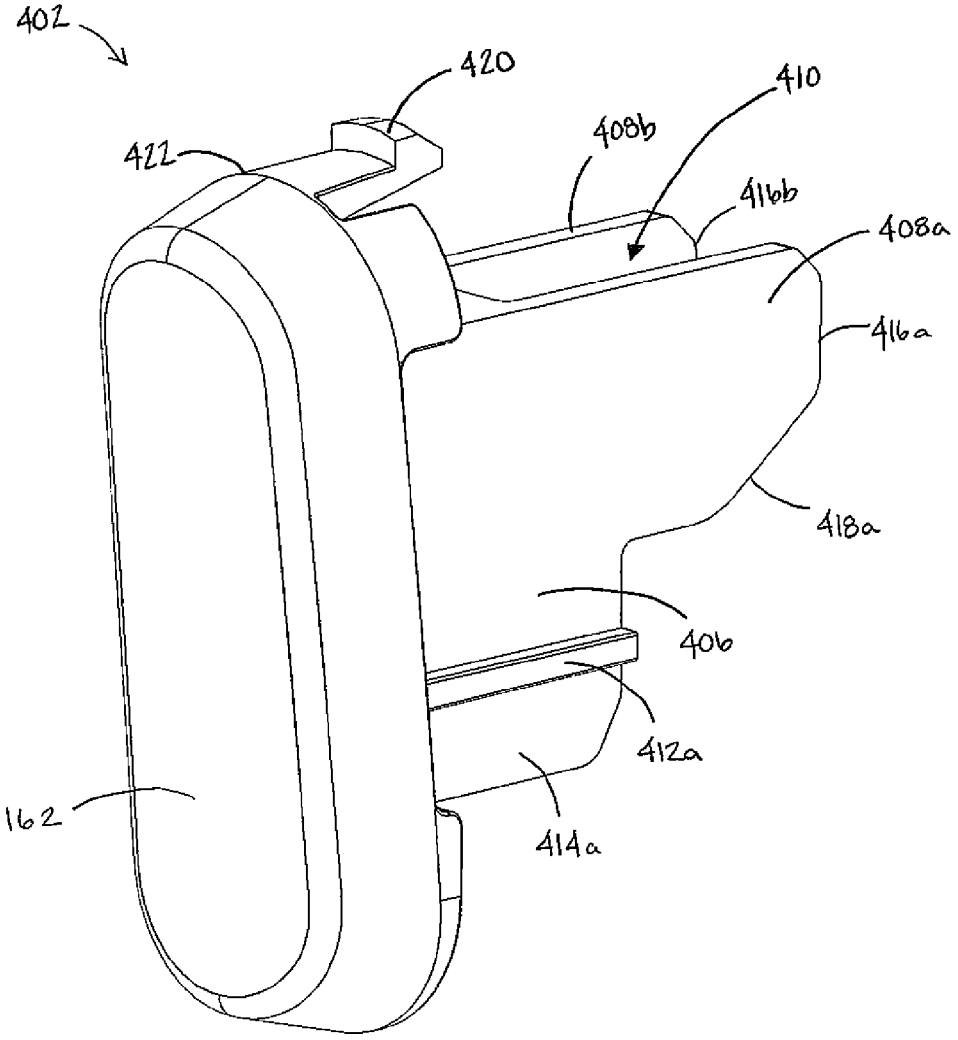
FIG. 47 is an isometric view of a top, front, and left side of the actuator of FIG. 45.

Referring now to FIGS. 45-47 the actuator 402 of the present embodiment includes a body 406 extending rearwardly from the elongate button 162. The body 406 includes two outwardly extending rails 408*a*, 408*b* on opposing sides of a channel 410. Ribs 412*a*, 412*b* (only 412*a* is shown) are disposed on outer sidewalls 414*a*, 414*b* (only 414*a* is shown), respectively, of the body 406 and extend the length of the body 406. The distal ends 416*a*, 416*b* of the rails 408*a*, 408*b* include angled sections 418*a*, 418*b* (only 418*a* is shown), respectively. A hook 420 extends rearwardly from a top end 422 of the elongate button 162.

Figure 48:
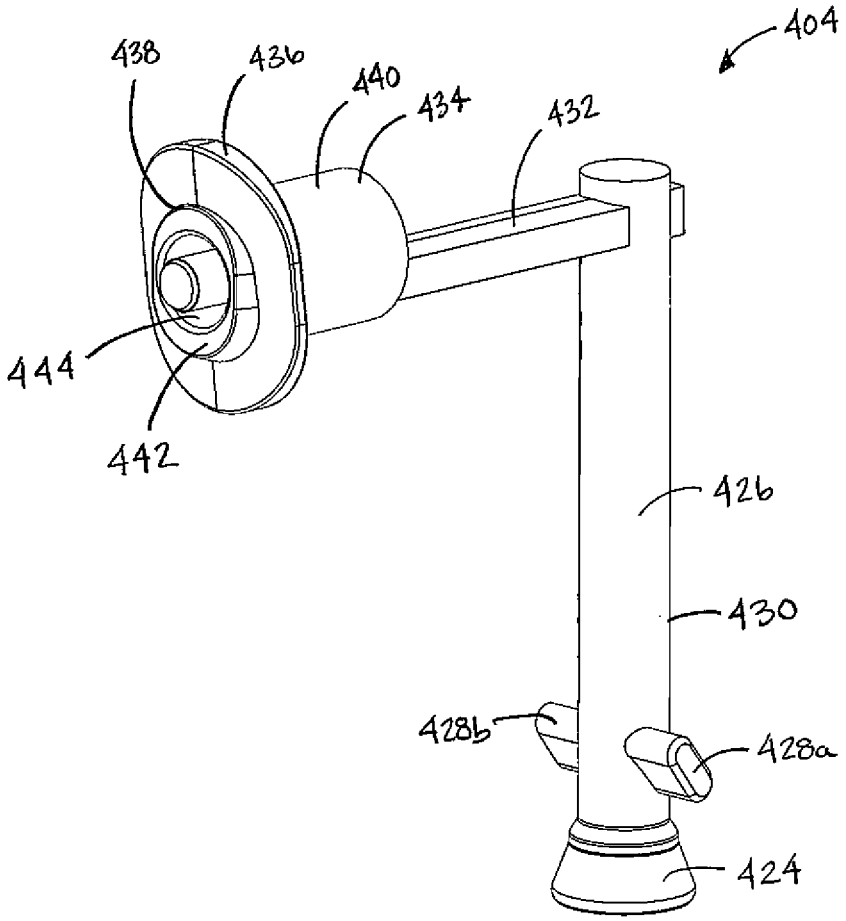
FIG. 48 is an isometric view of a top, front, and left side of the manifold of FIG. 45, wherein a nozzle insert is removed.

FIGS. 45, 46, and 48 depict the manifold 404 of the present embodiment, which is adapted to allow product to be dispensed therethrough. The manifold 404 of the present embodiment includes a conical base 424 adapted to receive and be in fluid communication with the distal end 136 of the valve stem 130 of the container 102. A first tube 426 extends upwardly from the conical base 424. Opposing angled racetrack shaped protrusions 428*a*, 428*b* extend from an exterior surface 430 of the first tube 426. A second tube 432 is in fluid communication with the first tube 426 and extends at a substantially 90 degree angle from same. A bezel 434 is attached to and in fluid communication with the distal end of the second tube 432. A racetrack shaped collar 436 is disposed around a first end 438 of an enlarged cylindrical section 440 of the bezel 434. A racetrack shaped outlet member 442 extends from the enlarged cylindrical section 440 of the bezel 434. A circular opening 444 (shown in FIG. 48) is provided within the racetrack shaped outlet member 442, which provides access for a nozzle insert 446 to emit fluid into the surrounding environment. The nozzle insert 446 and the outlet member 442 are designed to extend through the outlet orifice 158 in the body 140 of the overcap 104.

Referring to FIGS. 45 and 46, the manifold 404 is disposed within the channel 410 of the actuator 402. More specifically, the first tube 426 extends through the channel 410 and the racetrack shaped protrusions 428*a*, 428*b* of the manifold 404 are disposed below the angled sections 418*a*, 418*b* of the rails 408*a*, 408*b*, respectively.

FIGS. 49-55 depict the overcap 104 of the present embodiment, which includes a support structure 448 disposed within the chamber 168 of the overcap 104. The support structure 448 comprises a horizontal platform 450 extending from interior surfaces 452 of the body 140 of the overcap 104. Four curvilinear openings 454*a*, 454*b*, 454*c*, 454*d* are provided within the horizontal platform 450. Four prongs 456*a*, 456*b*, 456*c*, 456*d* extend into the chamber 168 from the inner surfaces 452 of the body 140. The prongs 456*a-d* are disposed below each of the curvilinear openings 454*a-d*, respectively, and are adapted to secure the overcap 104 to the container 102. The prongs 456*a-d* are configured to be secured beneath the undercut 300 of the mounting cup 128.

Figure 53:
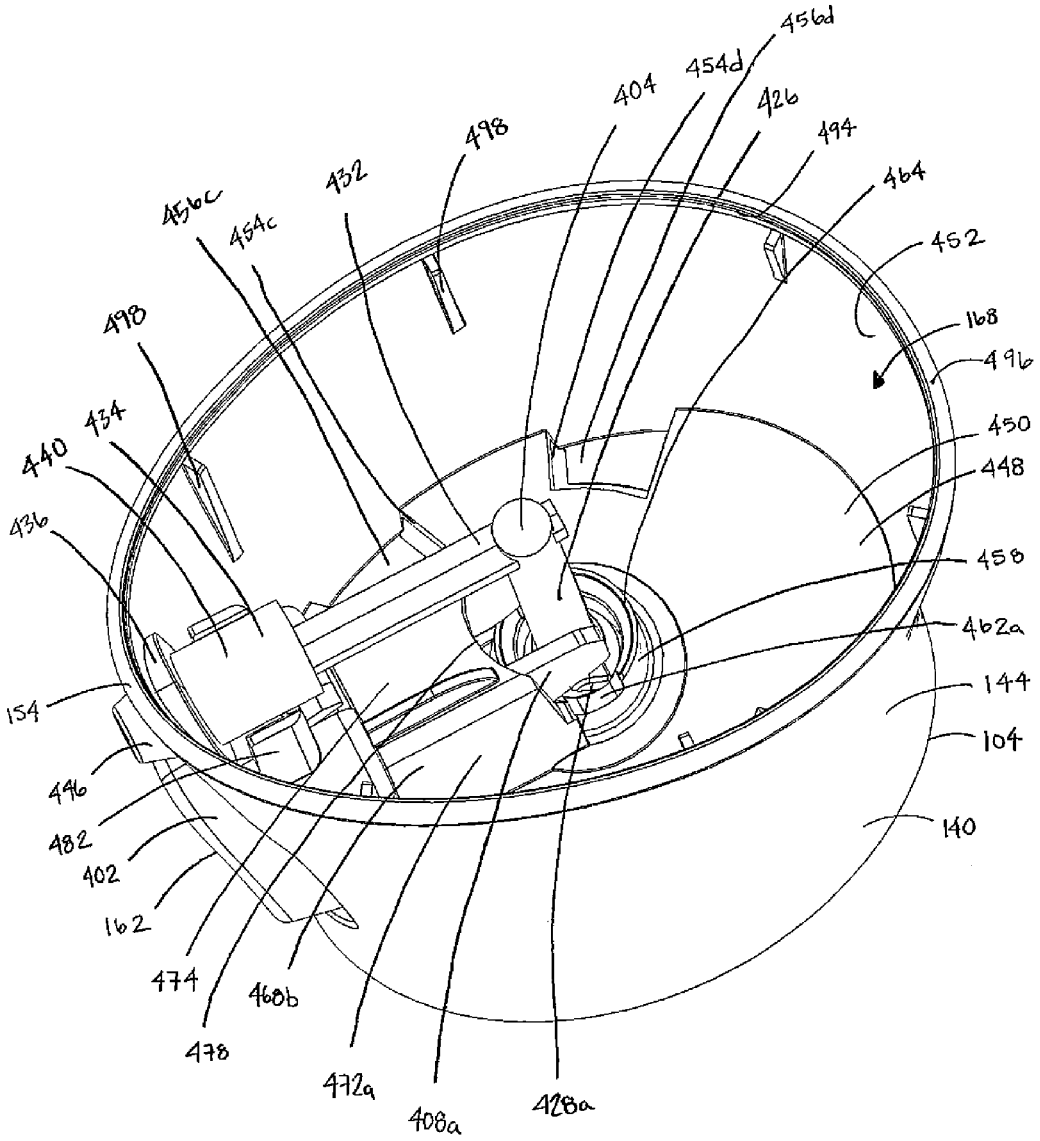
FIG. 53 is an isometric view of a top, front, and left side of the overcap and actuation mechanism of FIG. 43 with the top end removed.
Figure 54:
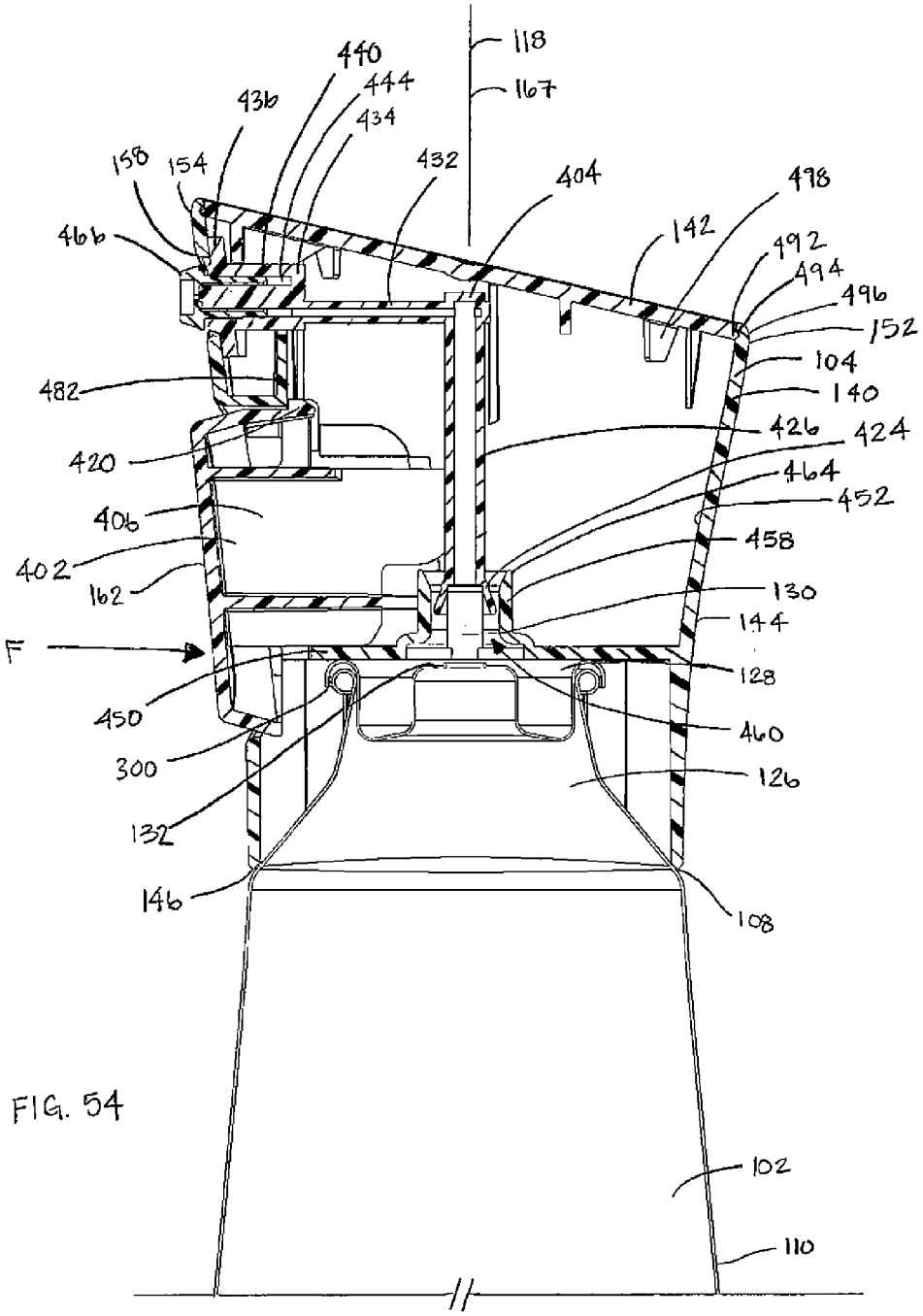
FIG. 54 is a partial cross-sectional view of the dispensing system and the actuation mechanism of FIG. 43, generally taken along the line 54-54 of FIG. 43.
Figure 55:
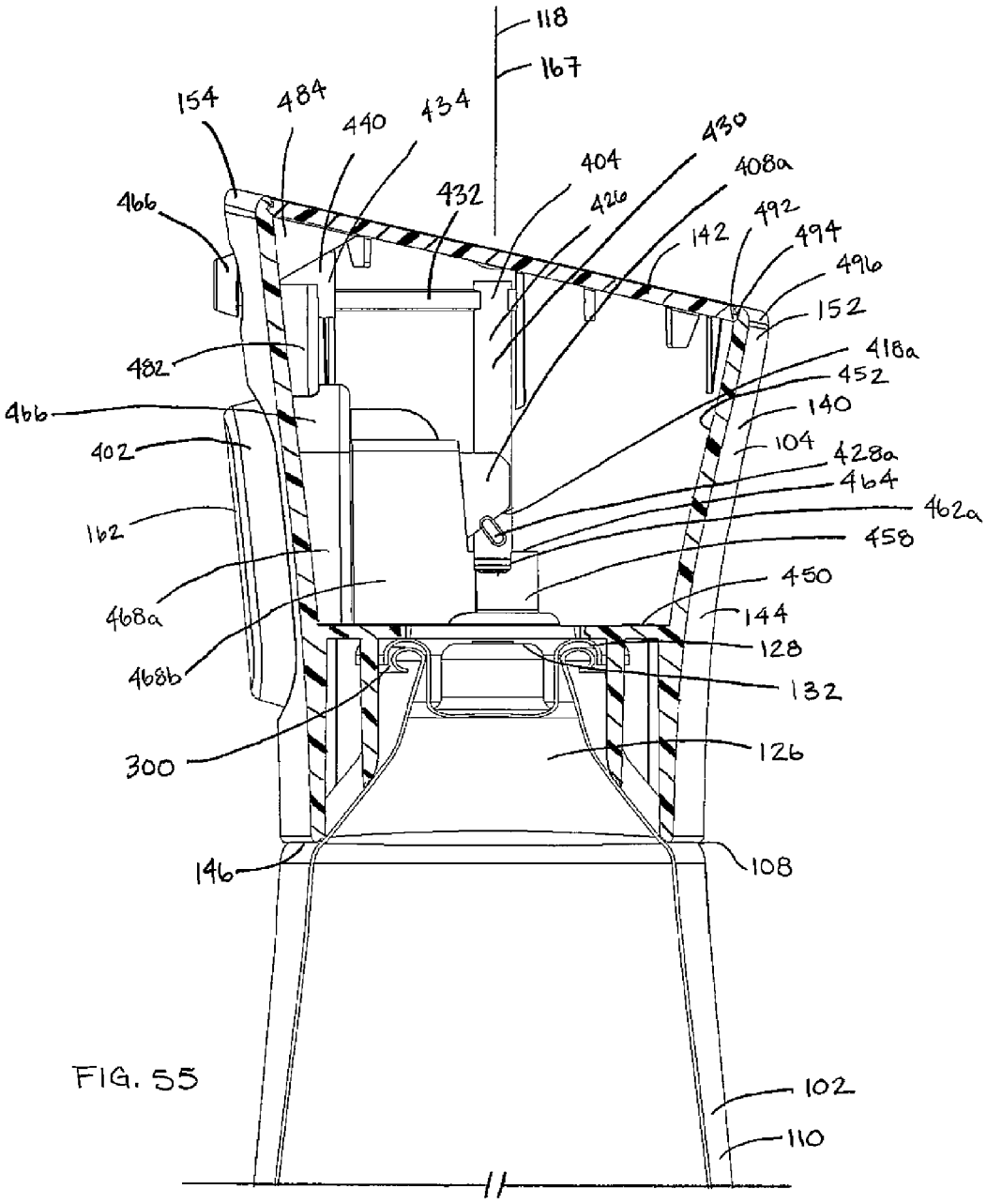
FIG. 55 is a partial cross-sectional view of the dispensing system and the actuation mechanism of FIG. 43, generally taken along the line 55-55 of FIG. 43.

Still referring to FIGS. 49-55, a centrally located cylindrical wall 458 extends upwardly from the platform 450 and defines a circular opening 460 in the center of the platform 450 between the curvilinear openings 454*a-d*. Further, as seen more clearly in FIG. 55, the cylindrical wall 458 includes two opposing grooves 462*a*, 462*b* (only 462*a* is shown in FIG. 55) extending downwardly from an upper edge 464 of the cylindrical wall 458. The grooves 462*a*, 462*b* are designed to allow the racetrack shaped protrusions 428*a*, 428*b* on the manifold 404 to move downwardly during actuation and further constrain the manifold 404 from moving too far.

Figure 49:
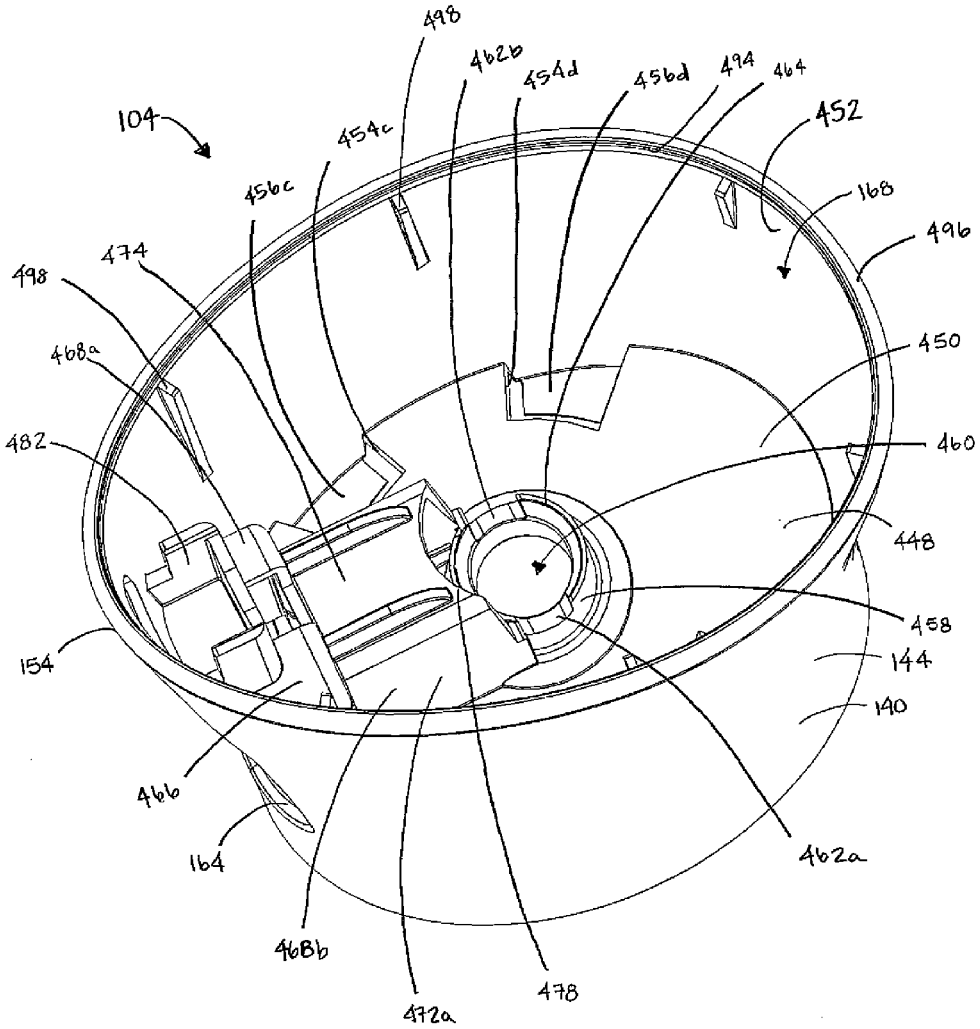
FIG. 49 is an isometric view of a top, front, and left side of the overcap of FIG. 43, wherein a top end has been removed.
Figure 50:
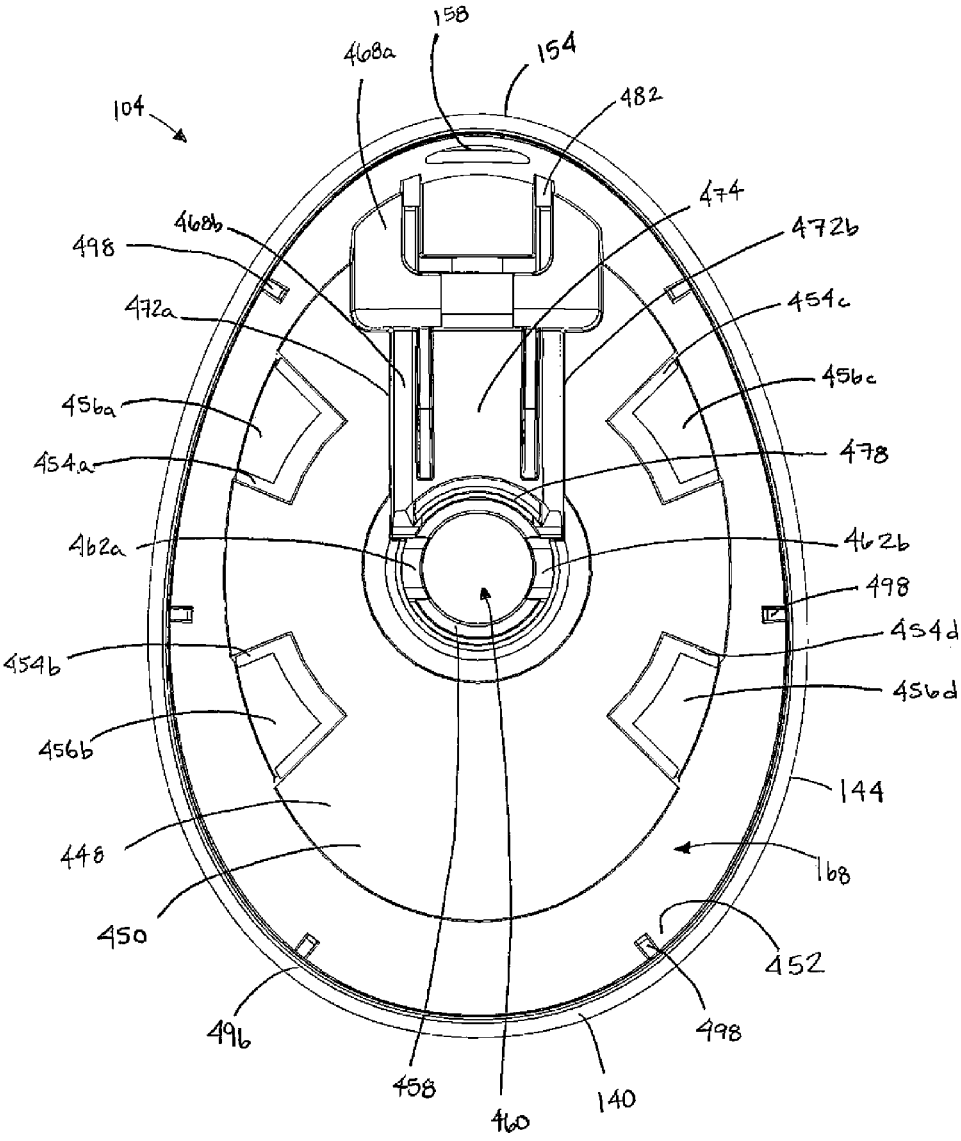
FIG. 50 is a top plan view of the overcap of FIG. 49.
Figure 51:
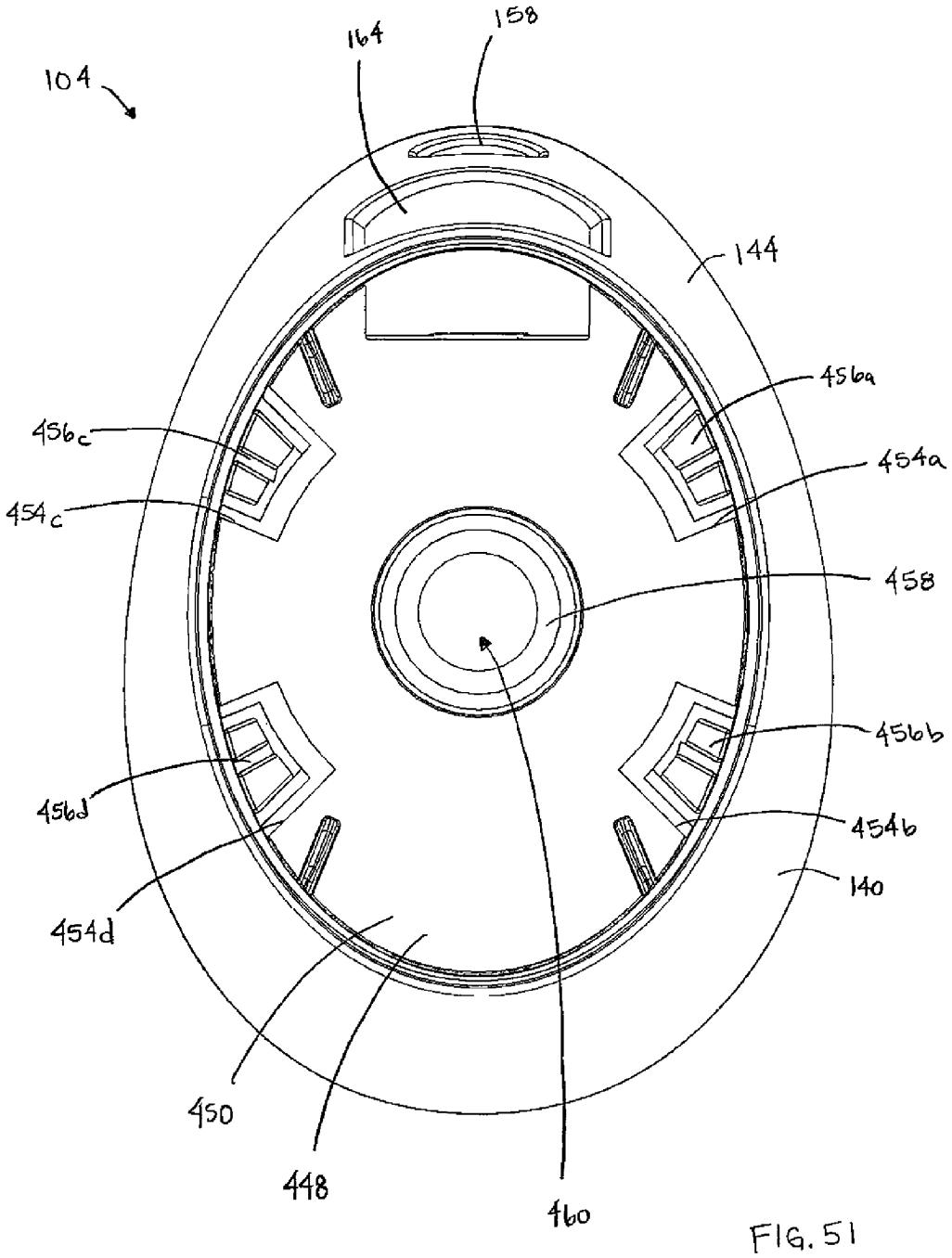
FIG. 51 is bottom elevational view of the overcap of FIG. 49.
Figure 52:
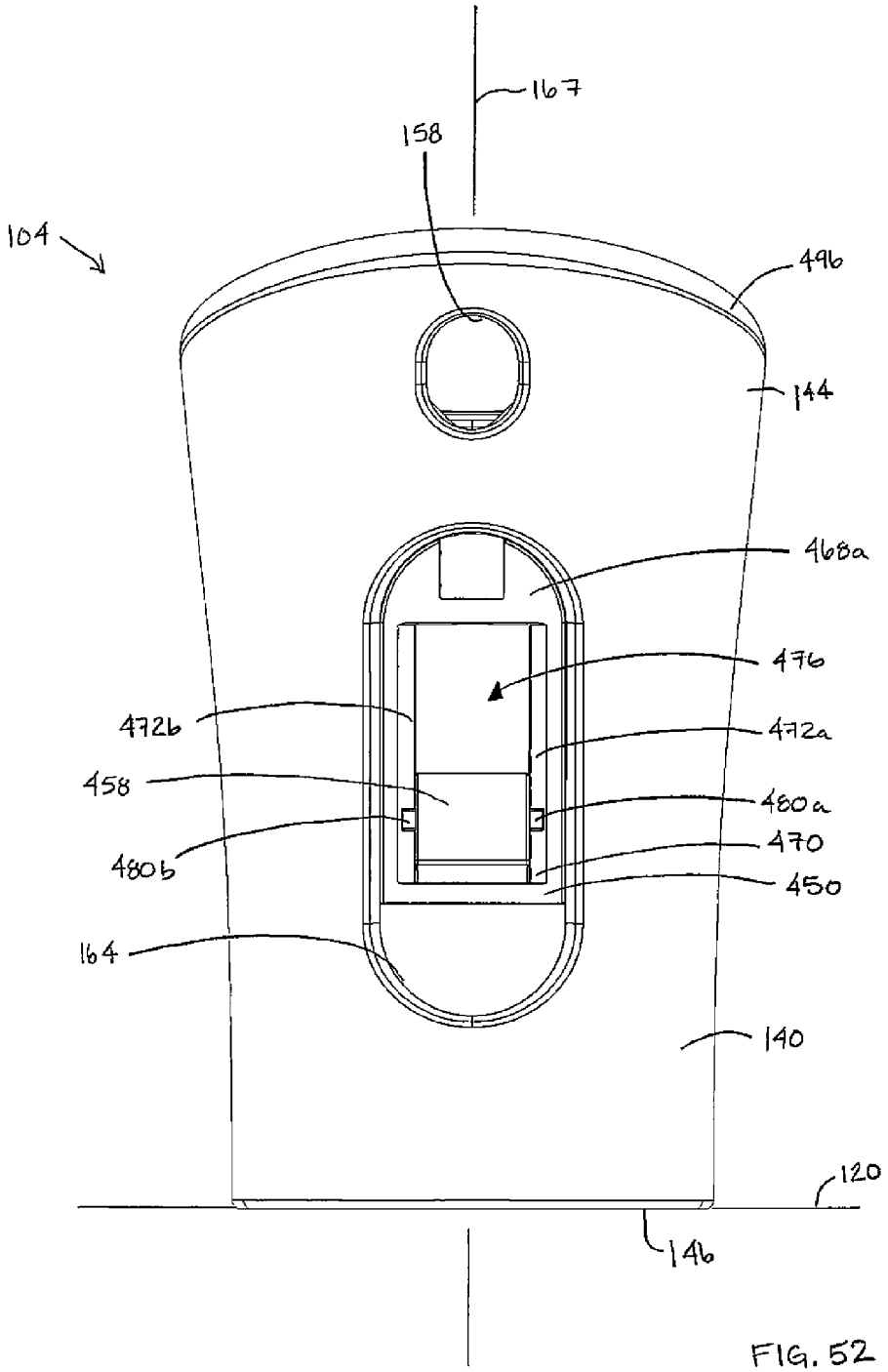
FIG. 52 is a front elevational view of the overcap of FIG. 43, wherein the actuator and the manifold have been removed.

Referring to FIGS. 49-52, a housing 466 is disposed within the chamber 168 of the overcap 104. The housing 466 includes first and second housing portions 468*a*, 468*b*, respectively. The first portion 468*a* extends into the chamber 168 from the interior surface 452 of the front side 154 of the body 140. The first portion 468*a* surrounds and is similarly shaped to the opening 164 and is bounded on a lower end 470 by the platform 450. The second portion 468*b* of the housing 466 extends from an end of the first housing 468*a* to the circular opening 460. The second portion 468*b* includes first and second sidewalls 472*a*, 472*b* and a top wall 474, which define a rectangular channel 476 (see FIG. 52). As seen in FIGS. 49 and 50 the top wall 474 includes a curved cutout 478 at a distal end thereof. The curved cutout 478 is designed to substantially mirror the shape of the cylindrical wall 458. Two opposing slots 480*a*, 480*b* are disposed within the first and second walls 472*a*, 472*b*, respectively (see FIG. 52), of the rectangular channel 476. A manifold support 482 (see FIGS. 49 and 50) extends into the chamber 168 from the inner surface 452 above the first housing portion 468*a*.

Now referring to FIGS. 53-55, the actuator 402 and the manifold 404 are depicted within the chamber 168 of the modified overcap 104. The manifold 404 extends upwardly through the cylindrical wall 458 located on the horizontal platform 450 (see FIG. 54). The collar 436 of the manifold 404 is disposed between the manifold support 482 and the front side 154 of the body 140. The rails 408*a*, 408*b* and the body 406 of the actuator 402 are disposed within the channel 476 of the housing 466 and the slots 480*a*, 480*b* in the sidewalls 472*a*, 472*b* receive the ribs 412*a*, 412*b*, respectively. The elongate button 162 extends through the opening 164 within the body 140, as described above. As the actuator 402 is inserted into the overcap 104 the hook 420 is resilient enough to bend and then snap into place behind the manifold support 482, thus preventing the actuator 402 from being removed from the device.

Figure 56:
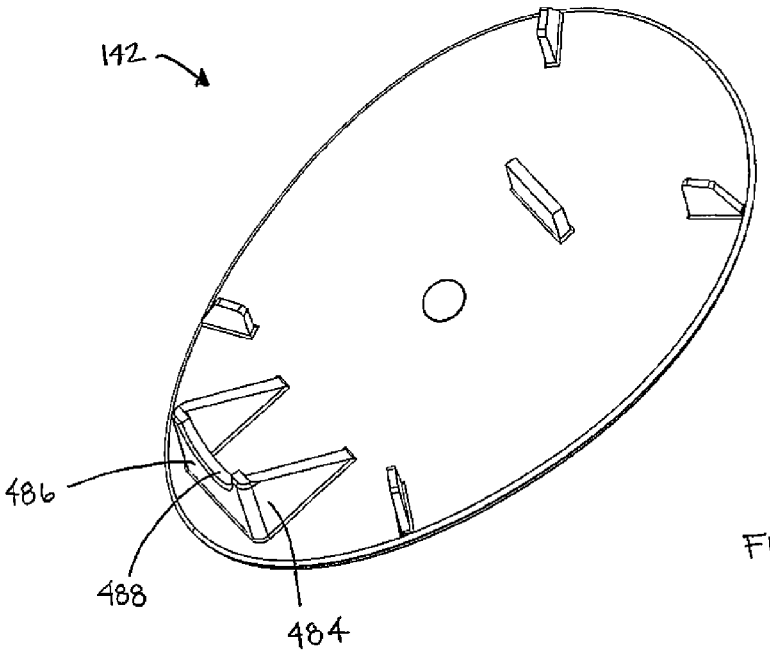
FIG. 56 is an isometric view of a bottom, front, and right side of the top end of FIG. 43.
Figure 57:
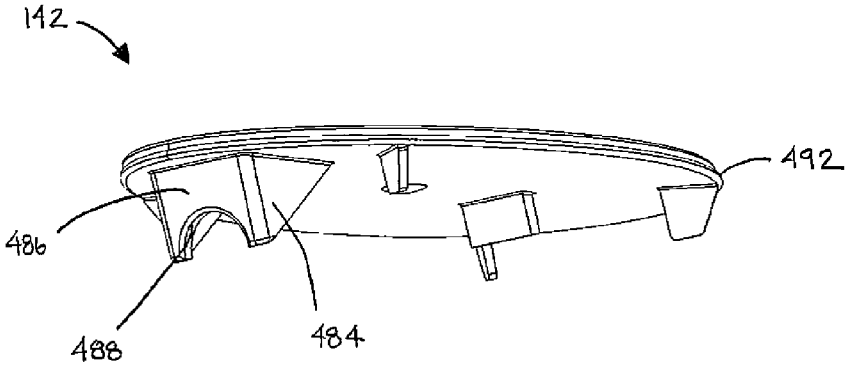
FIG. 57 is an isometric view of a bottom, front, and left side of the top end of FIG. 56.
Figure 58:
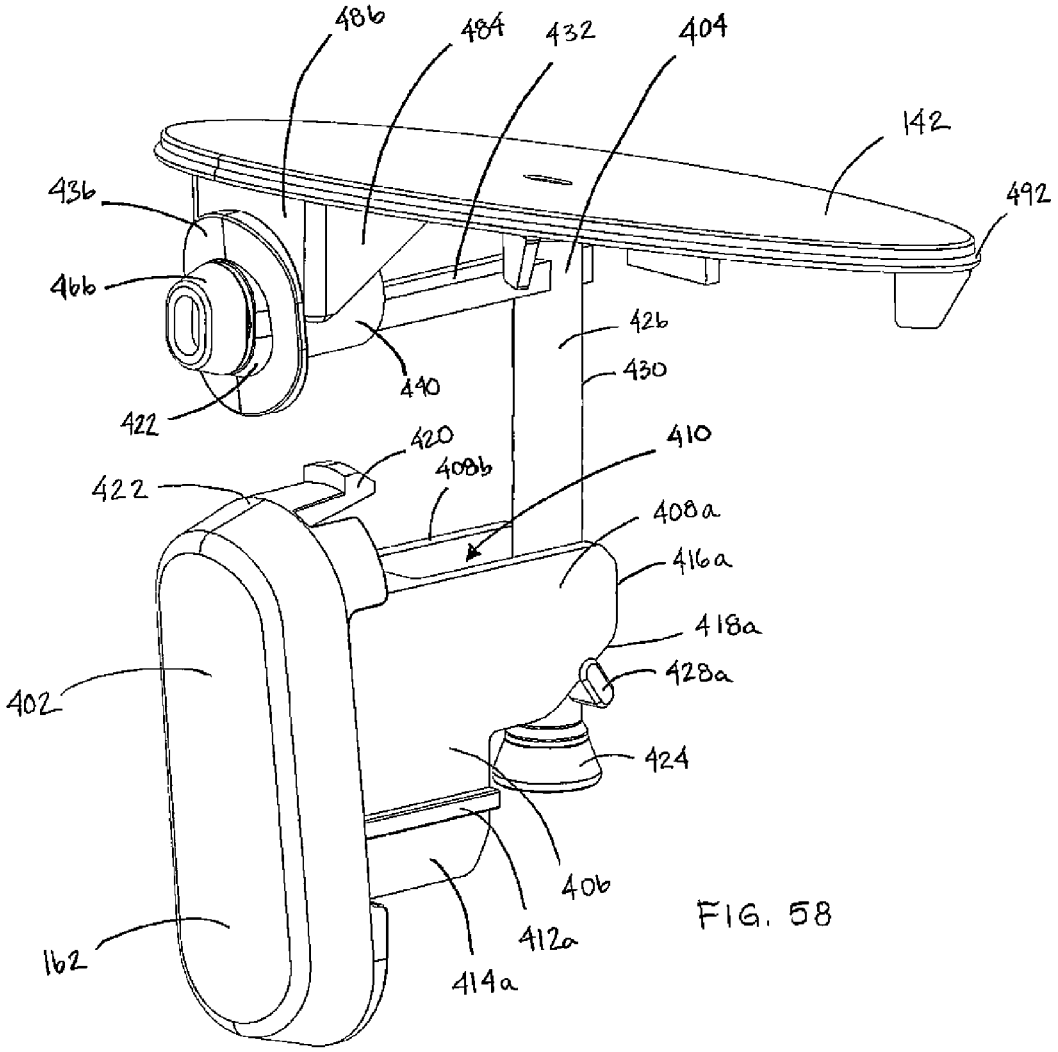
FIG. 58 is an isometric view of a top, front, and left side of the actuator, manifold, and top end of FIG. 43.
Figure 59:
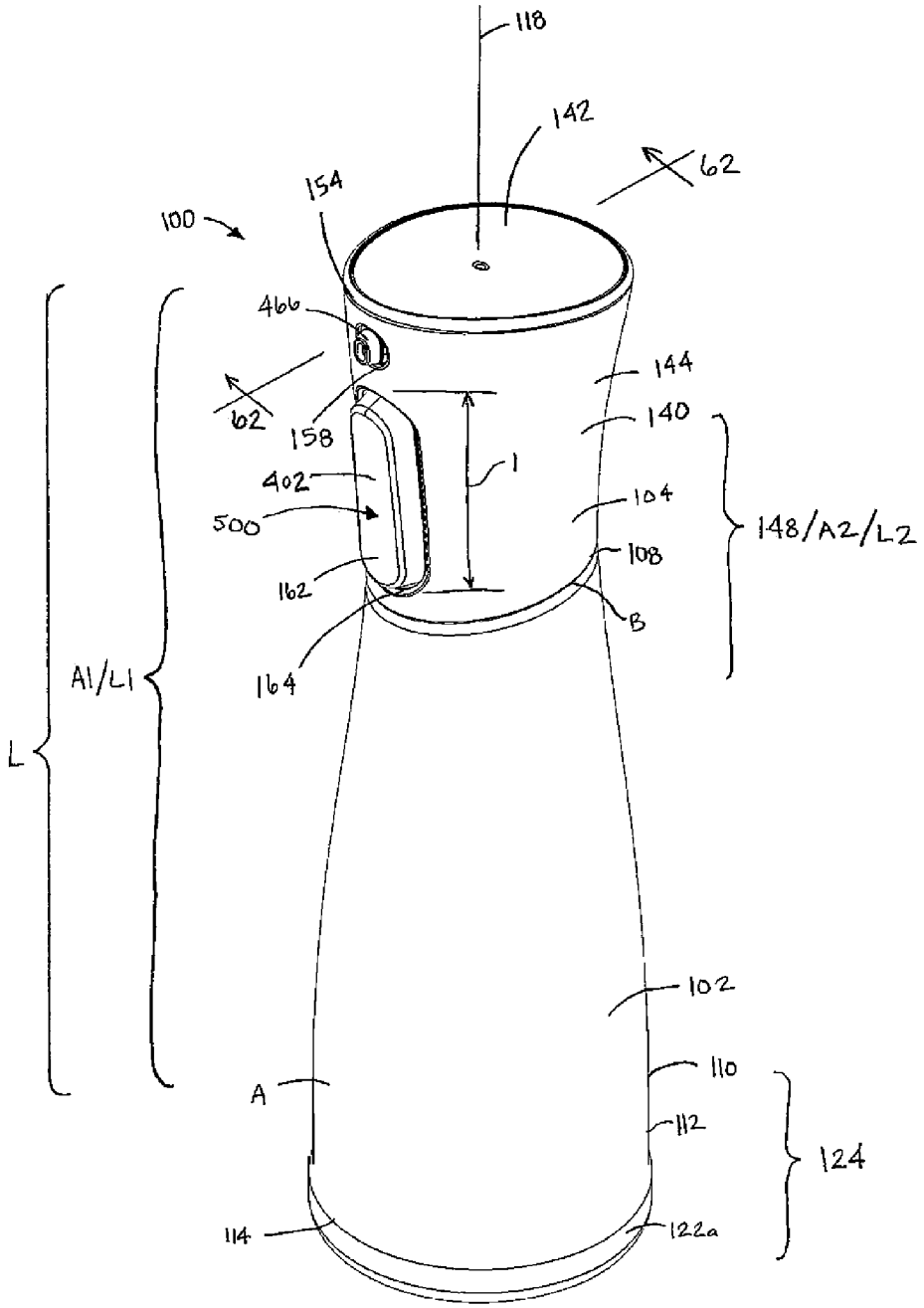
FIG. 59 is an isometric view of a top, front, and left side of the dispensing system of FIG. 1, which includes a third embodiment of an actuation mechanism.

As shown in FIGS. 56-58, the top end 142 of the overcap 104 in the present embodiment includes a depending top end projection 484. The projection 484 includes a front wall 486 with a U-shaped cutout 488. The top end 142 also includes a rail 492 located around a perimeter of the top end 142. As shown in FIGS. 54 and 55, the top end 142 is attached to the body 140 by snapping the rail 492 into a slot 494 (see FIG. 53) located within the inner surface 452 near an upper edge 496 of the body 140. The slot 494 forms a complete track around inner surface 452 of the upper edge 496 of the body 140. Ribs 498 project from the inner surface 452 of the body 140 just below the slot 494. The ribs 498 prevent the top end 142 from being inserted too far within the body 140 (see FIGS. 54 and 55). When the top end 142 is inserted into the body 140, the U-shaped cutout 488 of the projection 484 fits over the bezel 434 of the manifold 404 (see FIG. 58). The front wall 486 is disposed behind the collar 436 of the manifold 404.

In use, a user applies a lateral force F to any part of the elongate button 162 in a direction substantially perpendicular to the longitudinal axis 167. The lateral force F on the button 162 forces the rails 408*a*, 408*b* laterally in the direction of the arrow F within the overcap 104. The movement of the rails 408*a*, 408*b* is constrained in the lateral direction by the rectangular channel 476 and the combination of the ribs 412*a*, 412*b* and the slots 480*a*, 480*b*. The lateral movement of the rails 408*a*, 408*b* causes the angled sections 418*a*, 418*b* to abut against the opposing racetrack shaped protrusions 428*a*, 428*b* that extend from the exterior surface 430 of the first tube 426 of the manifold 404, respectively. The lateral movement of the rails 408*a*, 408*b* causes the racetrack shaped protrusions 428*a*, 428*b* to ride down the angled sections 418*a*, 418*b*, thereby forcing the first tube 426 of the manifold 404 downwardly. The downward movement of the first tube 426 causes the depression of the valve stem 130, which in turn opens the valve assembly of the container 102. The opening of the valve assembly causes fluid to be emitted from the container 102 as described above.

The lateral force F necessary to actuate the device when applied to the upper portion 162*a* of the elongate button 162 is substantially similar and/or identical to the force needed to actuate the device from the middle and lower portions 162*b*, 162*c*, respectively. In one particular embodiment, the forces are statistically equivalent. It is anticipated that all of the elongate buttons disclosed herein, which utilize substantially transverse motion to actuate the dispensing system, will provide the user the freedom to actuate the button anywhere about the length of the elongate button without having to exert undue strain or substantial additional force in comparison to the actuation of the elongate button from a different location about the length thereof. A test was performed to determine the force necessary to actuate the elongate button 162 of FIG. 44 on the dispensing system 100 of FIG. 43. A tensile/compression machine manufactured by MTS Systems Corp., e.g., a Sintech 2D machine, was used to measure the force required to actuate the elongate button 162 about the upper, middle, and lower portions 162*a-c*. Force measurements were taken nine times at each of the portions 162*a-c*, the results of which are listed in Table 2 below:

TABLE 2

| Specimen # | Upper Portion Peak Load (lbf) | Middle Portion Peak Load (lbf) | Lower Portion Peak Load (lbf) |
|---|---|---|---|
| 1 | 10.329 | 8.093 | 8.017 |
| 2 | 9.157 | 7.509 | 7.995 |
| 3 | 6.907 | 6.916 | 7.995 |
| 4 | 5.080 | 5.185 | 7.686 |
| 5 | 8.301 | 8.668 | 8.592 |
| 6 | 7.470 | 8.910 | 9.977 |
| 7 | 9.305 | 7.953 | 8.884 |
| 8 | 9.625 | 6.935 | 7.341 |
| 9 | 8.343 | 8.170 | 9.820 |
| Mean | 8.280 | 7.593 | 8.474 |
| Std. Deviation | 1.605 | 1.135 | 0.926 |

As shown in Table 2, the force needed to actuate the actuation mechanism 400 through the elongate button 162 has a substantially uniform force profile along the length l of the button 162. Specifically, the mean force required to actuate the elongate button about the upper, middle, and lower portions 162*a-c* is 8.280 lbf, 7.593 lbf, and 8.474 lbf, respectively, with standard deviations of 1.605, 1.135, and 0.926, respectively. The difference in force F necessary to actuate the device at the upper, middle, and lower portions 162*a-c*, is not noticeable and/or significantly noticeable to a user. Indeed, it is preferable that the greatest mean difference in force required to actuate the actuation mechanism be between about 0 to about 2 lbf, and more preferably between about 0 and about 1 lbf, and most preferably about 0 lbf. Such a range will provide the user with a uniform or substantially uniform force profile to actuate the dispensing mechanism with greater ease. The user will be able to place at least one finger anywhere along the length l of the button 162 and effectively actuate the device without the user having to exert a greater actuation force about one of the portions 162*a-c*. Additionally, any user, regardless of the size of their hands, can actuate the elongate button 162 without having to strain to reach a certain section. Moreover, the user can grip the dispensing system 100 wherever it feels most comfortable and is not constrained to a specific area based on where it is easiest to actuate the button 162. It is contemplated that the other embodiments disclosed herein will also have a uniform or substantially uniform force profile along the length l of the elongate button 162 to actuate the dispensing system.

FIGS. 59-62 illustrate a third embodiment of an actuation mechanism 500. The actuation mechanism 500 is similar to the second embodiment except for the below noted differences. The elongate button 162 of the actuation mechanism 500 has a longer length dimension l than the actuation mechanism 400. The longer length dimension l provides the user with a larger area for actuating the dispensing system. The overcap 104 is also modified to accommodate the longer button 162. The opening 164 within the body 140 is similarly shaped to accommodate the elongate button 164 with the longer length dimension l.

Figure 61:
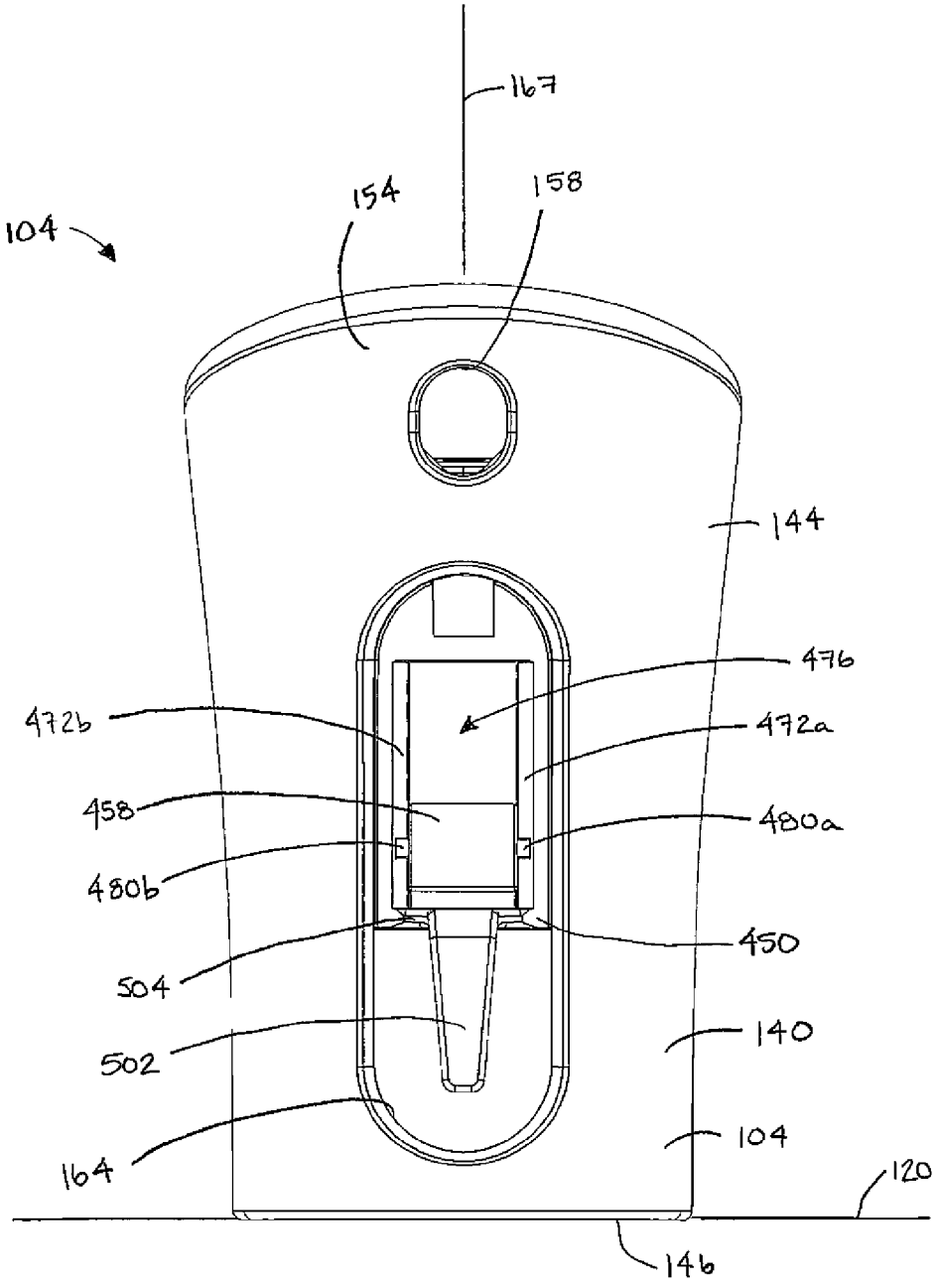
FIG. 61 is a front elevational view of the overcap of FIG. 60, wherein the actuation mechanism has been removed.
Figure 62:
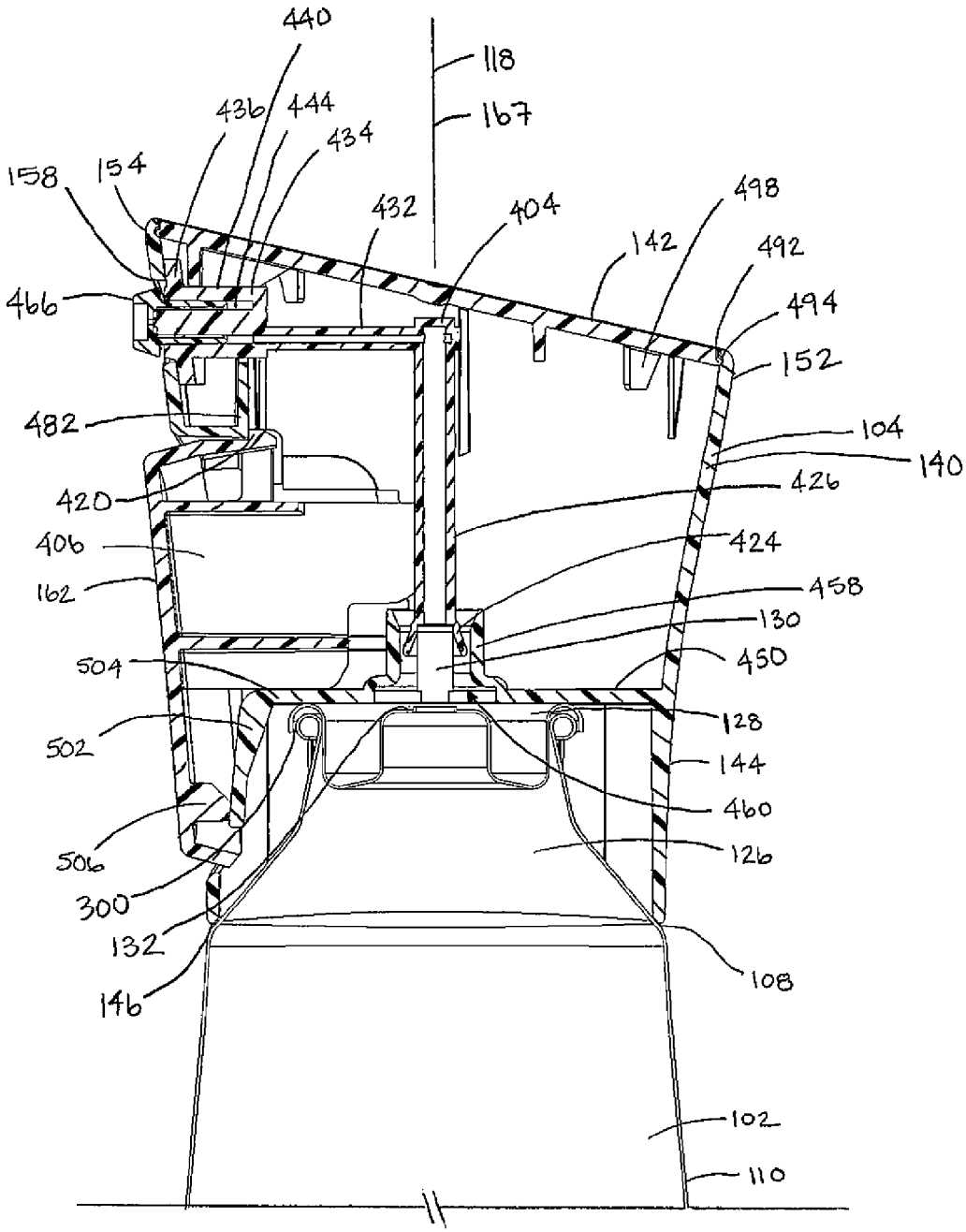
FIG. 62 is a partial cross-sectional view of the dispensing system and actuation mechanism of FIG. 59, generally taken along the line 62-62 of FIG. 59.

Additionally, as seen in FIGS. 61 and 62 the horizontal platform 450 is modified to include a depending tab 502 on a front end 504 of the platform 450 behind the opening 164. The tab 502 abuts a rearwardly extending protrusion 506 disposed on the elongate button 162. The tab 502 acts as a spring to return the button 162 to an unactuated position when the force is removed.

Figure 64:
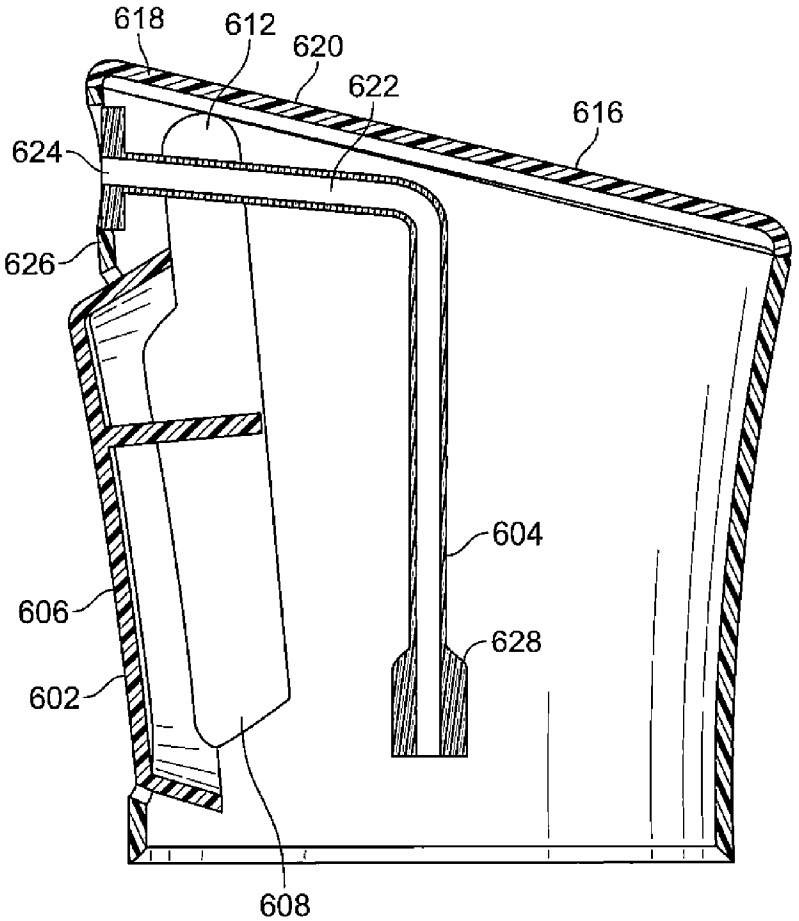
FIG. 64 is a schematic, cross-sectional view of the fourth actuation mechanism of FIG. 63 shown in combination with a body of an overcap with portions behind the plane of section omitted for purposes of clarity.
Figure 63:
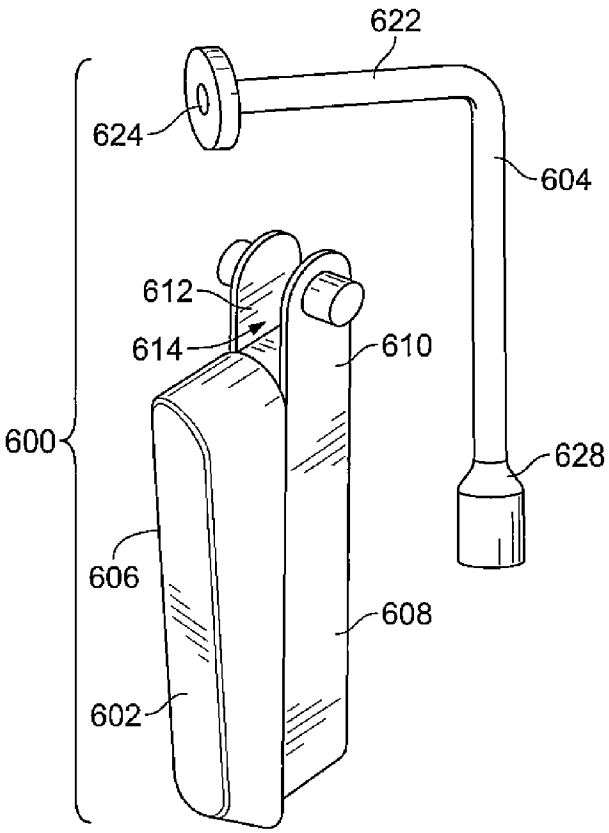
FIG. 63 is an exploded isometric view of a front, top, and left side of a fourth actuation mechanism.

Turning now to FIGS. 63 and 64, a fourth embodiment of an actuation mechanism 600 for use in the dispensing system 100 is depicted, which broadly comprises a pivot actuator 602 and a manifold 604. The pivot actuator 602 includes an elongate button 606 and an arm 608. The arm 608 includes first and second extensions 610, 612, which have a channel 614 therebetween. The first and second extensions 610, 612 are pivotably attached to a sidewall 616 of an overcap 618 adjacent a top end 620 thereof. A distal portion 622 of the manifold 604 extends through the channel 614 so that a nozzle 624 of the manifold 604 may be disposed adjacent an opening 626 of the sidewall 616. In use, pressure is applied to any part of the elongate button 606, which causes the first and second extensions 610, 612 to rotate and the elongate button 606 to flex inwardly toward the manifold 604. As the elongate button 606 flexes inwardly, a portion of the arm 608 defining the channel 614 abuts against the distal portion 622 of the manifold 604 to cause same to rotate a proximal end 628 of the manifold 604 down and toward the elongate button 606, thereby providing a sufficient force to depress a valve stem of a conventional aerosol container and dispense the contents therefrom (not shown).

Figure 66:
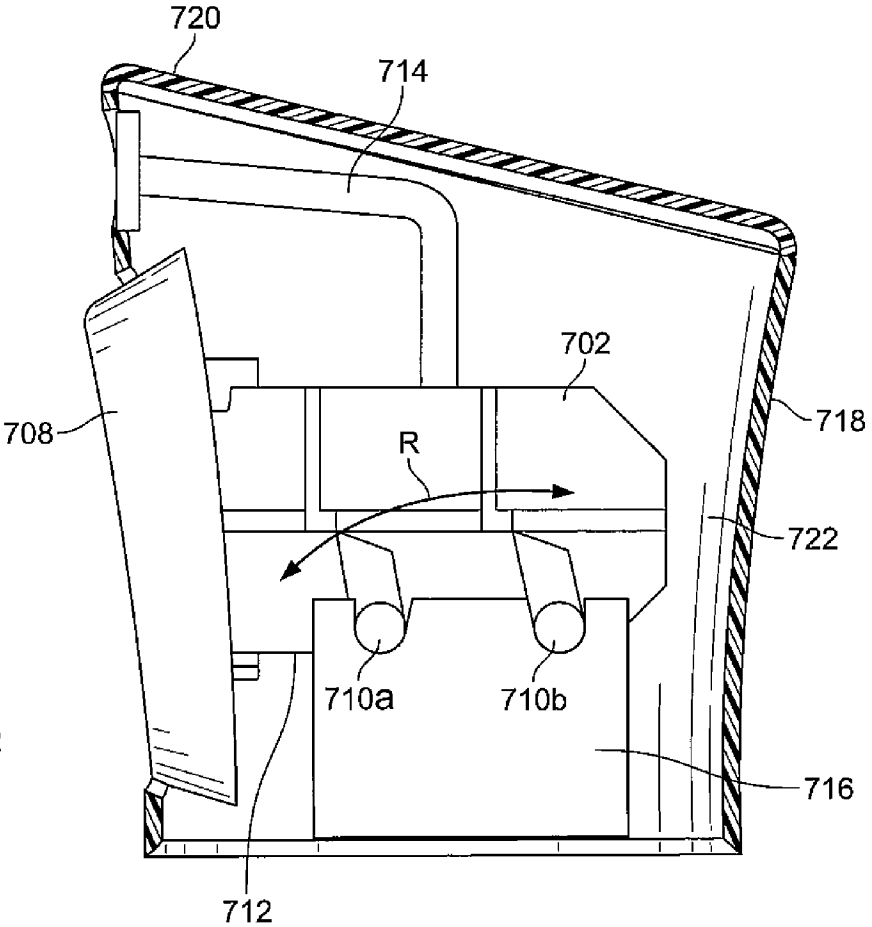
FIG. 66 is a schematic, partial cross-sectional view of the fifth actuation mechanism of FIG. 65 shown in combination with a body of an overcap with portions behind the plane of section omitted for purposes of clarity.
Figure 65:
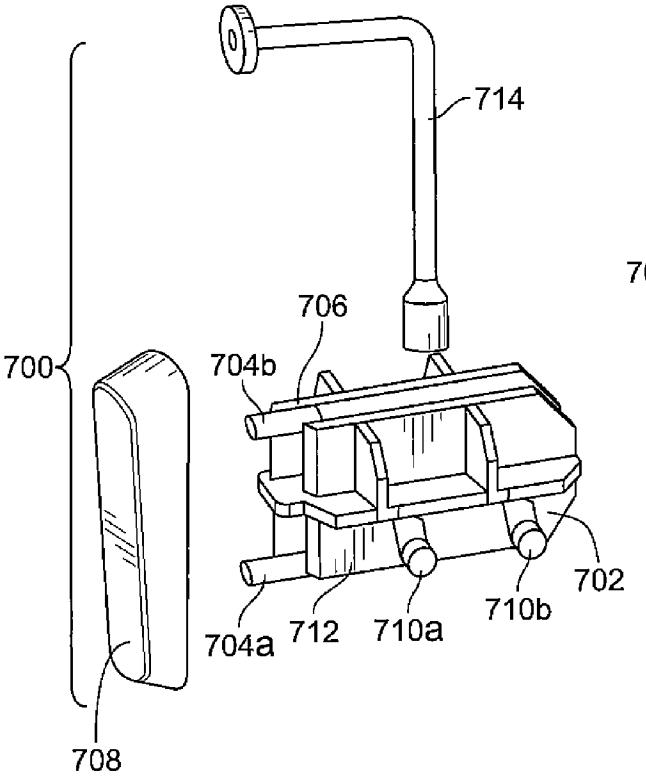
FIG. 65 is an exploded isometric view of a front, top, and left side of a fifth actuation mechanism.

Now referring to FIGS. 65 and 66, a fifth embodiment of an actuation mechanism 700 is shown that includes a bar actuator. The bar actuator includes an elongate body 702 with two rods 704*a*, 704*b* extending outwardly from a first end 706. The rods 704*a*, 704*b* are adapted to interact with an inside surface (not shown) of an elongate button 708. The elongate body 702 further includes resilient members 710*a*, 710*b* on a first side of the elongate body and opposing resilient members 710*c*, 710*d* (not shown), on an opposite side of the elongate body 702, respectively. The resilient members 710*a-d* are attached to and extend outwardly from a bottom portion 712 of the body 702. The resilient members 710*a-d* are adapted to allow the body 702 to rotate in a manner shown by the arrow R in FIG. 66 upon the application of a lateral force to the elongate button 708. A manifold 714 extends through a central channel (not shown) of the elongate body 702. The resilient members 710*a-d* rest in a base 716 built into a sidewall 718 of an overcap 720. In use, pressure is applied to the elongate button 708 to force the body 702 inwardly toward a back portion 722 of the overcap 720. As the elongate button 708 pushes against the rods 704*a*, 704*b*, the elongate body 702 rotatably slides so that portions on an interior of the body 702 impinge against and rotatably displace the manifold 714, which in turn displaces a valve stem of an aerosol container (not shown) to allow a fluid product to be released.

Figure 68:
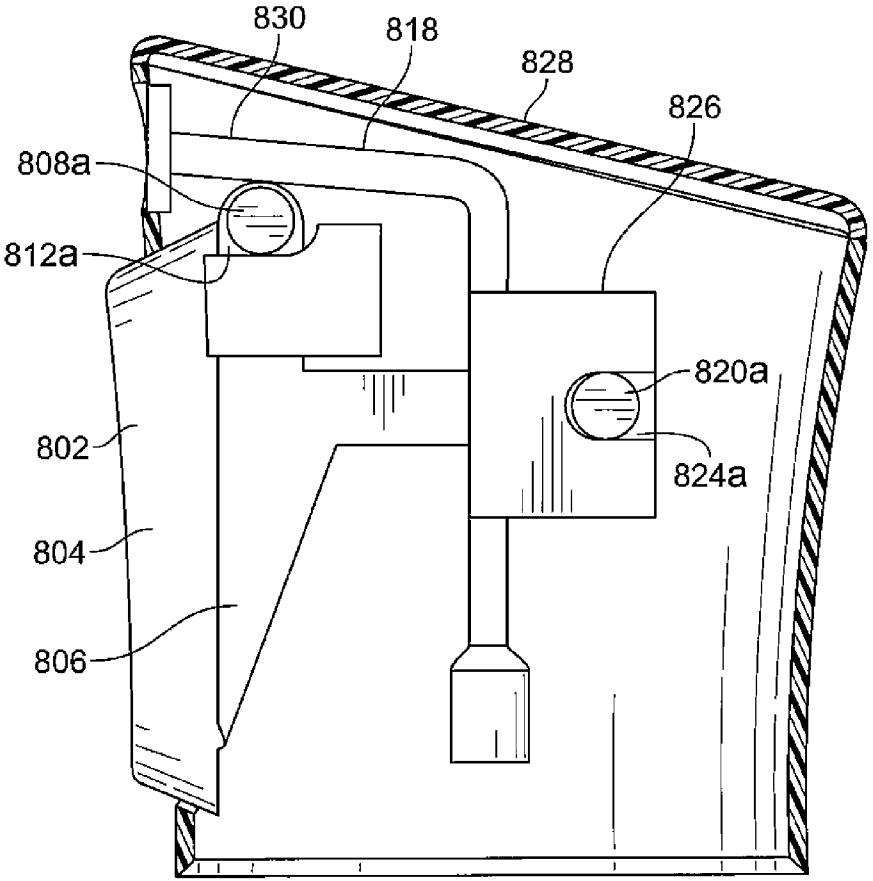
FIG. 68 is a schematic, partial cross-sectional view of the sixth actuation mechanism of FIG. 67 shown in combination with a body of an overcap with portions behind the plane of section omitted for purposes of clarity.
Figure 67:
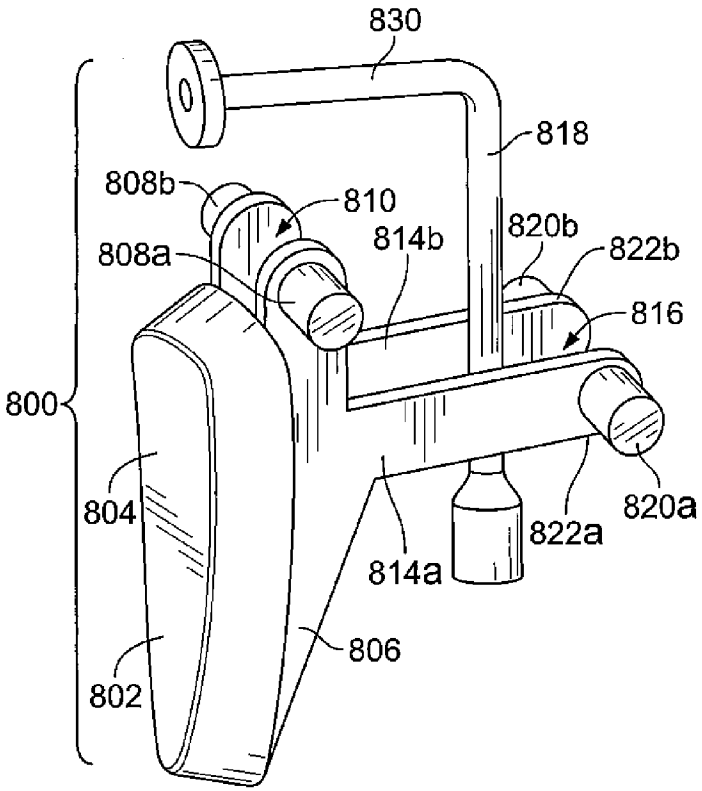
FIG. 67 is an isometric view of a front, top, and left side of a sixth actuation mechanism.

Turning to FIGS. 67 and 68, a sixth embodiment of an actuation mechanism 800 is depicted that broadly comprises a slider actuator 802 with an elongate button 804 and a body 806 extending therefrom. The body 806 includes an upwardly extending protrusion with bars 808*a*, 808*b* extending outwardly therefrom on opposing sides of an opening 810 that truncates the protrusion. The bars 808*a*, 808*b* rest within channels 812*a*, 812*b* (812*b* not shown), respectively. Two rails 814*a*, 814*b* extend outwardly from the body 806 and include a channel 816 formed therein. A manifold 818 is adapted to extend through the channel 816. Two bars 820*a*, 820*b* extend outwardly from distal ends 822*a*, 822*b* of each rail 814*a*, 814*b*, respectively. The bars 820*a*, 820*b* are adapted to be inserted into corresponding channels 824*a*, 824*b* (824*b* not shown), respectively, formed in a housing 826 within an overcap 828. When a force is applied to the elongate button 804, the bars 808*a*, 808*b*, 820*a*, 820*b* slide laterally within the channels 812*a*, 812*b*, 824*a*, 824*b*, wherein the bars 808*a*, 808*b* impinge against a distal end 830 of the manifold 818. Impingement of the bars 808*a*, 808*b* causes the manifold 818 to rotate downwardly and toward the elongate button 804, thereby displacing a valve stem of an aerosol container (not shown) to dispense a fluid product therefrom.

In any of the actuation mechanism embodiments discussed herein, it is contemplated that other types of valve stem assemblies may be utilized depending on the desired design criteria. Specifically, tilt-actuated valve stems may be used instead of vertically actuated valve stems to facilitate the release of the fluid product into the surrounding environment. It may be useful to provide a tilt-actuated valve stem in place of a vertically actuated valve stem because of space requirements within the overcap, e.g., there may not be enough space to provide a wedge or other protrusion to help effectuate downward motion. Further, if a vertically actuated valve stem is being utilized in the dispensing system, an inclined surface or any other protrusion may be added to any of the actuators to help facilitate vertical actuation.

Figure 69:
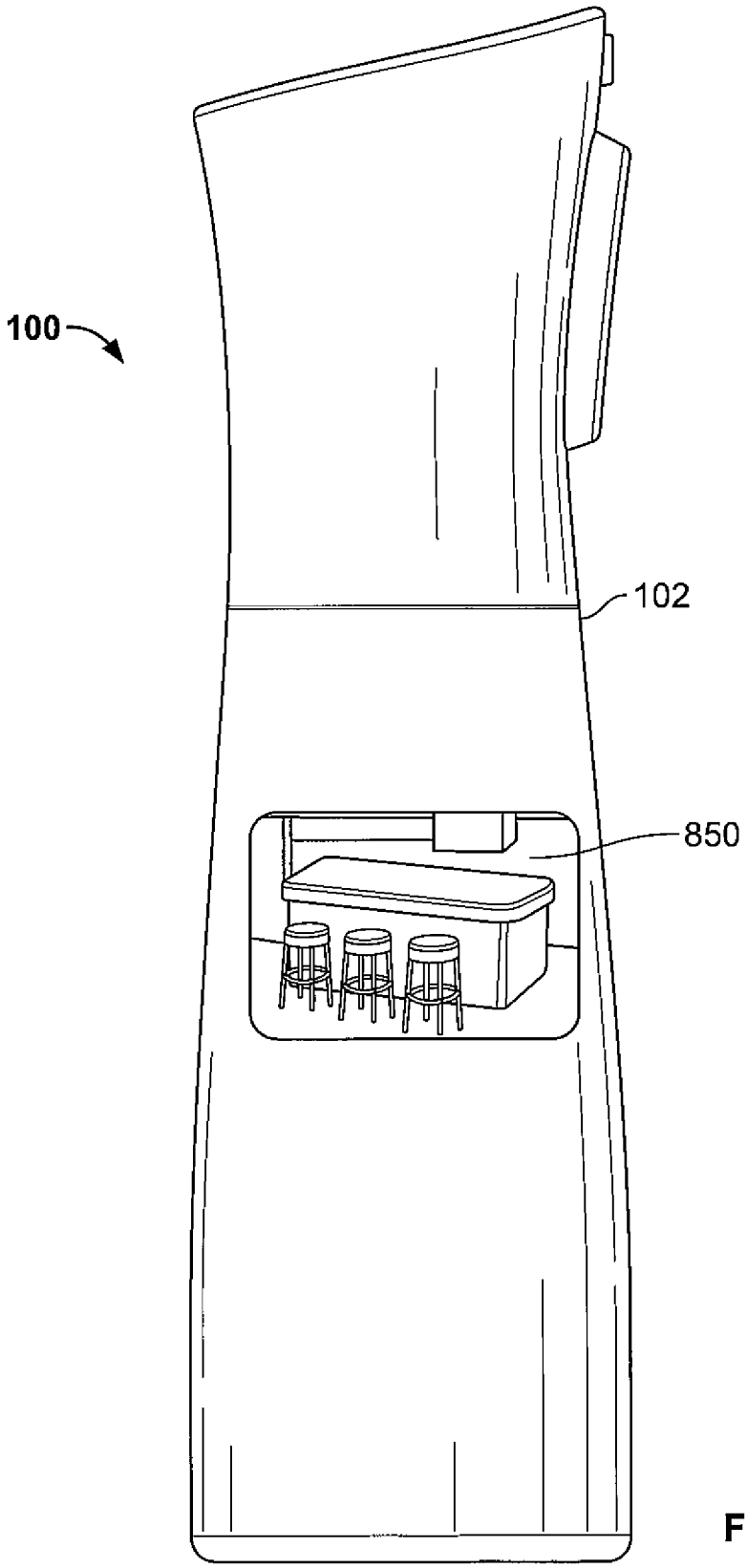
FIG. 69 is a right side elevational view of the dispensing system of FIG. 1 further including a visual communication element.

Turning to FIG. 69, a visual communicative element 850 is further included in the dispensing system 100 described herein. The visual communicative element 850 is in the form of a picture or schematic diagram. In one embodiment, the picture depicts a room or area that the dispensing device is to be used in, thereby giving the user a visual instruction. In a different embodiment, the picture is a specialized recycling symbol that reassures and reminds the user that the dispensing system is capable of being recycled post-consumer use. The visual communicative element 850 provides numerous advantages over traditional printed instructions. Specifically, the user saves time by easily ascertaining the proper use of the dispensing device. The user is also able to quickly determine items that the dispensing device is safe to use with. For example, one visual element 850 depicts a living room with furniture therein. The living room includes furniture and surfaces that are safe to clean with the dispensing device. The visual communicative element 850 also provides illustrative instructions for using the device to persons who may not otherwise understand or be able to read and/or see the printed directions. For example, non-native English speakers, elderly persons, and persons with reading disabilities may find the visual communicative element 850 effective to communicate the desired use of the dispensing system 100.

Figure 70:
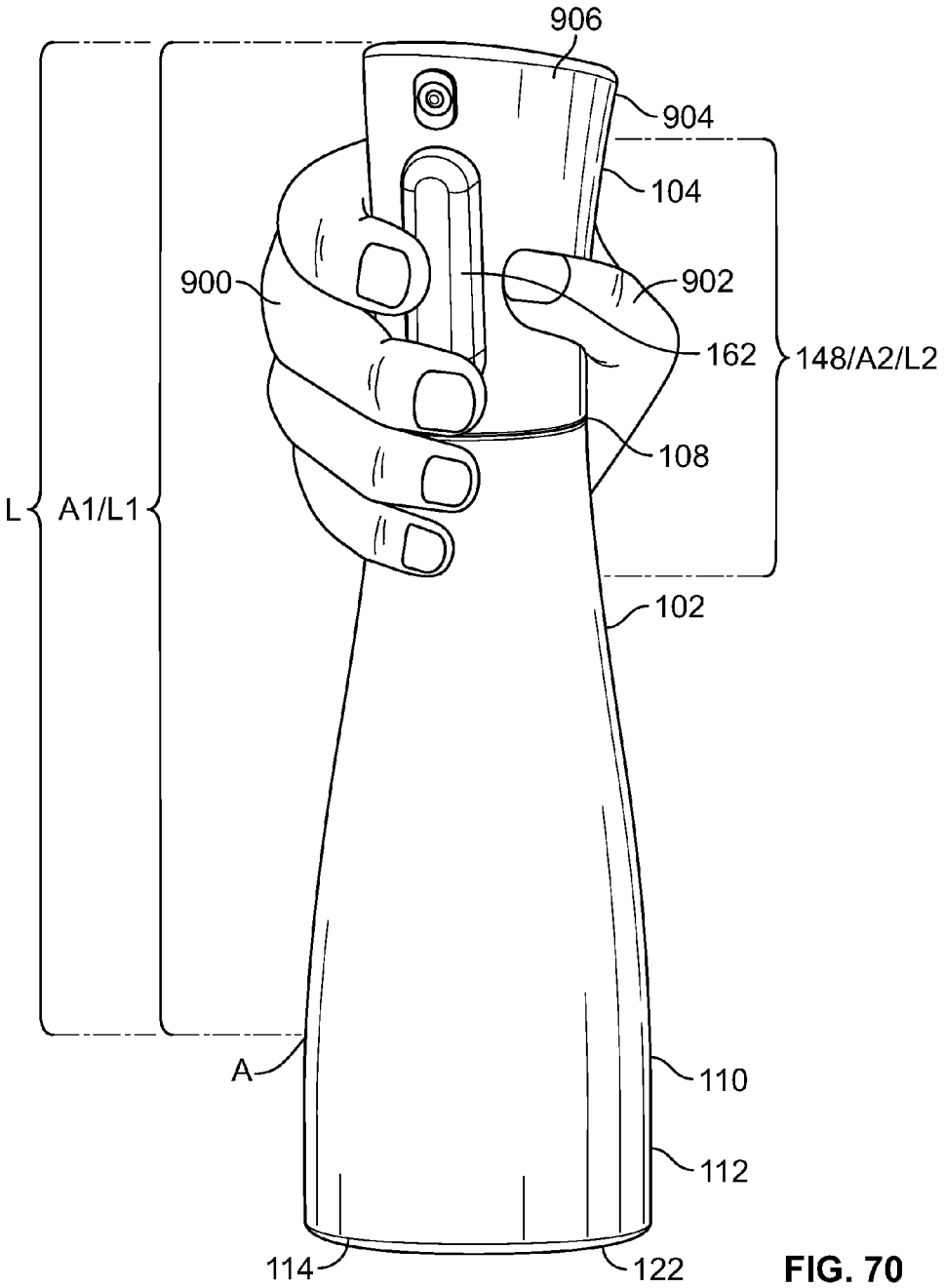
FIG. 70 is the dispensing system of FIG. 1 in a dispensing position.

In use, the dispensing system 100 is adapted to be held in a hand of a user. For purposes of describing the present dispensing system 100, same will be considered held when the dispensing system 100 is being solely or partially supported through effort of the user. One example of a non-dispensing position is depicted in FIG. 1, wherein the longitudinal axis 118 of the container 102 is perpendicular to the support surface 116 and the top portion 106 (shown in FIG. 3) of the container 102 faces upwardly without aid of a user. In a dispensing position, the user grasps the dispensing system 100 around the narrowest section 148, e.g., A2, (or, alternatively the gripping section A1) of the dispensing system 100, which is depicted in FIG. 70. A plurality of user fingers 900 are wrapped around the dispensing system 100 at an area adjacent the seam 108 and disposed on the elongate button 162. A user's thumb 902 extends around the dispensing system 100 in an opposite manner as the user's fingers 900. A palm (not shown) of the user's hand contacts and wraps around the dispensing system 100 from a back surface 904 toward a front surface 906 adjacent the seam 108. When a user holds the dispensing system 100 in the dispensing position depicted in FIG. 70, the finger(s) 900, thumb 902, and other portions of a user's hand exert transverse forces against the narrowest section 148 of the dispensing system 100 to resist forces developed by the weight of the dispensing system 100 and the product therein. The forces are distributed about the user's hand, which allows for a more secure grip and greater control during a dispensing operation. A user may also easily use a dominant or non-dominant hand to actuate the elongate button 162, because the large surface area of the elongate button 162 gives the user more flexibility in pressing same with one or more fingers and the narrowed sidewall facilitates a user's grasp of the dispensing system 100. Further, use of a non-dominant hand gives the user an added advantage of using their dominant hand for cleaning and moving items as they clean, which makes for faster and more efficient cleaning.

The overall design of the dispensing system 100 is adapted to provide enhanced spraying characteristics while providing an ergonomic gripping surface. The narrowest section 148 of the dispensing system 100 is smaller than the width of the base 112 of the container 102 and smaller than the width of the top portion 142 of the overcap 104. The larger width of the overcap 104 creates a shelf that is formed above and rests on the user's hand. When a user grasps the dispensing system, at least a portion of the weight of the system is supported on an upper edge of the user's hand during use. The weight supported on the upper edge of the user's hand helps to relieve pressure on the user's fingers during operation of the dispensing system 100. The larger width of the overcap 104 also makes it easier for the user to grab and lift the dispensing device from above as well as to provide an indicator to the user of the device itself. Further, some overcaps may be provided with a label or other form of indicia thereon. It is beneficial to be able to easily lift a device from above because these types of devices are often stored in low cabinets and shelves where the user must reach down to remove them.

The present dispensing system 100 is therefore provided with ergonomic characteristics that make it easier to hold and actuate than seen in conventional dispensing systems. Further, such dispensing systems provide a user the ability to quickly ascertain the specific product they are looking for based upon the unique shape of the dispensing systems. Such benefits are further enhanced when a user holds the dispensing system 100 away from their body during use. In such instances, it has been found that conventional dispensing systems, e.g., a finger actuated button on a top end of an aerosol container, are harder to hold away from a user's body for appreciable periods of time, are difficult to hold away from a user's body while simultaneously actuating, and require greater force requirements to actuate.

INDUSTRIAL APPLICABILITY

The dispensing system described herein advantageously allows for the dispensing of a fluid product therefrom. Various features provide a tapered ergonomic gripping surface and give visual and spatial indicators to the user to facilitate product dispensing. Other features provide for the dispensing of a fluid product by application of lateral forces to an actuator.

Numerous modifications will be apparent to those skilled in the art in view of the foregoing description. Accordingly, this description is to be construed as illustrative only and is presented for the purpose of enabling those skilled in the art to make and use what is herein disclosed and to teach the best mode of carrying out same. All patents, patent applications, and other references cited herein are incorporated herein by reference as if they appear in this document in their entirety. The exclusive rights to all modifications which come within the scope of this disclosure are reserved.

We claim:

1. An overcap for a container, comprising:

a body having a tapered section forming a surface of a sidewall, wherein an opening is provided in the sidewall; and an actuation mechanism including an actuator with an elongate button and a manifold, wherein the elongate button extends through the opening in the sidewall, wherein the elongate button has a length 1 in a direction about a longitudinal axis of the overcap and includes an upper portion, a middle portion, and a lower portion, wherein the length 1 of the elongate button is at least about 40 mm, wherein the actuation mechanism is actuable to open a valve of a container by only a sliding movement of the elongate button in a direction substantially perpendicular to the longitudinal axis of the overcap, and wherein a force F is to be exerted upon the upper portion, the middle portion, or the lower portion of the elongate button, and the minimum force necessary to actuate the actuation mechanism by pressing the middle portion of the elongate button is within a range of about 0 to about 1 lbf of the minimum force necessary to actuate the actuation mechanism by pressing either of the upper portion or the lower portion of the elongate button.

2. The overcap of claim 1, wherein the overcap is connected to a container with a valve, and wherein opening the valve causes a fluid to be emitted therefrom.

3. The overcap of claim 1, wherein the sidewall includes a continuously varying cross-sectional area measured about the longitudinal axis between a bottom end and a top end of the overcap.

4. The overcap of claim 3, wherein the cross-sectional area of the overcap continuously increases from the bottom end to the top end.

5. The overcap of claim 2, wherein the container includes an area of continuously varying cross-section beneath a bottom end of the overcap and the sidewall of the overcap includes an area of continuously varying cross-section above the bottom end thereof measured about the longitudinal axis of the overcap.

6. The overcap of claim 5, wherein the areas of continuously varying cross-section of the container and the sidewall define a gripping area.

7. The overcap of claim 6, wherein the gripping area is between about 90 mm to about 249 mm.

8. The overcap of claim 1 further including an outlet orifice for a nozzle extending through the sidewall, wherein the elongate button is disposed between the outlet orifice and a bottom end of the overcap.

9. The overcap of claim 1, wherein a ratio between the length and a width of the button is between about 5:1 and about 1:1.

10. The overcap of claim 1, wherein the actuator further includes at least one rail adapted to impinge against at least one protrusion extending from the manifold to force a portion of the manifold downwardly in a direction substantially parallel to the longitudinal axis of the overcap when the elongate button is moved in a direction substantially perpendicular to the longitudinal axis of the overcap.

11. The overcap of claim 10 further including a housing disposed within an interior of the body, wherein the housing includes a channel with at least one groove disposed within a surface defining the channel that is in communication with at least one rib extending from the actuator to restrain movement of the elongate button in a direction substantially perpendicular to the longitudinal axis of the overcap.

12. The overcap of claim 1, wherein the elongate button is returned to a pre-actuation position by a force provided only by one or more of a valve of the container and a manifold of the overcap.

13. The overcap of claim 1 further comprising an outlet orifice, wherein the elongate button is disposed on a same side of the overcap as the outlet orifice.

14. A dispensing system, comprising:

a container with a valve;

an overcap disposed on the container, wherein a portion of a sidewall of the container and the overcap has a continuously varying cross-section, which defines a gripping portion that extends a length L in a direction about a longitudinal axis of the dispensing system; and an actuator with an elongate button, wherein the elongate button extends through an aperture within the sidewall of the overcap, and has a length of 1 in a direction about the longitudinal axis of the dispensing system, wherein the actuator is adapted to open the valve of the container by movement of the elongate button only in a direction substantially perpendicular to the longitudinal axis of the dispensing system, wherein the length 1 of the elongate button is at least about 40 mm, and wherein a ratio of the length L of the gripping portion to the length 1 of the elongate button is at least about 1.5:1.

15. The dispensing system of claim 14, wherein the ratio of the length L of the gripping portion to the length 1 of the elongate button is between about 1.6:1 to about 5.2:1.

16. The dispensing system of claim 15, wherein the ratio of the length L of the gripping portion to the length of the elongate button is between about 2.1:1 to about 4:1.

17. The dispensing system of claim 14, wherein the elongate button is returned to a pre-actuation position by a force provided only by one or more of a valve of the container and a manifold of the overcap.

18. The dispensing system of claim 14, wherein the overcap defines an outlet orifice, the elongate button disposed between the outlet orifice and a bottom end of the overcap.

19. The dispensing system of claim 14, wherein the overcap comprises an outlet orifice, the elongate button and the outlet orifice disposed along an axis substantially parallel to the longitudinal axis of the dispensing system.

20. A dispensing system, comprising:

a container with a valve;

an overcap seated on the container;

an actuator with an elongate button, wherein the elongate button extends through an aperture within the sidewall of the overcap, and has a length of 1 in a direction about a longitudinal axis of the dispensing system; and a non-written visual communicative element disposed on a sidewall of the container, wherein the visual communicative element provides instructions for using the dispensing system, wherein the actuator is adapted to open the valve of the container by only a sliding movement of the elongate button in a direction substantially perpendicular to the longitudinal axis of the dispensing system, and wherein the length 1 of the elongate button is at least about 40 mm.

21. The dispensing system of claim 20, wherein the visual communicative element is a picture.

22. The dispensing system of claim 20, wherein the visual communicative element is a schematic diagram.

23. The dispensing system of claim 20, wherein the elongate button is returned to a pre-actuation position by a force provided only by one or more of a valve of the container and a manifold of the overcap.

24. The dispensing system of claim 20, wherein the overcap defines an outlet orifice spaced apart from a bottom end of the overcap by a first minimum distance, and wherein the elongate button is spaced apart from the bottom end of the overcap by a second minimum distance, the first minimum distance greater than the second minimum distance.

25. The dispensing system of claim 20, wherein the direction of movement of the elongate button to open the valve is a first direction, the dispensing system to dispense a fluid product from the dispensing system in a second direction different than the first direction.

* * * * *